US007056652B2

(12) United States Patent
Kashiwagi

(10) Patent No.: US 7,056,652 B2
(45) Date of Patent: Jun. 6, 2006

(54) SILVER SALT PHOTOTHERMOGRAPHIC DRY IMAGING MATERIAL

(75) Inventor: Hiroshi Kashiwagi, Hino (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 52 days.

(21) Appl. No.: 10/972,274

(22) Filed: Oct. 22, 2004

(65) Prior Publication Data

US 2005/0112514 A1 May 26, 2005

(30) Foreign Application Priority Data

Oct. 31, 2003 (JP) ..... 2003-371896
Jan. 7, 2004 (JP) ..... 2004-001923

(51) Int. Cl.
*G03C 1/00* (2006.01)
*G03C 1/08* (2006.01)
*G03C 7/26* (2006.01)
*G03C 7/32* (2006.01)

(52) U.S. Cl. ..... 430/617; 430/618; 430/619; 430/620; 430/517; 430/559

(58) Field of Classification Search ..... 430/617, 430/618, 619, 620, 517, 559
See application file for complete search history.

(56) References Cited

U.S. PATENT DOCUMENTS 6,649,337 B1 * 11/2003 Hioki et al. ..... 430/619
2004/0053177 A1 * 3/2004 Kashiwagi et al. ..... 430/619

* cited by examiner

*Primary Examiner*—Geraldine Letscher
(74) *Attorney, Agent, or Firm*—Lucas & Mercanti

(57) ABSTRACT

A silver salt photothermographic material is disclosed, comprising on a support a light-insensitive silver salt of an aliphatic carboxylic agent, light-sensitive silver halide grains, a reducing agent for silver ions and a binding agent, wherein the silver halide grains are those which are capable being converted from a surface latent image formation type to internal latent image formation type upon thermal development, and the photothermographic material further comprises a dye microcapsule dispersion or a dye compound containing at least two chromophores.

12 Claims, No Drawings

SILVER SALT PHOTOTHERMOGRAPHIC DRY IMAGING MATERIAL

FIELD OF THE INVENTION

The present invention relates to a silver salt photothermographic dry imaging material exhibiting minimized fogging, enhanced sensitivity, enhanced maximum density, superior image lasting quality after being thermally processed and improved resistance to staining or an offensive order caused by the heat-developing drum of a thermal processor, and an image forming method by use thereof.

BACKGROUND OF THE INVENTION

In the fields of medical diagnosis and graphic arts, there have been concerns in processing of photographic film with respect to effluent produced from wet-processing of image forming materials, and recently, reduction of the processing effluent has been strongly demanded in terms of environmental protection and space saving. Accordingly, there has been desired techniques relating to a photothermographic material in which efficient light-exposure is feasible as is done in a laser imager or laser image setter and by which definite, clear black images are obtained. There have been known a silver salt photothermographic dry imaging material comprising on a support an organic silver salt, light-sensitive silver halide and a reducing agent, as described in U.S. Pat. Nos. 3,152,904 and 3,487,075, and D. H. Klosterboer, "Dry Silver Photographic Materials" (Handbook of Imaging Materials, Marcel Dekker, Inc. page 48, 1991). This silver salt photothermographic dry imaging material (hereinafter, also denoted simply as photothermographic material) advantageously renders possible formation of distinct black images exhibiting high sharpness, enabling efficient exposure by means of a laser imager or a laser image setter. Thus, in the light-sensitive layer of the photothermographic material, light-sensitive silver halide and organic silver salt function as a photosensor and silver source, respectively, which are thermally developed at a temperature of 80 to 250° C. with the reducing agent to form images, without being further subjected to fixing.

The foregoing photothermographic material, after exposure, is processed by thermal developing at a temperature of from 80 to 250° C. without fixing, so that at least a part of silver halide, an organic silver salt or a reducing agent remains after thermal development, resulting in formation of metallic silver due to heat or light after storage over a long period of time and arising in problems that image quality such as silver image tone changes easily. There have been employed halogen compounds capable of oxidizing silver through photoinduction as a technique for preventing variation or deterioration of silver images and specific examples of such halogen compounds are disclosed, for example, in JP-A Nos. 7-2781, 6-208193 and 50120328 (hereinafter, the term, JP-A refers to an unexamined Japanese Patent Application Publication). However, the disclosed compounds, in general, have a tendency of displaying an oxidizing function upon thermal decomposition, and they are effective in preventing formation of fog or growth thereof, while it was also proved that there are problems that they inhibited silver image formation, leading to disadvantages such as reduction of sensitivity, maximum density and silver covering power. To overcome such problems, there is known the use of dyes capable of absorbing exposed light, so-called antihalation dyes. An antihalation dye, which is most effectively incorporated between a photosensitive layer and a support, exhibits interlayer diffusibility and is difficult to be fixed into an intended layer so that when photosensitive layer are simultaneously or successively coated, the dye diffuses into the photosensitive layers, resulting in competition for incident light with silver halide and leading to reduced sensitivity. In cases where a layer containing a pigment capable of absorbing exposed light is provided between a photosensitive layer and a support, color remained after thermal development becomes a problem. In light of the foregoing, specifically when coating a coating solution containing an organic solvent, there has been desired a technique of stably fixing a dye into a specific layer, specifically between the photosensitive layer and the support.

To overcome the foregoing problems, there is disclosed a technique of using dyes soluble in organic solvent with the intent of preventing halation caused by laser light, as disclosed in JP-A Nos. 8-201959 and 2001-83655. However, it is the present status that it is difficult to say that such a technique has overcome the foregoing problems.

To attain fixation, various techniques for micro-capsulation of dyes have been in the art. However, in the status, it is difficult to synthesize a microcapsule having a diameter capable of being stably incorporated into an intended layer and being coated, or to stably hold a dye contained in a core in an organic solvent.

SUMMARY OF THE INVENTION

Accordingly, it is an object of this invention to provide a silver salt photothermographic dry imaging material exhibiting minimized fogging, enhanced sensitivity, enhanced maximum density, superior image lasting quality after being thermally processed and improved resistance to staining or an offensive order caused by the heat-developing drum of a thermal processor, and an image recording method and image forming method by use thereof.

Thus, in one aspect this invention is directed to a silver salt photothermographic dry imaging material comprising on a support a light-insensitive silver salt of an aliphatic carboxylic acid, light-sensitive silver halide grains, a reducing agent for silver ions and a binder, wherein the silver halide grains are those which are capable being converted from a surface latent image type to an internal latent image type upon thermal development, and the photothermographic material further comprises a dye microcapsule dispersion or a dye compound containing at least two chromophores.

DETAILED DESCRIPTION OF THE INVENTION

First, there will be described constituting elements of the silver salt photothermographic dry imaging material.

The microcapsule relating to this invention means a minute enclosure and is a general term for one that has a size ranging from nanometers to micrometers. The microcapsule is comprised of a core as being the contents and a shell (or wall membrane) of enclosure. Any core comprised of a single nucleus or plural nuclei is included in the microcapsule of this invention. The core portion of the dye microcapsule contains a dye and a binder, in which the ratio of dye to binder (dye/binder) is from 0.1/99.1 to 99/1.

JP-A No. 2001-83655 discloses a method in which a filter layer is provided on the same side or on the opposite side of a photosensitive layer, or a dye is incorporated into a photosensitive layer to control the quantity or wavelength distribution of light transmitting through the photosensitive layer. In this invention, such a dye is incorporated through micro-encapsulation instead of incorporating through solution in a coating solvent, in which commonly known dyes are usable. There are usable commonly known dye compounds absorbing light at various wavelengths in response to spectral sensitivity of photographic material.

Examples of dyes usable in this invention include a dye represented by the following formula (I):

formula (I)

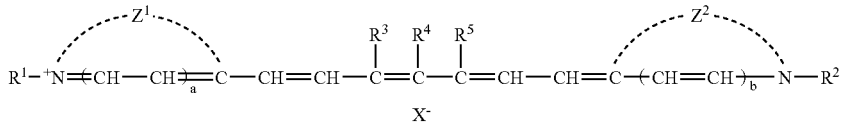

wherein $Z^1$ and $Z^2$ each represent a nonmetallic atom group necessary to form a 5- or 6-membered nitrogen containing heterocyclic ring, which may be condensed; $R^1$ and $R^2$ are each an alkyl group, an alkenyl group, or an aralkyl group; $R^3$ and $R^5$ are each a hydrogen atom or a nonmetallic atom group necessary to form a 5- or 6-membered ring by linking with each other; $R^4$ is a hydrogen atom, an alkyl group, a halogen atom, an aryl group, —$N(R^6)R^7$, —$SR^8$ or —$OR^9$, in which $R^6$ is a hydrogen atom, an alkyl group or an aryl group, $R^7$ is an alkyl group, an aryl group, a sulfonyl group or an acyl group, $R^8$ and $R^9$ are each an alkyl group or an aryl group, provided that $R^6$ and $R^7$ may combine with each other to form a 5- or 6-membered ring; a and b are each 0 or 1; $X^-$ represents an anion.

In the foregoing formula (I), examples of a 5- or 6-membered nitrogen containing heterocyclic ring, represented by $Z^1$ and $Z^2$, which may be condensed, include a oxazole ring, an isooxazole ring, a benzoxazole ring, a naphthoxazole, a thiazole ring, a benzthiazole ring, a naphthothiazole ring, an indolenine ring, a benzoindolenine ring, an imidazole ring, a benzimidazole ring, naphthoimidazole ring, a quinoline ring, pyridine ring, pyrrolopyridine ring, and flopyrrole ring. Of these, a 5-membered nitrogen containing heterocyclic ring which is condensed with a benzene or naphthalene ring is preferred, and an indolenine ring is more preferred. These rings may be substituted. Examples of a substituent include a lower alkyl group (e.g., methyl, ethyl), an alkoxy group (e.g., methoxy, ethoxy), a phenoxy group (e.g., unsubstituted phenoxy, p-chlorophenoxy), carboxy group, a halogen atom (e.g., Cl. Br, F), alkoxycarbonyl group (e.g., ethoxy), a cyano group, nitro group and hydroxy group.

An alkyl group represented by $R^1$, $R^2$, $R^4$, $R^8$ and $R^9$ is preferably is one having 1 to 10 carbon atoms, and more preferably 1 to 6 carbon atoms (e.g., methyl, ethyl propyl, butyl, isobutyl, pentyl, hexyl), which may be substituted by a hydroxy group, carboxy group or halogen atom (e.g., Cl, Br). An alkyl group represented by $R^6$ and $R^7$ is an alkyl group represented by $R^1$, $R^2$, $R^4$, $R^8$ and $R^9$ or an alkoxycarbonylalkyl group (e.g., methoxycarbonylmethyl, ethoxycarbonylmethyl, ethoxycarbonylethyl). Examples of a 5- or 6-membered ring formed by linkage of $R^3$ and $R^5$ include cyclopentene and cyclohexene. These rings may be substituted by a substituent (e.g., methyl, t-butyl, phenyl).

A halogen atom represented by $R^4$ includes F, Cl, and Br. An aryl group represented by $R^4$, $R^6$, $R^7$, $R^8$ and $R^9$ is preferably one having 6 to 12 carbon atoms, such as phenyl or naphthyl. The aryl group may be substituted by a substituent which is the same as described in the ring of $Z^1$. An aralkyl group represented by $R^1$ and $R^2$ is preferably one having 7 to 12 carbon atoms (e.g., benzyl, phenylethyl), which may be substituted by a substituent (e.g. methyl, alkoxy group, chlorine atom). An alkenyl group represented by $R^1$ and $R^2$ is preferably one having 2 to 6 carbon atoms, including, e.g., 2-pentenyl, vinyl, allyl, 2-butenyl, and 1-propenyl. A sulfonyl group represented by $R^7$ is preferably one having 1 to 10 carbon atoms, including, e.g., mesyl, tosyl, benzenesulfonyl, and ethanesulfonyl. An acyl group represented by $R^7$ is preferably one having 2 to 10 carbon atoms, including, e.g., acetyl, propionyl, and benzoyl. $R^6$ and $R^7$ may be linked with each other to form a heterocyclic ring. Examples of such as heterocyclic ring include piperidine, morpholine and piperazine. These rings may be substituted by a substituent (e.g., methyl, phenyl, ethoxycarbonyl). It is more preferred that $R^1$ and $R^2$ are each an alkyl group, and $R^3$ and $R^4$ linked with each other to form a 5- or 6-membered ring, and $R^4$ is —$N(R^6)R^7$, and it is still more preferred that at least one of $R^6$ and $R^7$ a phenyl group.

Examples of an anion represented by $X^-$ include a halogen ion (e.g., $Cl^-$, $Br^-$, $I^-$), p-toluenesulfonate ion, ethylsulfate ion, $PF_6^-$, $BF_4$— and $ClO_4^-$.

In this invention, a dye represented by the following formula (II) is more preferred:

formula (II)

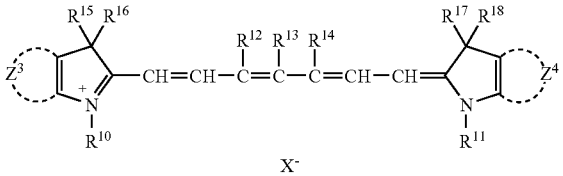

wherein $Z^3$ and $Z^4$ each represent a nonmetallic atom group necessary to form a benzene or naphthalene ring; $R^{10}$ and $R^{11}$ are each an alkyl group, an aralkyl group, or an alkenyl group; $R^{12}$ and $R^{14}$ are each a hydrogen atom or a nonmetallic atom group necessary to form a 5- or 6-membered ring formed by linking with each other; $R^{14}$ is a hydrogen atom, an alkyl group, a halogen atom, an aryl group, —$N(R^{19})R^{20}$, —$SR^{21}$ or —$OR^{22}$, in which $R^{19}$, $R^{20}$, $R^{21}$ and $R^{22}$ are each am alkyl group or an aryl group, provided that $R^{19}$ and $R^{20}$ may combine with each other to form a ring. $R^{15}$, $R^{16}$, $R^{17}$ and $R^{18}$ are each an alkyl group, provided that $R^{15}$ and $R^{16}$, or $R^{17}$ and $R^{18}$ may combine with each other to form a ring. $X^-$ is an anion.

There will be further detailed the formula (II). A condensed benzene or naphthalene ring (condensed benzo- or naphtho-ring) formed by $Z^3$ or $Z^4$ may be substituted by a substituent which is the same as described in $Z^1$. An alkyl group represented by $R^{10}$, $R^{11}$, $R^{13}$, $R^{15}$, $R^{16}$, $R^{17}$, $R^{18}$, $R^{21}$ and $R^{22}$ are each the same as defined in $R^1$, $R^2$, $R^4$ $R^8$ and $R^9$ of the foregoing formula (I). $R^{15}$ and $R^{16}$, or $R^{17}$ and $R^{18}$ may combine with each other to form a ring (such as a cyclohexane ring). An alkyl group represented by $R^{19}$ and $R^{20}$ are each the same as defined in an alkyl group of $R^6$ and $R^7$ of the foregoing formula (I). An alkenyl group and an aralkyl group represented by $R^{10}$ and $R^{11}$ are each the same as defined in an alkenyl group and an aralkyl group of $R^1$ and $R^2$. An aryl group represented by $R^{13}$, $R^{19}$, $R^{20}$, $R^{21}$ and $R^{22}$ are each the same as defined in an aryl group of $R^4$, $R^6$, $R^7$, $R^8$ and $R^9$ of the foregoing formula (I). A halogen atom represented by $R^{13}$ is the same as defined in $R^4$. Ring formation by $R^{19}$ and $R^{20}$ is the same as defined in $R^6$ and $R^7$. $X^-$ is the same as defined in $X^-$ of the foregoing formula (I). It is preferred a compound in which $R^{10}$ and $R^{11}$ are each an alkyl group, $R^{12}$ and $R^{14}$ link with each other to form a 5- or 6-membered ring, and $R^{13}$ is —$N(R^{19})R^{20}$. It is specifically preferred a compound in which at least one of $R^{19}$ and $R^{20}$ is a phenyl group.

A compound represented by the following formula (III) is specifically preferred:

formula (III)

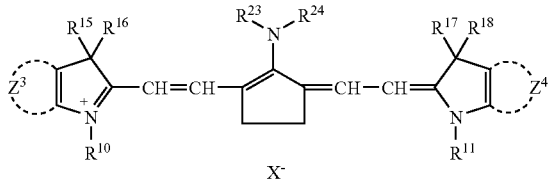

wherein $Z^3$ and $Z^4$ are each a nonmetallic atom group necessary to form a benzene or naphthalene ring (or a condensed benzo- or naphtho-ring); $R^{10}$ and $R^{11}$ are each an alkyl group, an aralkyl group or alkenyl group; $R^{23}$ and $R^{24}$ are each an alkyl group or an aryl group; $R^{15}$, $R^{16}$, $R^{17}$ and $R^{18}$ are each an alkyl group, provided that $R^{15}$ and $R^{16}$, or $R^{17}$ and $R^{18}$ may combine with each other to form a ring; and $X^-$ is an anion.

In the formula (III), a condensed benzene or naphthalene ring (or benzo- or naphtho-ring) formed by $Z^3$ and $Z^4$ may be substituted by a substituent as described in $Z^1$. An alkyl group represented by $R^{10}$, $R^{11}$, $R^{15}$, $R^{16}$, $R^{17}$ and $R^{18}$ is the same as defined in $R^1$, $R^2$, $R^4$, $R^8$ and $R^9$. $R^{15}$ and $R^{16}$, or $R^{17}$ and $R^{18}$ may combine with each other to form a ring (such as a cyclohexane ring). An alkyl group represented by $R^{23}$ and $R^{24}$ is the same as defined in $R^6$ and $R^7$. An alkenyl group and an aralkyl group represented by $R^{10}$ and $R^{11}$ is the same as defined in $R^1$ and $R^2$. An aryl group represented by $R^{23}$ and $R^{24}$ is the same as defined in $R^6$ and $R^7$. Ring formation of $R^{23}$ and $R^{24}$ is the same as defined in $R^6$ and $R^7$. $X^-$ is the same as defined in $X^-$ of the foregoing formula (I). It is more preferred that $R^{10}$ and $R^{11}$ are each an alkyl group, and $R^{23}$ and $R^{24}$ are each a phenyl group.

Specific examples of dyes usable in this invention are shown below, but the scope of this invention is not limited to these.

| Compound | R | R' |
|---|---|---|
| 1 | $CH_3$ | H |
| 2 | $CH_3$ | 5-Cl |
| 3 | $CH_3$ | 5-$OCH_3$ |
| 4 | $CH_3$ | 5-CN |
| 5 | $CH_3$ | 5-$CO_2C_2H_5$ |
| 6 | $CH_3$ | 5-$NO_2$ |
| 7 | $CH_3$ | 5-$CH_3$ |
| 8 | $CH_3$ | 5,6-di-Cl |
| 9 | $CH_3$ | 4,6-di-Cl |
| 10 | $C_2H_5$ | 5-Cl |
| 11 | $CH_3$ | 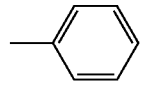 |

-continued
| | | |
|---|---|---|
| 12 | $C_2H_5$ | 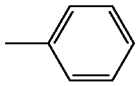 |
| 13 | 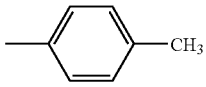 | 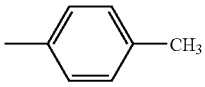 |
| 14 | 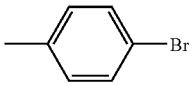 | 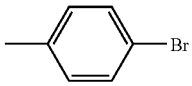 |
| 15 | 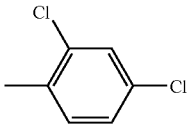 | 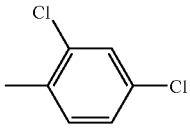 |
| 16 | 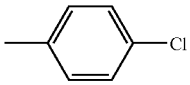 | 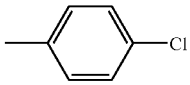 |
| 17 | 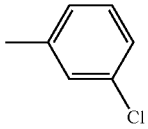 | 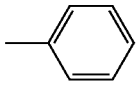 |
| 18 | $CH_3$ | $CH_3$ |
| 19 | $C_2H_5$ | $C_2H_5$ |
| 20 | $CH_2CO_2CH_3$ | $CH_2CO_2CH_3$ |
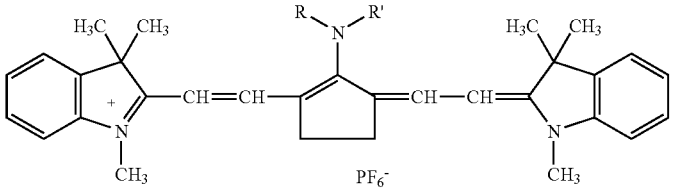
| | | |
|---|---|---|
| 21 | 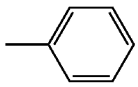 | 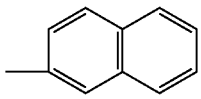 |
| 22 | 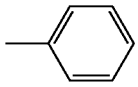 | 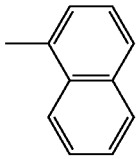 |
| 23 | 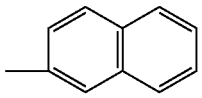 | 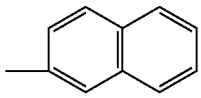 |
| 24 | $CH_3$ | 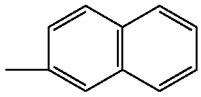 |
| 25 | $C_4H_9$ | 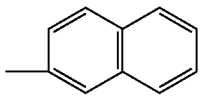 |

-continued
| | | |
|---|---|---|
| 26 | 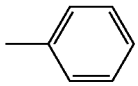 | —$SO_2CH_3$ |
| 27 | 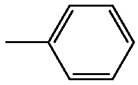 | —$COCH_3$ |
| 28 | 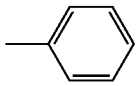 | H |
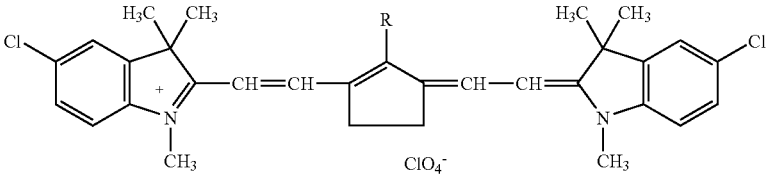
| Compound | R |
|---|---|
| 29 | Cl |
| 30 | —$OCH_3$ |
| 31 | 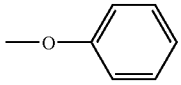 |
| 32 | 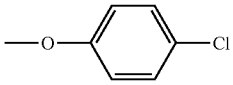 |
| 33 | $CH_3$ |
| 34 | 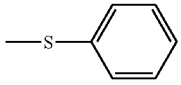 |
| 35 | 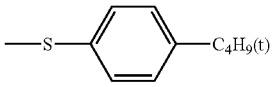 |
| 36 | H |
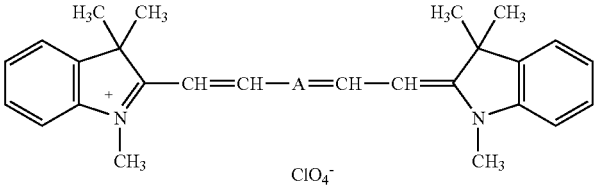
| Compound | A |
|---|---|
| 37 | 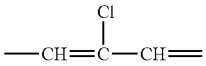 |
| 38 | 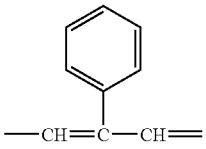 |

-continued
39
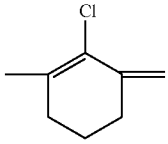
40
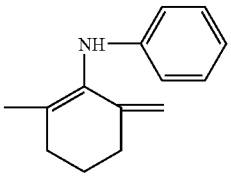
41
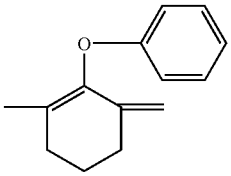
42
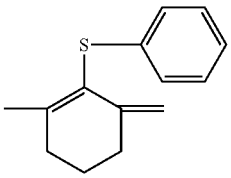
43
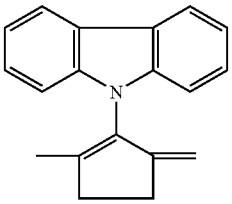
44
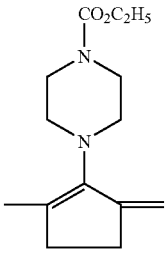
Compound 45
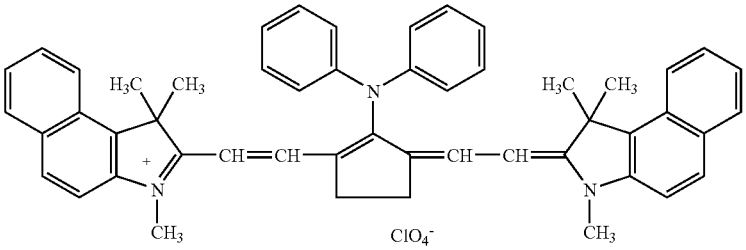
Compound 46

-continued
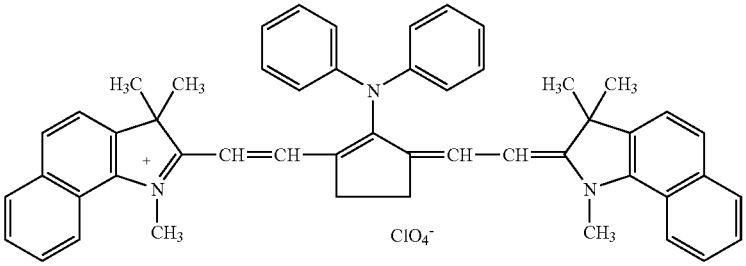
Compound 47
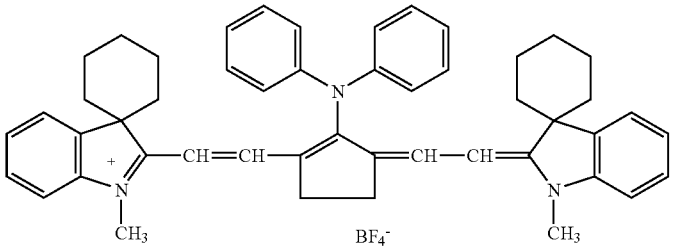
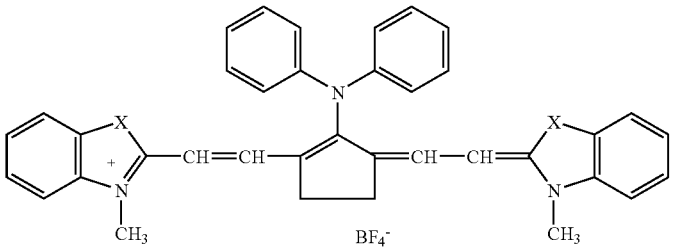
| Compound | X |
|---|---|
| 48 | O |
| 49 | S |
| 50 | N—$CH_3$ |
Compound 51
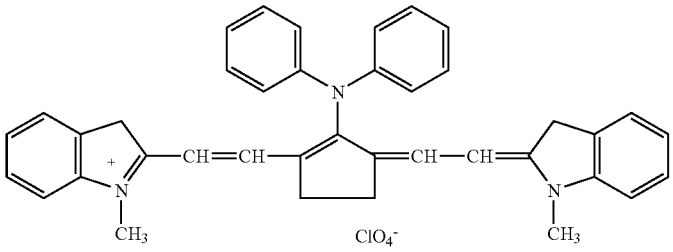
Compound 52
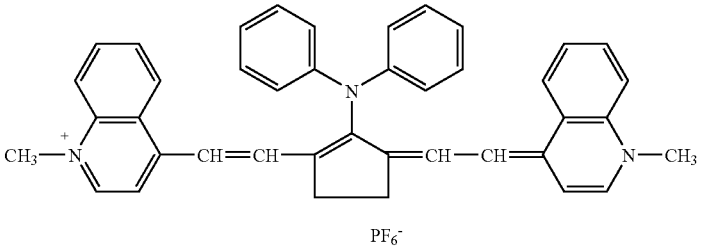

-continued

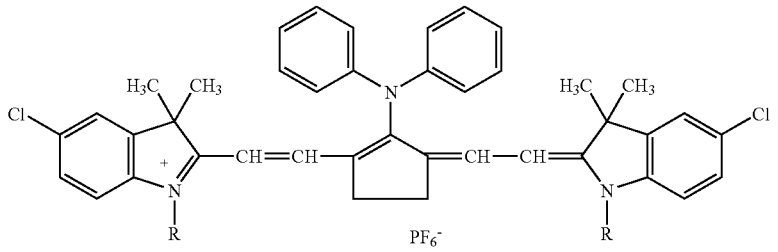

| Compound | R |
|---|---|
| 53 | —$CH_2$— 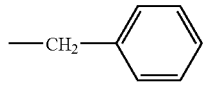 |
| 54 | —$C_2H_4$— 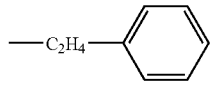 |
| 55 | —$CH_2$—CH=$CH_2$ |

The foregoing dyes can be synthesized with reference to U.S. Pat. No. 3,671,648 or the synthesis examples described below.

SYNTHESIS EXAMPLE 1

Synthesis of Exemplified Compound 2

A mixture of 11.4 g of 1,2,3,3-tetramethyl-5-indolenium-p-toluesulfonate, 7.2 g of N-(2,5-dianilinomethylenecyclopentylidene)-diphenylaluminium perchlorate, 100 ml of ethyl alcohol and 12 ml of acetic anhydride were stirred at an external temperature of 100° C. for 1 hr and precipitated crystals were filtered off. Subsequently, recrystallization was carried out in 100 ml of methyl alcohol to obtain 7.3 g of compound 2. It was proved that according to the conventional measurements, the melting point was not less than 270° C., λmax was 800.8 nm, and (molar extinction coefficient) was $2.14\times10^5$ (in chloroform).

Other exemplified compounds can also be synthesized in a manner similar to the foregoing.

Dyes usable I his invention include a squalilium dye containing a thiopyrylium nucleus, a squalilium dye containing a pyrylium nucleus, and a thiopyrylium croconium dye and pyryliumcroconium dye similar to a squalilium dye. A compound containing a squalelium nucleus is a compound containing 1-cyclobutene-2-hydroxy-4-one in its molecular structure, and a compound containing a croconium nucleus is a compound containing 1-cyclopentene-2-hydroxy-4,5-dione in its molecular structure. Hereinafter, all of these dyes are called squalelium dyes.

Next, there will be described a squalelium dye represented by the following formula (1):

formula (1)

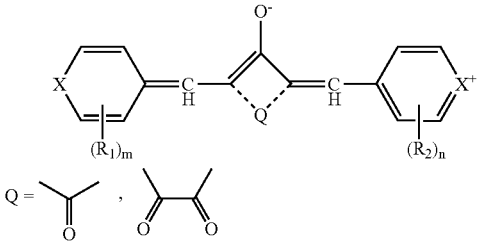

In the formula (1), $R_1$ and $R_2$ are each a mono-valent substituent. The mono-valent substituent is not specifically limited, but preferably an alkyl group (e.g., methyl, ethyl, isopropyl, t-butyl, methoxyethyl, methoxyethoxyethyl, 2-ethylhexyl, 2-hexyl, decyl, benzyl) and an aryl group (e.g., phenyl, 4-chlorophenyl, 2,6-dimethylphenyl), and an alkyl group is more preferred and t-butyl is still more preferred. $R_1$ and $R_2$ may combine with other to form a ring; m and n are each an integer of from 0 to 4 (preferably 2 or less).

Examples of squalilium dyes usable in this invention are shown below.

1-1

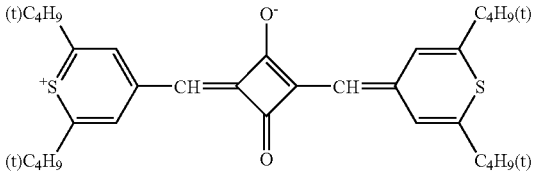

-continued 1-2

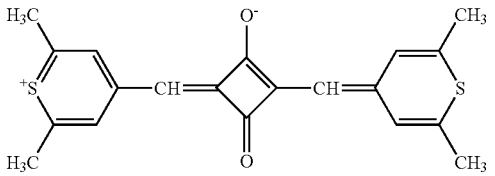

1-3

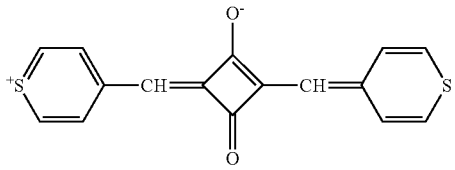

1-4

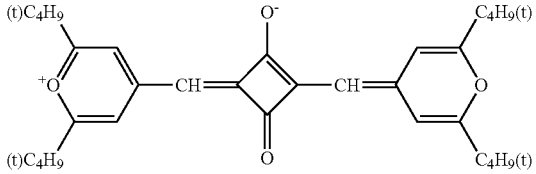

1-5

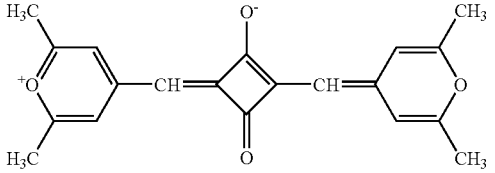

1-6

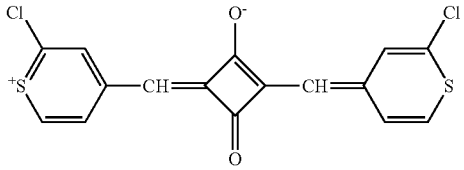

1-7

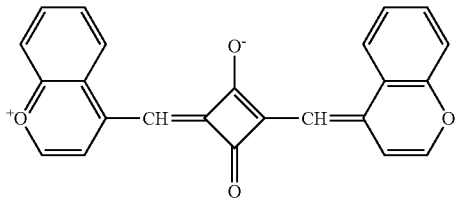

1-8

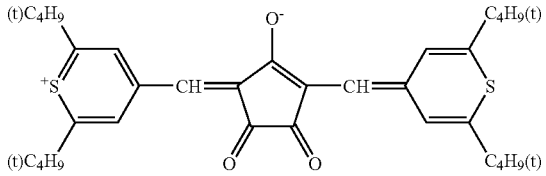

1-9

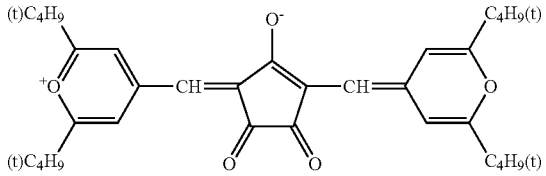

-continued 1-10

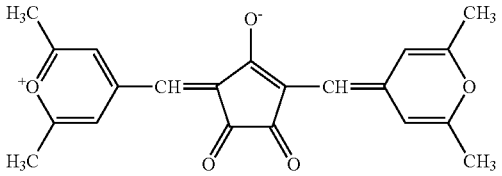

1-11

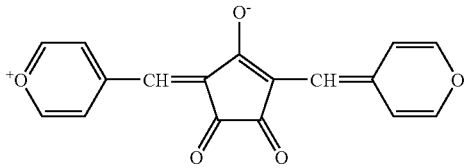

1-12

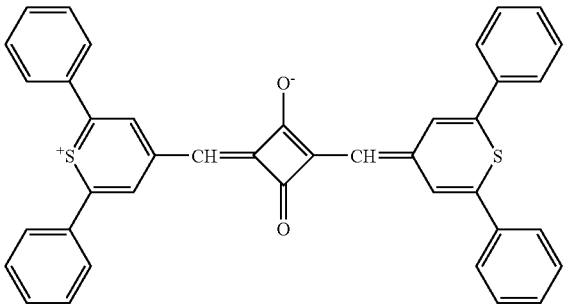

1-13

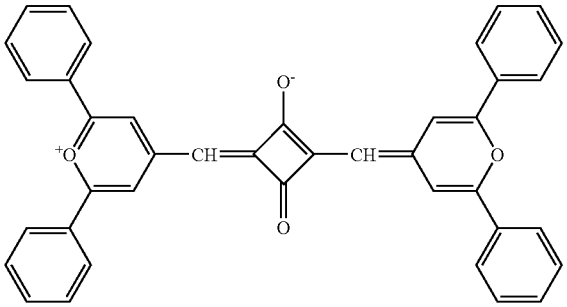

These squalilium dyes can be synthesized according to the method described in JP-A No. 2000-160042.

Binder usable to form a core includes, for example, a colorless and transparent or translucent natural polymers, synthetic resin polymers and copolymers, and a film forming medium. Examples thereof include cellulose acetate, cellulose acetate butyrate, poly(vinyl chloride), copoly(styrene-acrylonitrile), copoly(styrene-butadiene), poly(vinyl acetal), e.g., poly(vinyl formal), poly(vinyl butyral), poly(ester), poly(urethane), phenoxy resin, poly(vinylidene chloride), poly(epoxide), poly(carbonate), poly(vinyl acetate), cellulose esters and polyamides. A hydrophobic transparent binder is preferably used. Preferred binders include polyvinyl butyral, cellulose acetate, cellulose acetate butyrate, polyester, polycarbonate, polyacrylic acid, and polyurethane. Of these, polyvinyl butyral, cellulose acetate, cellulose acetate butyrate and polyester are specifically preferred.

Next, there will be described components constituting the shell (or wall membrane) of the microcapsule.

In dye microcapsules relating to this invention, water-soluble resin is used as a binder for the shell portion. The water soluble resin plays a role as a protective colloid when the core component is dispersed in water and also as a barrier to prevent dissolution in an organic solvent when dispersed in an organic solvent. Accordingly, from such a point of view, water-soluble resins, such as polyvinyl alcohol or its derivative, gelatin, gelatin and/or gum arabic and albumin are preferably used, and the use of gelatin and/or gum arabic is more preferred.

Suitable water-soluble resins include gelatin and gum arabic. Examples of gelatin usable in this invention include lime-processed gelatin, acid-processed gelatin, oxygen-treated gelatin described in Bull. Soc. Sci. Phot. Japan, No. 16, page 30 (1966) and a hydrolytic degradation product or oxygen degradation product of gelatin. There are also usable gelatin derivatives and graft polymer of gelatin with other polymers. As a gum arabic, commercially available ones are usable as they are. When gum arabic is used in combination with gelatin, alkali-processed gelatin is preferred.

Such a water-soluble resin contains a hydrophilic group within the molecule so that there is a fear such that when dispersed in an organic solvent, dispersion is inhibited by water carried-in by a hydrophilic group of the molecule and when coated and dried, a coated layer is subject to brushing. To overcome the foregoing problems, it is preferred to add a compound capable of reacting with a hydrophilic group of a water-soluble resin after completing formation of the shell of the dye microcapsule.

Examples of a compound capable of reacting with a hydrophilic group of a water-soluble resin include a chromate, aldehydes (e.g., formaldehyde, glutaraldehyde), N-methylol compound (e.g., dimethylolurea), active vinyl compounds {e.g., 1,3,5-triacryloyl-hexahydro-triazine, bis (vinylsulfonyl)methyl ether, N,N'-methylene-bis-[β-(vinylsulfonyl)propioneamide]}, active halogen compounds (e.g., 2,4-dichloro-6-hydroxy-s-triazine), mucohalogenic acids (e.g., mucochloric acid), N-carbamoylpyridiniums [e.g., (1-morpholinocarbonyl-3-pyridinio)methanesufonate], and haloamidinium salts [e.g., 1-(1-chloro-1-pyridinomethylene)pyrrolidinium, 2-naphthalenesulfonate]. Specifically, active vinyl compounds described in JP-B Nos. 53-41220, 53-57257, 59-162546 and 60-80846 (hereinafter, the term, JP-B refers to Japanese Patent Publication), and active halogen compounds described in U.S. Pat. No. 3,325,287 can be used alone or in combinations thereof. This reaction results in reduction of the pore size within the shell, which is effective for release control of a dye in an organic solvent within the core.

In microcapsules having a sub-micron particle size, it is preferred to add an inorganic or organic compound capable of reacting with a water-soluble resin at a concentration of from 5 to 20% (solid content) of an aqueous microcapsule dispersion to prevent diffusion of a dye in the core into the organic solvent. A concentration of more than 20% often results in flocculation of the compound capable of reacting with a water-soluble resin or aggregation of microcapsules; on the other hand, a concentration of less than 5% results in deterioration in barrier capability against solvent, adversely affecting the dispersion state.

The dye microcapsules preferably contain a colloidal silica on the surface of the shell, and more preferably a colloidal silver with a salt concentration of not more than 1 ppm. A salt concentration of zero is also acceptable.

Colloidal silica refers to an aqueous dispersion of silicon dioxide particles having an average primary particle size of from 5 nm to several tens of nm and containing, as a stabilizer, an inorganic alkali component such as sodium hydroxide, potassium hydroxide, lithium hydroxide or ammonia, or an organic alkali component such as tetramethylammonium ion. A colloidal silica having an alkali component content of not more than 1 ppm is preferred in terms of desired effects of this invention. Such a colloidal silica, which is not dispersed with an ionic compound, is dispersible in both of a water solvent and an organic solvent and plays an important role to re-disperse core/shell particles prepared in water solvent in an organic solvent. Such colloidal silica is commercially available under the name of PL-1, PL-2, or PL-3 from Fuso Kagaku Kogyo Co., Ltd.

The ratio of core to shell (core/shell) of the dye microcapsule is preferably from 1/99 to 99/1.

As a matter of fact, whether the thus formed dye microcapsule particles have a core shell structure or not can be confirmed in the following manner. First, the obtained microcapsule particles are dispersed in an organic solvent containing dissolved dye. The thus prepared dispersion is coated on ITO film and dried, and is then electron-microscopically observed. When particles having a desired core shell structure are formed, the particle shape can be observed and any of dissolved and dried dye (in a stain form) cannot be observed. The absorption of a dye shifts more to the shorter wavelengths in the solid state than in the solution state. The microcapsule particle dispersion and a dye solution are measured with respect to spectral intensity and if desired core shell particles can be formed, the dye is not dissolved. Accordingly, formation of core-shell particles can be confirmed based on the fact that absorption shifts to longer wavelengths.

In the dye microcapsules, the shell portion may be designed to be thickened to prevent bleeding-out of dye after a long period of storage. Alternatively, the shell portion may be designed to be thinner to enhance absorptivity of a dye. The core portion preferably accounts for at least ⅓ of the particle size when considering absorption of the dye.

Next, a preparation method of dye microcapsules will be described. First, a dye and a binder are dissolved in an organic solvent. A usable organic solvent is preferably one which dissolves the dye and the binder and exhibits a solubility in water of 1% or less. The dye and binder, which exhibit a certain extent of hardness in water and are difficult to be finely ground, are dissolved in an organic solvent for easier dispersion or emulsification), whereby adsorption onto the interface of a shell forming material or a shell forming pre-material becomes easier and feasible by selection of an organic solvent, irrespective of the kind of dye or binder.

An organic solvent capable of dissolving dyes and binders usable in this invention is preferably one which exhibits a boiling point of 120° C. or less and is capable of dissolving the core component in an amount of at least 1% by weight, based on the organic solvent. Any organic solvent satisfying the foregoing is usable and one which exhibits a solubility in water of not more than 10%, is preferred. Specific examples thereof include esters such as ethyl acetate and butyl acetate, alicyclic hydrocarbons such cyclohexane, aliphatic hydrocarbons such as heptane and hexane, ketones such as cyclohexanone, alcohols, ethers such as dimethyl ether and diethyl ether, aromatic hydrocarbons such as benzene, toluene and xylene, halogenated hydrocarbons such as carbon tetrachloride and dimethylsulfoxide methyl cellosolve. These organic solvents may be used alone or in combinations thereof.

In such an organic solvent, at least a dye and binder are dissolved and dispersed in an aqueous solution of a water-soluble resin. Dispersion methods include, for example, a method using a magnetic stirrer or a high-speed dissolver, a ultrasonic dispersing method and a method using high pressure shearing such as a Manton-Gaulin homogenizer, which are chosen according to intended particle size. Of these, ultrasonic dispersion and a dispersing method using a nanomizer are preferred to obtain dispersed droplets of the sub-micron order. Ultrasonic dispersion is specifically preferred, which is said to be able to form a kind of a supercritical state. The ultrasonic frequency is preferably in the range of from 19 to 22 kHz. A frequency higher than this cannot form a microcapsule of the sub-micron order, and at a lower frequency lower, the output is too high and difficult to control, often resulting in aggregation of dispersed droplets and enlarging the particle size. To enhance stability, commonly known anionic surfactants, cationic surfactants, betaine type surfactants, nonionic surfactants and fluorine-containing surfactants may be used according to necessity as long as they do not adversely affect effects of this invention.

From the thus obtained dye microcapsule dispersion, first of all, the organic solvent is removed. A method of removing organic solvent is not specifically limited but a method not applying heat so much is preferred in terms of preventing degradation of the dye. Specifically, it is preferred to perform removal of organic solvent by evaporating the dye microcapsule dispersion using an evaporator. Wall membrane (shell portion) of microcapsule particles can be formed by a procedure of removing the organic solvent. In the formation of the dye microcapsules, a method in which wall membrane formation is not done prior to the drying procedure, for example, a spray-drying method in which wall formation is carried out simultaneously with drying, is not preferred, which forms multinucleate microcapsules, resulting in an increase of capsule size and making it impossible to obtain microcapsules of the sub-micron order. Wall membrane formation can be achieved employing commonly known micro-encapsulation techniques. Employment of a simple coacervation method and a complex coacervation method are preferred. Specifically, it is preferred that simple coacervation is employed in the case of using gelatin as shelling material, and complex coacervation is employed for the use of shelling material of gelatin and gum arabic.

Thereafter, colloidal silica or the like may be added. In this regard, taking account of taking-out of sub-micron particles after drying or deterioration thereof, loose multiple-order aggregates of the sub-micron particles may be formed by controlling the pH value or the like. Then, the particulate dye microcapsules are dried and taken out. Drying is carried out preferably under conditions by not applying heat to prevent degradation of the dye. It is preferred to perform drying by a spray drier. It is also preferred to perform drying by controlling the temperature of powder at 40° C. or lower.

When adding the dye microcapsules to a coating solution of a component layer, the microcapsule is dispersed in an organic solvent identical to one used in the coating solution to form a dye microcapsule dispersion. A particulate microcapsule in which colloidal silica is attached onto the microcapsule particle surface is dispersed in an organic solvent using a commonly known stirrer such as a magnetic stirrer or an ultrasonic homogenizer and is then added to a coating solution.

The thus prepared coating solution containing a dye microcapsule dispersion is coated onto a support of the photothermographic material of this invention. The component layer containing the dye microcapsule dispersion can be provided at any position, and it is preferred to provide this layer between the light-sensitive layer and the support or on the back layer side.

Light-sensitive silver halide grains used in this invention are those which are capable of absorbing light as an inherent property of silver halide crystal or capable of absorbing visible or infrared light by artificial physico-chemical methods, and which are treated or prepared so as to cause a physico-chemical change in the interior and/or on the surface of the silver halide crystal upon absorbing light within the region of ultraviolet to infrared.

The silver halide grains used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide. Specifically, silver bromide or silver iodobromide is preferred. In the case of silver iodobromide, the iodide content thereof is preferably 0.02 to 6 mol %/Ag mol. The iodide may be distributed overall within grain or localized in a specific portion of the grain, such as a core/shell structure comprising the central portion containing a relatively high iodide and surface portion containing a relatively low or substantially no iodide.

The grain forming process is usually classified into two stages of formation of silver halide seed crystal grains (nucleation) and grain growth. These stages may continuously be conducted, or the nucleation (seed grain formation) and grain growth may be separately performed. The controlled double-jet precipitation, in which grain formation is undergone with controlling grain forming conditions such as pAg and pH, is preferred to control the grain form or grain size. In cases when nucleation and grain growth are separately conducted, for example, a soluble silver salt and a soluble halide salt are homogeneously and promptly mixed in an aqueous gelatin solution to form nucleus grains (seed grains), thereafter, grain growth is performed by supplying soluble silver and halide salts, while being controlled at a pAg and pH to prepare silver halide grains.

In order to minimize cloudiness or yellowish coloring of images after image formation and to obtain excellent image quality, the less the average grain size, the more preferred. When particles of les than 02 μm are ignored, the average grain size is preferably from 0.030 μm to 0.55 μm.

The grain size as described above is defined as an average edge length of silver halide grains, in cases where they are so-called regular crystals in the form of cube or octahedron. Furthermore, in cases where grains are tabular grains, the grain size refers to the diameter of a circle having the same area as the projected area of the major faces. Furthermore, silver halide grains are preferably monodisperse grains.

The monodisperse grains as described herein refer to grains having a coefficient of variation of grain size obtained by the formula described below of not more than 30%; more preferably not more than 20%, and still more preferably not more than 15%:

Coefficient of variation of grain size=standard deviation of grain diameter/average grain diameter×100 (%)

The grain form can be of almost any one, including cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 1.5 to 100, and more preferably 2 to 50. These grains are described in U.S. Pat. Nos. 5,264,337, 5,314,798 and 5,320,958 and desired tabular grains can be readily obtained. Silver halide grains having rounded corners are also preferably employed.

Crystal habit of the outer surface of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation. Thus, the low molecular gelatin has an average molecular eight of not more than 50,000, preferably 2,000 to 40,000, and more preferably 5,000 to 25,000. The average molecular weight can be determined by means of gel permeation chromatography.

The concentration of dispersion medium used in the nucleation stage is preferably not more than 5% by weight, and more preferably 0.05 to 3.0% by weight.

In the preparation of silver halide grains, it is preferred to use a compound represent by the following formula, specifically in the nucleation stage:

$$YO(CH_2CH_2O)m(C(CH_3)CH_2O)p(CH_2CH_2O)_nY$$

where Y is a hydrogen atom, —$SO_3M$ or —CO—B—COOM, in which M is a hydrogen atom, alkali metal atom, ammonium group or ammonium group substituted by an alkyl group having carbon atoms of not more than 5, and B is a chained or cyclic group forming an organic dibasic acid; m and n each are 0 to 50; and p is 1 to 100. Polyethylene oxide compounds represented by foregoing formula have been employed as a defoaming agent to inhibit marked foaming occurred when stirring or moving emulsion raw materials, specifically in the stage of preparing an aqueous gelatin solution, adding a water-soluble silver and halide salts to the aqueous gelatin solution or coating an emulsion on a support during the process of preparing silver halide photographic light sensitive materials. A technique of using these compounds as a defoaming agent is described in JP-A No. 44-9497. The polyethylene oxide compound represented by the foregoing formula also functions as a defoaming agent during nucleation. The compound represented by the foregoing formula is used preferably in an amount of not more than 1%, and more preferably 0.01 to 0.1% by weight, based on silver.

The compound is to be present at the stage of nucleation, and may be added to a dispersing medium prior to or during nucleation. Alternatively, the compound may be added to an aqueous silver salt solution or halide solution used for nucleation. It is preferred to add it to a halide solution or both silver salt and halide solutions in an amount of 0.01 to 2.0% by weight. It is also preferred to make the compound represented by formula [5] present over a period of at least 50% (more preferably, at least 70%) of the nucleation stage.

The temperature during the stage of nucleation is preferably 5 to 60° C., and more preferably 15 to 50° C. Even when nucleation is conducted at a constant temperature, in a temperature-increasing pattern (e.g., in such a manner that nucleation starts at 25° C. and the temperature is gradually increased to reach 40° C. at the time of completion of nucleation) or its reverse pattern, it is preferred to control the temperature within the range described above.

Silver salt and halide salt solutions used for nucleation are preferably in a concentration of not more than 3.5 mol/l, and more preferably 0.01 to 2.5 mol/l. The flow rate of aqueous silver salt solution is preferably $1.5\times10^{-3}$ to $3.0\times10^{-1}$ mol/min per liter of the solution, and more preferably $3.0\times10^{-3}$ to $8.0\times10^{-2}$ mol/min. per liter of the solution. The pH during nucleation is within a range of 1.7 to 10, and since the pH at the alkaline side broadens the grain size distribution, the pH is preferably 2 to 6. The pBr during nucleation is 0.05 to 3.0, preferably 1.0 to 2.5, and more preferably 1.5 to 2.0.

One feature of silver halide grains of this invention is that the silver halide grains form latent images capable of acting as a catalyst in development (or reduction reaction of silver ions by a reducing agent) upon exposure to light prior to thermal development on the silver halide grain surface, and upon exposure after completion of thermal development, images are formed preferentially in the interior of the grains (i.e., internal latent image formation), thereby suppressing latent image formation on the grain surface.

In general, when exposed to light, light-sensitive silver halide grains or spectral sensitizing dyes adsorbed onto the surfaces of the silver halide grains are photo-excited to form free electrons. The thus formed electrons are trapped competitively by electron traps on the grain surface (sensitivity center) and internal electron traps existing in the interior of the grains. In cases when chemical sensitization centers (chemical sensitization nuclei) or dopants useful as a electron trap exist more on the surface than the interior of the grain, latent images are more predominantly on the surface than in the interior of the grain, rendering the grains developable. On the contrary, the chemical sensitization centers or dopants useful as electron traps, which exist more in the interior than the surface of the grains form latent images preferentially in the interior rather than the surface of the grains, rendering the grain undevelopable. Alternatively, it can be said that, in the former case, the grain surface has higher sensitivity than the interior; in the latter case, the surface has lower sensitivity than the interior. The foregoing is detailed, for example, in T. H. James, The Theory of the Photographic Process, 4th Ed. (Macmillan Publishing Co., Ltd., 1977 and Nippon Shashin Gakai Ed., "Shashin Kogaku no Kiso (Ginene Shashin)" (Corona Co., Ltd., 1998).

In one preferred embodiment of this invention, light-sensitive silver halide grains each internally contains an electron-trapping dopant. Thus, it is preferred to cause an electron trapping dopant to be occluded in the interior of light-sensitive silver halide grains, resulting in enhanced sensitivity and improved image storage stability. The dopant is more preferably one which functions as a hole trap when exposed prior to thermal development and which also functions as an electron trap after subjected to thermal development.

The electron trapping dopant is an element or compound, except for silver and halogen forming silver halide, referring to one having a property of trapping free electrons or one whose occlusion within the grain causes a site such as an electron-trapping lattice imperfection. Examples thereof include metal ions except for silver and their salts or complexes; chalcogen (elements of the oxygen group) such as sulfur, selenium and tellurium; chalcogen or nitrogen containing organic or inorganic compounds; and rare earth ions or their complexes.

Examples of the metal ions and their salts or complexes include a lead ion, bismuth ion and gold ion; lead bromide, lead carbonate, lead sulfate, bismuth nitrate, bismuth chloride, bismuth trichloride, bismuth carbonate, sodium bismuthate, chloroauric acid, lead acetate, lead stearate and bismuth and acetate.

Compounds containing chalcogen such as sulfur, selenium or tellurium include various chalcogen-releasing compounds, which are known, in the photographic art, as a chalcogen sensitizer. The chalcogen0 or nitrogen-containing organic compounds are preferably heterocyclic compounds. Examples thereof include imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, indolenine, and tetrazaindene; preferred of these are imidazole, pyridine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzthiazole, and tetrazaindene. The foregoing heterocyclic compounds may be substituted with substituents. Examples of substituents include an alkyl group, alkenyl group, aryl group, alkoxy group, aryloxy group, acyloxy group, acyl group, alkoxycarbonyl group, aryloxycarbonyl group, acyloxy group, acylamino group, alkoxycarbonylamino group, aryloxycarbonylamino group, sulfonylamino group, sulfamoyl group, carbamoyl group, sulfonyl group, ureido group, phosphoric acid amido group, halogen atoms, cyano group, sulfo group, carboxyl group, nitro group, and heterocyclic group; of these, an alkyl group, aryl group, alkoxy group, aryloxy group., acyl group, acylamino group, alkoxycarbonylamino group, sulfonylamino group, sulfamoyl group, carbamoyl group, sulfonyl group, ureido group, phosphoric acid amido group, halogen atoms, cyano group, nitro group and heterocyclic group are preferred; and an alkyl group, aryl group, alkoxy group, aryloxy group, acyl group, acylamino group, sulfonylamino group, sulfamoyl group, carbamoyl group, halogen atoms, cyano group, nitro group, and heterocyclic group are more preferred.

Silver halide grains used in this invention may occlude transition metal ions selected from group 6 to 11 of the periodical table whose oxidation state is chemically prepared in combination with ligands so as to function as an electron-trapping dopant and/or a hole-trapping dopant. Preferred transition metals include W. Fe, Co, Ni, Cu, Ru, Rh, Pd, Re, Os, Ir and Pt.

The foregoing dopants may be used alone or in combination thereof, provided that at least one of the dopants needs to act as an electron-trapping dopant when exposed after being subjected to thermal development. The dopants can be introduced, in any chemical form, into silver halide grains. The dopant content is preferably $1\times10^{-9}$ to $1\times10$ mol, more preferably $1\times10^{-8}$ to $1\times10^{-1}$ mol, and still more preferably $1\times10^{-6}$ to $1\times10^{-2}$ mol per mol of silver. The optimum content, depending on the kind of the dopant, grain size or form of silver halide grains and other environmental conditions, can be optimized in accordance with the foregoing conditions.

In this invention, transition metal complexes or their ions, represented by the general formula described below are preferred:

Formula: $(ML_6)^m$:

wherein M represents a transition metal selected from elements in Groups 6 to 11 of the Periodic Table; L represents a coordinating ligand; and m represents 0, 1-, 2-, 3- or 4-. M is selected preferably from W, Fe, Co, Ni, Cu, Ru, Rh, Pd, Re, Os, Ir and Pt. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be non-uniformly occluded in the interior of the grain.

These metal compounds can be dissolved in water or a suitable organic solvent (e.g., alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening. Non-metallic dopants can also be introduced in a manner similar to the foregoing metallic dopants.

Whether a dopant has an electron-trapping property in the photothermographic material relating to this invention can be evaluated according to the following manner known in the photographic art. A silver halide emulsion comprising silver halide grains doped with a dopant is subjected to microwave photoconductometry to measure photoconductivity. Thus, the doped emulsion can be evaluated with respect to a decreasing rate of photoconductivity on the basis of a silver halide emulsion containing no dopant. Evaluation can also be made based on comparison of internal sensitivity and surface sensitivity.

A photothermographic dry imaging material relating to this invention can be evaluated with respect to effect of an electron trapping dopant, for example, in the following manner. The photothermographic material, prior to exposure, is heated under the same condition as usual thermal developing conditions and then exposed through an optical wedge to white light or light in the specific spectral sensitization region (for example, in the case when spectrally sensitized for a laser, light falling within such a wavelength region and in the case when infrared-sensitized, an infrared light) for a period of a given time and then thermally developed under the same condition as above. The thus processed photothermographic material is further subjected to densitometry with respect to developed silver image to prepare a characteristic curve comprising an abscissa of exposure and an ordinate of silver density and based thereon, sensitivity is determined. The obtained sensitivity is compared for evaluation with that of a photothermographic material using silver halide emulsion grains not containing an electron trapping dopant. Thus, it is necessary to confirm that the sensitivity of the photothermographic material containing the dopant is lower than that of the photothermographic material not containing the dopant.

A photothermographic material is exposed through an optical wedge to white light or a light within the specific spectral sensitization region (e.g., infrared ray) for a given time (e.g., 30 seconds) and thermally developed under usual practical thermal development conditions (e.g., 123° C., 15 seconds) and the sensitivity obtained based on the characteristic curve is designated as $S_1$. Separately, the photothermographic material, prior to exposure, is heated under the practical thermal development conditions and further exposed and thermally developed similarly to the foregoing and the sensitivity obtained based on a characteristic curve is designated as $S_2$. The ratio of $S_2/S_1$ of the photothermographic material relating to this invention is preferably not more than 0.2, more preferably not more than 0.1 (or 1/10 or less), still more preferably not more than 0.05 (or 1/20 or less), and further still more preferably not more than 0.02 (or 1/50 or less).

Specifically, the foregoing characteristics can be evaluated in the following manner. Thus, the photothermographic material is subjected to a heat treatment at a temperature of 123° C. for a period of 15 sec., followed by being exposed to white light (e.g., light at 4874 K) or infrared light through an optical wedge for a prescribed period of time (within the range of 0.01 sec. to 30 min., e.g., 30 sec. using a tungsten light source) and being thermally developed at a temperature of 123° C. for a period of 15 sec. The thus processed photothermographic material is further subjected to densitometry with respect to developed silver image to prepare a characteristic curve comprising an abscissa of exposure and an ordinate of silver density and based thereon, sensitivity is determined, which is designated as $S_2$. Separately, the photothermographic material is exposed and thermally developed in the same manner as above, without being subjected to the heat treatment to determine sensitivity, which is designated $S_1$. The sensitivity is defined as the reciprocal of an exposure amount giving a density of a minimum density (or a density of the unexposed area) plus 1.0.

Silver halide may be incorporated into an image forming layer by any means, in which silver halide is arranged so as to be as close to reducible silver source (aliphatic carboxylic acid silver salt) as possible. It is general that silver halide, which has been prepared in advance, added to a solution used for preparing an organic silver salt. In this case, preparation of silver halide and that of an organic silver salt are separately performed, making it easier to control the preparation thereof. Alternatively, as described in British Patent 1,447,454, silver halide and an organic silver salt can be simultaneously formed by allowing a halide component to be present together with an organic silver salt-forming component and by introducing silver ions thereto. Silver halide can also be prepared by reacting a halogen containing compound with an organic silver salt through conversion of the organic silver salt. Thus, a silver halide-forming component is allowed to act onto a pre-formed organic silver salt solution or dispersion or a sheet material containing an organic silver salt to convert a part of the organic silver salt to photosensitive silver halide.

The silver halide-forming components include inorganic halide compounds, onium halides, halogenated hydrocarbons, N-halogeno-compounds and other halogen containing compounds. These compounds are detailed in U.S. Pat. Nos. 4,009,039, 3,457,075 and 4,003,749, British Patent 1,498,956 and JP-A 53-27027 and 53-25420. Silver halide can be formed by converting a part or all of an organic silver salt to silver halide through reaction of the organic silver salt and a halide ion. The silver halide separately prepared may be used in combination with silver halide prepared by conversion of at least apart of an organic silver salt. The silver halide which is separately prepared or prepared through conversion of an organic silver salt is used preferably in an amount of 0.001 to 0.7 mol, and more preferably 0.03 to 0.5 mol per mol of organic silver salt.

Silver halide grain emulsions used in the invention may be desalted after the grain formation, using the methods known in the art, such as the noodle washing method and flocculation process.

Silver halide grains used in the invention can be subjected to chemical sensitization. In accordance with methods described in JP-A Nos. 2001-249428 and 2001-249426, for example, a chemical sensitization center (chemical sensitization speck) can be formed using compounds capable of releasing chalcogen such as sulfur or noble metal compounds capable of releasing a noble metal ion such as a gold ion. In this invention, it is preferred to conduct chemical sensitization with an organic sensitizer containing a chalcogen atom, as described below. Such a chalcogen atom-containing organic sensitizer is preferably a compound containing a group capable of being adsorbed onto silver halide and a labile chalcogen atom site. These organic sensitizers include, for example, those having various structures, as described in JP-A Nos. 60-150046, 4-109240 and 11-218874. Specifically preferred of these is at least a compound having a structure in which a chalcogen atom is attacked to a carbon or phosphorus atom through a double-bond. Specifically, heterocycle-containing thiourea derivatives and triphenylphosphine sulfide derivatives are preferred. A variety of techniques for chemical sensitization employed in silver halide photographic material for use in wet processing are applicable to conduct chemical sensitization, as described, for example, in T. H. James, The Theory of the Photographic Process, 4th Ed. (Macmillan Publishing Co., Ltd., 1977 and Nippon Shashin Gakai Ed., "Shashin Kogaku no Kiso (Ginene Shashin)" (Corona Co., Ltd., 1998). The amount of a chalcogen compound added as an organic sensitizer is variable, depending on the chalcogen compound to be used, silver halide grains and a reaction environment when subjected to chemical sensitization and is preferably $10^{-8}$ to $10^{-2}$ mol, and more preferably $10^{-7}$ to $10^{-3}$ mol per mol of silver halide. In the invention, the chemical sensitization environment is not specifically limited but it is preferred to conduct chemical sensitization in the presence of a compound capable of eliminating a silver chalcogenide or silver specks formed on the silver halide grain or reducing the size thereof, or specifically in the presence of an oxidizing agent capable of oxidizing the silver specks, using a chalcogen atom-containing organic sensitizer. To conduct chemical sensitization under preferred conditions, the pAg is preferably 6 to 11, and more preferably 7 to 10, the pH is preferably 4 to 10 and more preferably 5 to 8, and the temperature is preferably not more than 30° C.

Chemical sensitization using the foregoing organic sensitizer is also preferably-conducted in the presence of a spectral sensitizing dye or a heteroatom-containing compound capable of being adsorbed onto silver halide grains. Thus, chemical sensitization in the present of such a silver halide-adsorptive compound results in prevention of dispersion of chemical sensitization center specks, thereby achieving enhanced sensitivity and minimized fogging. Although there will be described spectral sensitizing dyes used in the invention, preferred examples of the silver halide-adsorptive, heteroatom-containing compound include nitrogen containing heterocyclic compounds described in JP-A No. 3-24537. In the heteroatom-containing compound, examples of the heterocyclic ring include a pyrazolo ring, pyrimidine ring, 1,2,4-triazole ring, 1,2,3-triazole ring, 1,3,4-thiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, and a condensed ring of two or three of these rings, such as triazolotriazole ring, diazaindene ring, triazaindene ring and pentazaindene ring. Condensed heterocyclic ring comprised of a monocycic hetero-ring and an aromatic ring include, for example, a phthalazine ring, benzimidazole ring indazole ring, and benzthiazole ring. Of these, an azaindene ring is preferred and hydroxy-substituted azaindene compounds, such as hydroxytriazaindene, tetrahydroxyazaindene and hydroxypentazaundene compound are more preferred. The heterocyclic ring may be substituted by substituent groups other than hydroxy group. Examples of the substituent group include an alkyl group, substituted alkyl group, alkylthio group, amino group, hydroxyamino group, alkylamino group, dialkylamino group, arylamino group, carboxy group, alkoxycarbonyl group, halogen atom and cyano group. The amount of the heterocyclic ring containing compound to be added, which is broadly variable with the size or composition of silver halide grains, is within the range of $10^{-6}$ to 1 mol, and preferably $10^{-4}$ to $10^{-1}$ mol per mol silver halide.

As described earlier, silver halide grains can be subjected to noble metal sensitization using compounds capable of releasing noble metal ions such as a gold ion. Examples of usable gold sensitizers include chloroaurates and organic gold compounds. In addition to the foregoing sensitization, reduction sensitization can also be employed and exemplary compounds for reduction sensitization include ascorbic acid, thiourea dioxide, stannous chloride, hydrazine derivatives, borane compounds, silane compounds and polyamine compounds. Reduction sensitization can also conducted by ripening the emulsion while maintaining the pH at not less than 7 or the pAg at not more than 8.3. Silver halide to be subjected to chemical sensitization may be one which has been prepared in the presence of an organic silver salt, one which has been formed under the condition in the absence of the organic silver salt, or a mixture thereof.

When the surface of silver halide grains is subjected to chemical sensitization, it is preferred that an effect of the chemical sensitization substantially disappears after subjected to thermal development. An effect of chemical sensitization substantially disappearing means that the sensitivity of the photothermographic material, obtained by the foregoing chemical sensitization is reduced, after thermal development, to not more than 1.1 times that of the case not having been subjected to chemical sensitization. To allow the effect of chemical sensitization to disappear, it is preferred to allow an oxidizing agent such as a halogen radical-releasing compound which is capable of decomposing a chemical sensitization center (or chemical sensitization nucleus) through an oxidation reaction to be contained in an optimum amount in the light-sensitive layer and/or the light-insensitive layer. The content of an oxidizing agent is adjusted in light of oxidizing strength of an oxidizing agent and chemical sensitization effects.

Spectral sensitizing dyes applicable to this invention are those which are capable of spectrally sensitizing silver halide grains to the desired wavelength region upon adsorption onto the silver halide grains, and sensitizing dyes exhibiting spectral sensitivity suitable for spectral characteristics of a light source can be advantageously chosen.

Next, there will be described a compound containing at least two dye chromophores, relating to the invention. In cases where a specified portion is defined as a group in this invention, this portion may be substituted by at least one substituent, even if this portion is not substituted, and in the case of being capable of being substituted by plural substituents, it means that the substituents may be the same with or different from each other. For example, "alkyl group" means an unsubstituted or substituted alkyl group. Substituents capable of being substituted on the group of the compound include any substituent, which may be substituted.

When such a substituent is represented by A, the substituent represented by A may be any one, including, for example, a halogen atom, an alkyl group {including a cycloalkyl group, a bicycloalkyl group and a tricycloalkyl group}, and also including an alkenyl group (including a cycloalkenyl and bicycloalkenyl group) and an alkyl group}, an aryl group, a heterocyclic group, cyano group, hydroxy group, nitro group, a carboxyl group, an alkoxy group, an aryloxy group, a silyloxy group, a heterocyclic-oxy group, an acyloxy group, a carbamoyloxy group, an alkoxycarbonyloxy group, an aryloxycarbonyloxy group, an amino group (including an anilino group), an ammonio group, an acyamino group, an aminocarbonylamino group, an alkoxycarbonylamino group, an aryloxycarbonylamino group, a sulfamoylamino group, an alkyl- and aryl-sulfonylamino group, a mercapto group, an alkylthio group, an arylthio group, a heterocyclic-thio group, a sulfamoyl group, a sulfo group, an alkyl- and aryl-sulfinyl group, an alkyl- and aryl-sulfonyl group, an acyl group, an aryloxycarbonyl group, an alkoxycarbonyl group, a carbamoyl group, an aryl- and heterocyclic-azo group, an imido group, a phosphino group, a phosphonyl group, a phosphinyloxy group, a phospho group (also called a phosphono group), a silyl group, a hydrazine group, a ureido group, a boron acid group

[or —$B(OH)_2$], a phosphato group [or —$OPO(OH)_2$], a sulfato group (or —$SO_3H$) and other commonly known substituent groups.

More specifically, the halogen atom is, for example, fluorine atom, chlorine atom, bromine atom, or iodine atom. The alkyl group is a straight chained, branched, or cyclic, and substituted or unsubstituted alkyl group including an alkyl group (preferably having 1 to 30 carbon atoms, e.g., methyl, ethyl, n-propyl, isopropyl, tert-butyl, n-octyl, eicosyl, 2-chloroethyl, 2-cyanoethyl, 2-ethylhexyl), a cycloalkyl group (preferably having 3 to 30 carbon atoms, e.g., cyclohexyl, cyclopentyl, 4-n-dodecylcyclohexyl), a bicycloalkyl group (preferably having 5 to 30 carbon atoms, e.g., bicyclo[1,2,2]heptane-2-yl, bicyclo[2,2,2]octane-3-yl) and a tricycloalkyl group. The alkenyl group is a straight chained, branched or cyclic, substituted or unsubstituted alkenyl group including an alkenyl group (preferably having 2 to 30 carbon atoms, e.g., vinyl, allyl, prenyl, gelanyl, oleyl), a cycloalkenyl group (preferably having 3 to 30 carbon atoms, e.g., 2-cyclopentene-1-yl, 2-cyclohexene-1-yl) and a bicycloalkenyl group (substituted or unsubstituted, preferably having 5 to 30 carbon atoms, e.g., bicyclo[2,2,1]hepto-2-ene-1-yl, bicyclo[2,2,2]octo-2-ene-4-yl). The alkynyl group is substituted or unsubstituted one having 2 to 30 carbon atoms, e.g., ethynyl, propargyl, trimethylslylethynyl. Further, A is an aryl group (preferably substituted or unsubstituted aryl group having 6 to 30 carbon atoms, such as phenyl, p-tolyl, naphthyl, m-chlorophenyl, or o-hexadecanoylaminophenyl), a heterocyclic group (preferably a univalent group which is formed by removing a hydrogen atom from a 5- or 6-membered, substituted or unsubstituted, aromatic or non-aromatic heterocyclic compound, and more preferably a 5- or 6-membered, aromatic, heterocyclic group having 3 to 30 carbon atoms, for example, 2-furyl, 2-thienyl, 2-pyrimidinyl and 2-benzothiazolyl, and a cationic heterocyclic group such as 1-methyl-2-pyridinio or 1-methyl-2-quinolinio), cyano group, hydroxy group, nitro group, carboxyl group, an alkoxy group (preferably substituted or unsubstituted alkoxy group having 1 to 30 carbon atoms, for example, methoxy, ethoxy, isopropoxy, tert-butoxy, n-octyloxy, and 2-methoxyethoxy), an aryloxy (preferably substituted or unsubstituted aryloxy group having 6 to 30 carbon atoms, for example, phenoxy, 2-methylphenoxy, 4-tert-butylphenoxy, 3-nitrophenoxy, 2-tetradecanoylaminophenoxy), a silyloxy group (preferably silyloxy group having 3 to 20 carbon atoms, for example, trimethylsilyloxy, tert-butyldimethylsilyloxy), a heterocyclic-oxy group (preferably substituted or unsubstituted heterocyclic-oxy group having 2 to 30 carbon atoms, for example, 1-phenyltetrazole-5-oxy, 2-tetrahydropyranyloxy), an acyloxy group (preferably formyloxy, a substituted or unsubstituted alkylcarbonyloxy group having 2 to 30 carbon-atoms, and a substituted or unsubstituted arylcarbonyloxt group having 6 to 30 carbon atoms, for example, formyloxy, acetyloxy, pivaloyloxy, stearoyloxy, benzoyloxy, p-methoxyphenylcarbonyloxy), a carbamoyloxy group (preferably a substituted or unsubstituted carbamoyloxy group having 1 to 30 carbon atoms, for example, N,N-dimethylcarbamoyloxy, N,N-diethylcarbamoyloxy, morpholinocarbonyloxy, N,N-di-n-octylaminocarbonyloxy, n-n-octylcarbamoyloxy), an alkoxycarbonyloxy (preferably a substituted or unsubstituted alkoxycarbonyloxy group having 2 to 30 carbon atoms, for example, methoxycarbonyloxy, ethoxycarbonyloxy, tert-butoxycarbonyloxy, n-octylcarbonyloxy), an aryloxycarbonyloxy group (preferably a substituted or unsubstituted aryloxycarbonyloxy group having 7 to 30 carbon atoms, for example, phenoxycarbonyloxy, p-methoxyphenoxycarbonyloxy, p-n-hexadecyloxyphenoxycarbonylcarbonyloxy), an amino group (preferably a substituted or unsubstituted amino group having 1 to 30 carbon atoms, a substituted or unsubstituted alkylamino group having 1 to 30 carbon atoms, for example, a substituted or unsubstituted anilino group having 6 to 30 carbon atoms, for example, for example, amino, methylamino, dimethylamino, anilino, N-methyl-anilino, diphenylamino), an ammonio group (preferably ammonio, an unsubstituted, or alkyl-, aryl- or heterocyclic-substituted ammonio group having 1 to 30 carbon atoms, for example, trimethylammonio, triethylammonio, diphenylmethylammonio), an acylamino group (preferably formylamino, or a substituted or unsubstituted alkylcarbonylamino group having 1 to 30 carbon atoms, preferably a substituted or unsubstituted arylcarbonylamino group having 6 to 30 carbon atoms, for example, formylamino, acetylamino, pivaloylamino, lauroylamino, benzoylamino, 3,4,5-tri-n-octyloxyphenylcarbonylamino), an aminocarbonylamino group. (preferably a substituted or unsubstituted aminocarbonylamino group having 1 to 30 carbon atoms, for example, carbamoylamino, N,N-dimethylaminocarbonylamino, diethylaminocarbonylamino, morpholinocarbonylamino), an alkoxycarbonylamino group (preferably a substituted or unsubstituted alkoxycarbonylamino group having 2 to 30 carbon atoms, for example, methoxycarbonylamino, ethoxycarbonylamino, tert-butoxycarbonylamino, n-octadecyloxycarbonylamino, N-methylmethoxycarbonylamino), an aryloxycarbonylamino group (preferably a substituted or unsubstituted aryoxycarbonylamino group having 7 to 30 carbon atoms, for example, phenoxycarbonylamino, p-chlorophenoxycarbonylamino, m-n-octyloxyphenoxycarbonyl), a sulfamoylamino group (preferably a substituted or unsubstituted sulfamoylamino group having 0 to 30 carbon atoms, for example, sulfamoylamino, N,N-dimethylaminosulfonylamino, N-n-octylaminosulfonylamino), an alkyl- or aryl-sulfonylamino group (preferably a substituted or unsubstituted alkylsulfonylamino group having 1 to 30 carbon atoms or arysulfonylamino group having 6 to 30 carbon atoms, for example, for example, methylsulfonylamino, butylsulfonylamino, phenylsulfonylamino, 2,3,5-trichlorophenylsulfonylamino, p-methylphenylsulfonylamino), mercapto group, an alkylthio group (preferably a substituted or unsubstituted alkylthio group having 1 to 30 carbon atoms, for example, methylthio, ethylthio, n-hexadecylthio), an arylthio group (preferably a substituted or unsubstituted arylthio group having 6 to 30 carbon atoms, for example, phenylthio, p-chlorophenylthio, m-methoxyphenylthio), a heterocyclic-thio group (preferably a substituted or unsubstituted heterocyclic-thio group having 2 to 30 carbon atoms, for example, benzothiazolylthio, 1-phenyltetrazole-5-ylthio), a sulfamoyl group (preferably a substituted or unsubstituted sulfamoyl group having 0 to 30 carbon atoms, for example, ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), sulfo group, an alkyl-or arylsulfinyl group (preferably a substituted or unsubstituted alkylsulfinyl group having 1 to 30 carbon atoms and a substituted or unsubstituted arylsulfinyl group having 6 to 30 carbon atoms, for example, methylsulfinyl, ethylsulfinyl, phenylsulfinyl, p-methylphenylsulfinyl), an alkyl-or arylsulfonyl group (preferably a substituted or unsubstituted alkylsulfonyl group having 1 to 30 carbon atoms and (a substituted or unsubstituted arylsulfonyl group having 6 to 30 carbon atoms, for example, methylsulfinyl, ethylsulfinyl, phenylsulfonyl, p-methylphenylsulfonyl), an acyl group (preferably formyl or a substituted or unsubstituted alkylcarbonyl group having 2 to 30 carbon atoms, a substituted or unsubstituted arylcarbonyl group having 7 to 30 carbon atoms or a substituted or unsubstituted heterocyclic-carbonyl group having a C-attached carbonyl group and having 4 to 30 carbon atoms, for example, acetyl, pivaloyl, 2-chloroacetyl, stearoyl, benzoyl, p-n-octyloxyphenylcarbonyl, 2-pyridylcarbonyl, 2-furylcarbonyl), an aryloxycarbonyl group (preferably a substituted or unsubstituted aryloxycarbonyl group having 1 to 30 carbon atoms, for example, phenoxycarbonyl, o-chlorophenoxycarbonyl, m-nitrophenoxycarbonyl, p-tert-butylphenoxycarbonyl), an alkoxycarbonyl group (preferably a substituted or unsubstituted alkoxycarbonyl group having 2 to 30 carbon atoms, for example, methoxycarbonyl, ethoxycarbonyl, tert-butoxycarbonyl, n-octadecyloxycarbonyl), a carbamoyl group (preferably a substituted or unsubstituted carbamoyl group having 1 to 30 carbon atoms, for example, carbamoyl, N-methylcarbamoyl, N,N-dimethylcarbamoyl, N,N-di-n-octylcarbamoyl-N-(methylsulfinyl)carbamoyl), an aryl- or heterocyclic-azo group (preferably a substituted or unsubstituted arylazo group having 6 to 30 carbon atoms and (preferably a substituted or unsubstituted heterocyclic-azo group having 3 to 30 carbon atoms, for example, phenylazo, p-chlorophenyl, 5-ethylthio-1,3,4-thiadiazole-2-ylazo), an imido group (preferably N-succinimido, N-phthalimido), a phosphino group (preferably a substituted or unsubstituted phosphino group having 2 to 30 carbon atoms, for example, dimethylphosphino, diphenylphosphino, methylphenoxyphosphino), a phosphinyl group (preferably a substituted or unsubstituted phosphinyl group having 2 to 30 carbon atoms, for example, phosphonyl, dioctylphosphinyl, diethoxyphosphinyl), a phosphinyloxy group (preferably a substituted or unsubstituted phosphinyloxy group having 2 to 30 carbon atoms, for example, diphenoxyphosphinyloxy, dioctyoxyphosphinyloxy), a phosphinylamino group (preferably a substituted or unsubstituted phosphinylamino group having 2 to 30 carbon atoms, for example, dimethoxyphosphinylamino, dimethylaminophosphinylamino), phospho group, a silyl group (preferably a substituted or unsubstituted silyl group having 3 to 30 carbon atoms, for example, trimethylsilyl, tert-butyldimethylsilyl, phenyldimethylsilyl), a hydrazine group (preferably a substituted or unsubstituted hydrazino group having 0 to 30 carbon atoms, for example, trimethylhydrazino), and a ureido group (preferably a substituted or unsubstituted ureido group having 0 to 30 carbon atoms, for example, N-dimethylureido).

Further, two As may combine with each to form a ring (aromatic or non-aromatic hydrocarbon ring or heterocyclic ring). These are further combined to form a polycyclic condensed ring. Examples thereof include a benzene ring, naphthalene ring, anthracene ring, quinoline ring phenanthrene ring, fluorene ring, triphenylene ring, naphthacene ring, biphenyl ring, pyrrole ring, furan ring, thiophene ring, imidazole ring, oxazole ring, thiazole ring, pyridine ring, pyrazine ring, pyrimidine ring, pyridazine ring, indolizine ring, indole ring, benzofuran ring, benzothiophene ring, isobenzofuran ring, quinolizine ring, phthalazine ring, naphthyridine ring, quinoxaline ring, quinoxazoline ring isoquinoline ring carbazole ring, phenanthridine ring, acridine ring, phenanthroline ring, thianthrene ring, chromene ring, xanthene ring, phenoxathiin ring, phenothiazine ring, and phenazine ring.

Of the foregoing substituents A, those which contain a hydrogen atom, may further be substituted for the hydrogen atom by a substituent. Substituents which substitute the substituent A include, for example, —$CONHSO_2$— group (sulfonylcarbamoyl group, carbonylsulfamoyl group), —CONHCO— group (carbonylcarbamoyl group), and —$SO_2NHSO_2$— group (sulfonylsulfamoyl group). Specific examples thereof include an alkylarbonylaminosulfonyl group (e.g., acetylamiosulfonyl), an arylcarbonylaminosulfonyl group (e.g., benzoylaminosulfonyl), an alkylsulfonylaminocarbonyl group (e.g., methylsulfonylaminocarbonyl), and an arylsulfonylaminocarbonyl group (e.g., p-methylphenylsulfonylaminocarbonyl).

Hereinafter, the compound containing at least two dye chromophores will be described. This compound can be used as a sensitizing dye. Preferred dye chromophores include those similar to $D^1$ as described later. The dye chromophores may be the same with or different from each other, and preferably the same with each other. The number of dye chromophores is 2 or more, and preferably from 2 to 100, more preferably from 2 to 10, still more preferably from 2 to 5, further still more preferably 2 or 3, and optimally 2. Two or more dye chromophores are bonded through a covalent bond or coordination bond, and preferably through a covalent bond. The covalent bond or coordination bond may be formed in advance or may be formed in the process of preparing silver salt photothermographic material (for example, in a silver halide emulsion), and is preferably formed in advance.

The compound containing at least two dye chromophores is represented by the following formula (A):

$$D^a([-L^a-]_{qb}[D^b]_{qa})_{ra}\,M^a_{ma} \qquad \text{formula (A)}$$

wherein $D^a$ and $D^b$ are each independently a dye chromophore; $L^a$ is a linkage group or a single bond; qa and ra are each an integer of 1 to 100; qb is an integer of 1 to 4; $M^a$ is a charge balancing counter ion; ma is the number necessary to neutralize charge of the molecule.

In the formula (A), $D^a$ and $D^b$ may be the same chromophore or different chromophores, and are preferably the same chromophore. $D^a$ and $D^b$ are preferably $D^1$ as described later. $L^a$ is a linkage group or a single bond, and preferably is identical to $L^1$ described later; qa and ra are each an integer of 1 to 100, preferably 1 to 5, more preferably 1 or 2, and still more preferably 1. When qa and ra are each 2 or more, plural $L^a$s and $D^b$s may be different linkage groups or a single bond and dye chromophores.

Further, qb is an integer of 1 to 4, and qb of 2 or more means that $D^a$ and $D^b$ or $D^b$ and $D^b$ are linked with plural linkage groups. Thus, $D^a$ and $D^b$ or $D^b$ and $D^b$ are linked at a single place or at plural places (2 to 4 places, and preferably 2 places. When qb is 2 or more, plural $L^a$s may be the same or different, and preferably the same; and qb is preferably 1 or 2 and more preferably 1.

$L^a$ may be bonded to any portion of $D^a$ and $D^b$ and preferably not to a methine chain portion and also preferably bonded to the N-position of a basic nucleus or an acidic nucleus, and more preferably to the N-position of a basic nucleus. $M^a$ is a charge balancing counter ion (or anion for counter-balancing charge of the molecule) and ma is the number necessary to neutralize charge of the molecule, and $M^a$ and ma are preferably identical to $M^1$ and m1 described later, respectively.

Of compounds represented by the foregoing formula (A), a compound represented by formula (I) is specifically preferred:

$$D^1([-L^1-]_{q2}[D^1]_{q1})_{r1}M^1_{m1} \quad \text{formula (I)}$$

wherein $D^1$ is a dye chromophore; $L^1$ is a linkage group or a single bond; q1 and r1 are each an integer of 1 to 100, q2 is an integer of 1 to 4; $M^1$ is a counter ion for charge balance; m1 is the number necessary to neutralize charge of the molecule.

The formula (A) represents that chromophores can be linked in any linkage form.

Further, preferred dye chromophores, general formulas and substituents in cases when $D^a$ and $D^b$ of formula (A) are different from each other are the same as those defined in formula (I) corresponding to the case of $D^a$ and $D^b$ being the same and its preferred region, except for dye chromophores being different. Thus, when $D^a$ and $D^b$ are different in the formula (A), further preferred dye chromophore is the following formula (XI), (XII) or (XIII) explained in formula (I) and the case of these are not the same.

formula (XI)

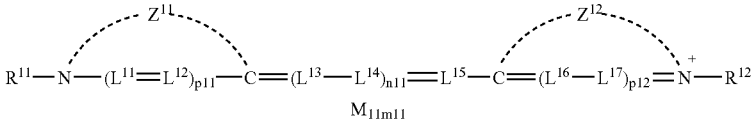

wherein $L^{11}$, $L^{12}$, $L^{13}$, $L^{14}$, $L^{15}$, $L^{16}$ and $L^{17}$ are each an methine group; P11 and P12 are each 0 or 1; n11 is an integer of 0, 1, 2, 3 or 4; $Z^{11}$ and $Z^{12}$ are each an atom group necessary to form a nitrogen containing heterocyclic ring, provided that the heterocyclic ring formed by $Z^{11}$ or $Z^{12}$ may form a condensed ring; $M^{11}$ is a counter ion for charge balance; m11 is the number of 0 or more necessary to neutralize charge of the molecule; and $R^{11}$ and $R^{12}$ are each a hydrogen atom, an alkyl group, an aryl group or a heterocyclic group;

formula (XII)

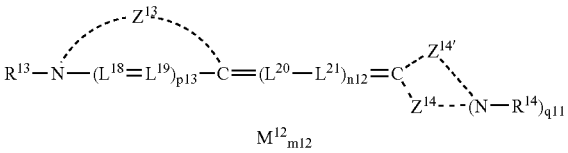

wherein $L^{18}$, $L^{19}$, $L^{20}$ and $L^{21}$ are each an methine group; P13 is 0 or 1; q11 is 0 or 1; n12 is an integer of 0, 1, 2, 3 or 4; $Z^{13}$ is an atom group necessary to form a nitrogen containing heterocyclic ring, $Z^{14}$ and $Z^{14'}$ are each an atom group necessary to form a heterocycric ring or an acyclic acid end group, together with $(N—R^{14})_{q11}$, provided that the ring formed by $Z^{13}$ or $Z^{14}$ and $Z^{14}$, may form a condensed ring; $M^{12}$ is a counter ion for charge balance; m12 is the number of 0 or more necessary to neutralize charge of the molecule; and $R^{13}$ and $R^{14}$ are each a hydrogen atom, an alkyl group, an aryl group or a heterocyclic group;

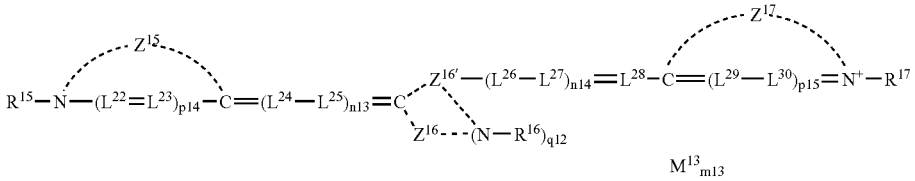

wherein $L^{22}$ $L^{23}$ $L^{24}$ $L^{25}$ $L^{27}$, $L^{27}$, $L^{28}$, $L^{29}$ and $L^{30}$ are each an methine group; P14 and P15 are each 0 or 1; n13 and n14 are each an integer of 0, 1, 2, 3 or 4; $Z^{15}$ and $Z^{17}$ are each an atom group necessary to form a nitrogen containing heterocyclic ring, $Z^{16}$ and $Z^{16'}$are each an atom group necessary to form a heterocycric ring together with $(N—R^{16})_{q12}$, provided that the heterocyclic ring formed by $Z^{15}$, $Z^{16}$ and $Z^{16}$, or $Z^{17}$ may form a condensed ring; $M^{13}$ is a counter ion for charge balance; m13 is the number of 0 or more necessary to neutralize charge of the molecule; and $R^{15}$, $R^{16}$ and $R^{17}$ are each a hydrogen atom, an alkyl group, an aryl group or a heterocyclic group.

When $D_a$ and $D_b$ are different in formula (A), a more preferred dye chromophore is the case when at least one of two $L^{11}$s, two $L^{12}$s, two $L^{13}$s, two $L^{14}$s, two $L^{15}$s, two $L^{16}$s, two $L^{17}$s, two p11s, two p12s, two n11s, two $Z^{11}$s, two $Z^{12}$s, and two $R^{21}$s in the following formula (XXI) is not the same; or the case when at least one of two $L^{18}$s, two $L^{19}$s, two $L^{20}$s, two $L^{21}$ s, two p13s, two q11s, two n12s, two $Z^{13}$S, two $Z^{14}$S, two $Z^{14'}$ s and two $R^{14}$s in the following formula (XXII) is not the same:

formula (XXI)

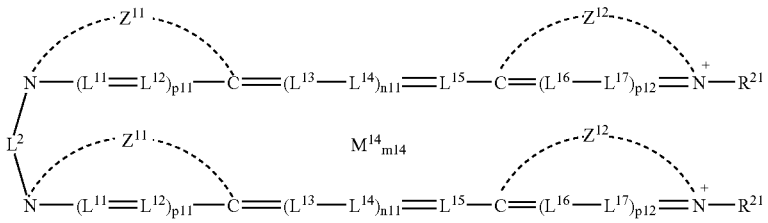

wherein $L^{11}$, $L^{12}$, $L^{13}$, $L^{14}$, $L^{15}$, $L^{16}$, $L^{17}$ p11, p12, n11, $Z^{11}$, and $Z^{12}$ are each the same as defined in the foregoing formula (XI); $L^2$ is a linkage group; $M^{14}$ is a counter ion for charge balance; m14 is the number of 0 or more necessary to neutralize charge of the molecule; and $R^{21}$ are each an alkyl group, an aryl group or a heterocyclic group;

formula (XXII)

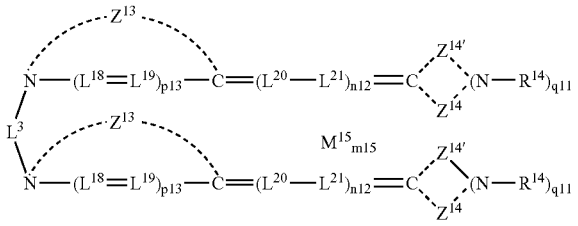

wherein $L^{18}$, $L^{19}$, $L^{20}$, $L^{21}$, p11, p13, q11 n12, $Z^{13}$, $Z^{14}$, $Z^{14'}$ $R^{14}$ are each the same as defined in the foregoing formula (XII); $L^3$ is a linkage group; $M^{15}$ is a counter ion for charge balance; m15 is the number of 0 or more necessary to neutralize charge of the molecule.

When $D_a$ and $D_b$ are different in formula (A), a specifically preferred dye chromophore is the case when at least one of two $Z^{51}$s, two $Z^{52}$s, two $R^{51}$s, two $L^{51}$s, two $L^{52}$s, two $L^{53}$s, two $L^{54}$s, two $L^{55}$s, two $L^{56}$s, two $L^{57}$s, two $V^{51}$s, two $V^{52}$s, two $V^{53}$s, two $V^{54}$s, two $V^{55}$s, two $V^{56}$s, two $V^{57}$s, and two $V^{58}$s in the following formula (XXXIa) is not the same; the case when at least one of two $Z^{53}$s, two $R^{52}$S, two $R^{53}$s, two $L^{58}$s, two $L^{59}$s, two $L^{60}$s, two $L^{61}$s, two L 62s, two $V^{59}$s, two $V^{60}$s, two $V^{61}$s, two $V^{62}$s, two $V^{63}$s, two $V^{64}$s, two $V^{65}$s, two $V^{66}$s, two $V^{67}$s, and two $V^{68}$s in the following formula (XXXIb) is not the same; or the case when at least one of two $Z^{59}$s, two $Z^{55}$s, two $R^{54}$ s, two $L^{63}$s, two $L^{64}$s, two $L^{65}$s, two $L^{66}$s, two n51s, two $V^{69}$s, two $V^{70}$s, two $V^{71}$s and two $V^{72}$s in the following formula (XXXII) is not the same:

formula (XXXIa)

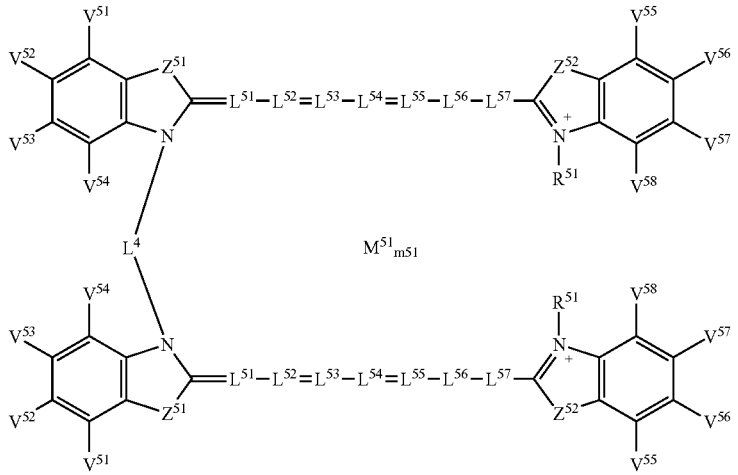

wherein $Z^{51}$ and $Z^{52}$ are each an oxygen atom, a sulfur atom, a selenium atom, a nitrogen atom or a carbon atom; $R^{51}$ is an alkyl group, an aryl group or a heterocyclic group; $L^{51}$, $L^{52}$, $L^{53}$, $L^{54}$, $L^{55}$, $L^{56}$ and $L^{57}$ are each a methine group; $V^{51}$, $V^{52}$, $V^{53}$, $V^{54}$, $V^{55}$, $V^{56}$, $V^{57}$ and $V^{58}$ are each a hydrogen atom or a substituent; $L^4$ is a linkage group; $M^{51}$ is a counter ion for charge balance, m51 is the number of 0 or more necessary to neutralize charge of the molecule;

formula (XXXIb)

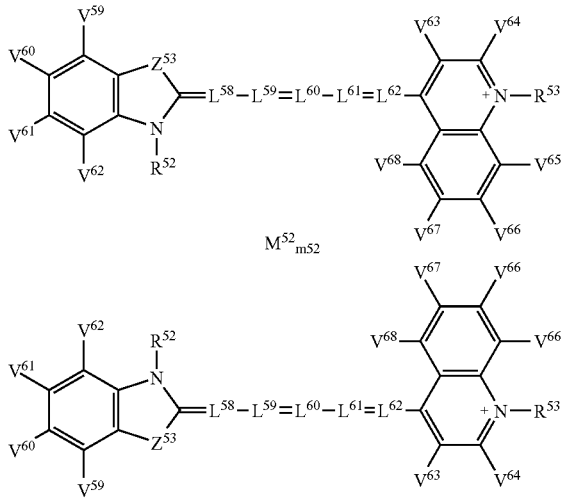

wherein $Z^{53}$ is an oxygen atom, a sulfur atom, a selenium atom, a nitrogen atom or a carbon atom; $R^{52}$ and $R^{53}$ are each an alkyl group, an aryl group or a heterocyclic group, provided that either two $R^{52}$s or two $R^{53}$s combine with each other to form a linkage group (which is designated $L_5$); $L^{58}$, $L^{59}$, $L^{60}$, $L^{61}$ and $L^{62}$ are each a methine group; $V^{59}$, $V^{60}$, $V^{61}$, $V^{62}$, $V^{63}$, $V^{64}$, $V^{65}$, $V^{66}$, $V^{67}$ and $V^{68}$ are each a hydrogen atom or a substituent; $M^{52}$ is a counter ion for charge balance; m52 is the number of 0 or more necessary to neutralize charge of the molecule;

formula (XXXII)

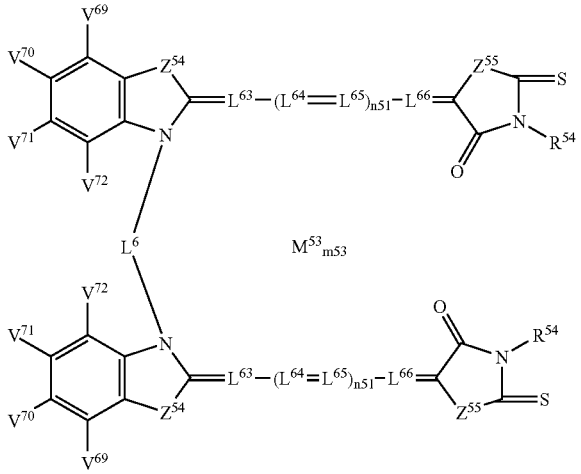

$Z^{54}$ is an oxygen atom, a sulfur atom, a selenium atom, a nitrogen atom or a carbon atom; $Z^{55}$ is an oxygen atom, a sulfur atom or a nitrogen atom; $R^{54}$ is an alkyl group, an aryl group or a heterocyclic group $L^6$ is a linkage group; $L^{63}$, $L^{64}$, $L^{65}$ and $L^{66}$ are each a methine group; n51 is 1 or 2; $V^{69}$, $V^{70}$, $V^{71}$ and $V^{72}$, are each a hydrogen atom or a substituent; $M^{53}$ is a counter ion for charge balance; m53 is the number of 0 or more necessary to neutralize charge of the molecule.

Of the compounds represented by the foregoing formula (A), a compound represented by foregoing formula (I) is specifically preferred. Thus, the compound of formula (I) corresponds to the case where $D^a$ and $D^b$ of formula (A) are an identical dye chromophore. The formula (I) represents that dye chromophores can be linked even if they are in any linkage form.

The compound represented by formula (I), which contains plural number of the same dye chromophore, exhibits superior raw stock stability, compared to the compound represented by formula (A) in which $D^a$ and $D^b$ are different. The compound represented by formula (I) can be readily synthesized and is superior in low manufacturing cost, compared to the compound represented by formula (A) in which $D^a$ and $D^b$ are different.

When a compound of formula (A) or (I) is adsorbed in the form of monolayer adsorption, it exhibits superior raw stock stability and is preferred. The monolayer adsorption means that dye chromophores of the compound (sensitizing dye) are adsorbed onto the silver halide surface in the form of a single layer or less. Thus, it means that the adsorption amount of dye chromophores per unit particle surface area is not more than the monolayer saturated covering amount. The monolayer saturated covering amount means a dye adsorption amount per unit particle surface area at the time of monolayer saturated coverage. In other words, the compound of formula (A) or (I) exhibits superior raw stock stability and is preferred when it is not adsorbed in the form of multilayer adsorption. The multilayer adsorption means that dye chromophores of the compound (sensitizing dye) are adsorbed in the form of multiple layers onto the silver halide surface. Thus, it means that the adsorption amount of dye chromophores per unit particle surface area is more than the monolayer saturated covering amount. The adsorption layer number is the adsorption amount, based on the monolayer saturated covering amount. Measurement of monolayer adsorption and multilayer adsorption is detained in JP-A Nos. 2000-26716, 2001-75222 and 2001-75226. In this invention, the light absorption intensity of spectrally sensitized silver halide grains is preferably less than 100. Further, the light absorption intensity is preferably less than 60 when the spectral absorption maximum is at a wavelength of 500 nm or less. When the light absorption intensity is less than 100 or less than 60, monolayer adsorption is preferred, thereby resulting in enhanced stock stability. The light absorption intensity is detailed in JP-A No. 10-239789.

In the foregoing formula (I), the dye chromophore represented by $D^1$ may be any one and examples thereof include groups derived from a cyanine dye, a styryl dye, a hemicyanine dye, a merocyanine dye, a trinuclear merocyanine dye, a tetranuclear merocyanine dye, a rhodanine dye, complex cyanine dye, complex merocyanine dye, an aropolar dye, an oxonol dye, a hemi-oxonol dye, a squarium dye, a chroconium dye, an azamethine dye, a coumalin dye, an arylidene dye, an anthraquinone dye, a triphenylmethane dye, an azo dye, an azomethine-dye, a spiro compound, a metallocene dye, a fluorenone dye, a furgitde dye, a perylene dye, a phenazine dye, a phenothiazine dye, a quinone dye, an indigo dye, a diphenylmethane dye, a polyene dye, an acridine dye, an acrydinone dye, a diphenylamine dye, a quinacridone dye, a quinophthalone dye, a phenoxazine dye, a phthaloperylene dye, a porphyrin dye, a chlorophyll dye, phthalocyanine dye and a metal complex dye. Of these, polymethine chromophores derived from a cyanine dye, a styryl dye, a hemi-cyanine dye, a merocyanine dye, a trinuclear merocyanine dye, a tetranuclear merocyanine dye, a rhodanine dye, complex cyanine dye, complex merocyanine dye, an aropolar dye, an oxonol dye, a hemi-oxonol dye, a squarium dye, a chroconium dye and an azamethine dye are preferred. Further, groups derived from a cyanine dye, a merocyanine dye, trinuclear merocyanine dye, tetranuclear merocyanine dye, an oxonol dye and a rhodanine dye are more preferred; groups derived from a cyanine dye, merocyanine dye and oxonol dye are still more preferred; and groups derived from a cyanine dye and a merocyanine dye are further still more preferred.

These dyes are detailed in F. M. Harmer, Heterocyclic Compounds-Cyanine Dyes and Related Compounds (John Wiley & Sons, New York, London, 1964): D. M. Sturmer, Heterocyclic Compounds-Special topics in heterocyclic chemistry, chapter 18, sect. 14, page 482–515 (John Wiley & Sons, New York, London, 1977); Rodd's Chemistry of Carbon Compounds, 2nd Ed. vol. IV, part B, published in 1977, page 369–422, Elsevier Science Publishing Company Inc., New York.

General formulas of preferred dyes include, for example, those described in U.S. Pat. No. 5,994,051, page 32–36; and U.S. Pat. No. 5,747,236, page 30–34. Examples of preferred cyanine dyes, merocyanine dyes and rhodacyanine dyes include those represented by general formulas (XI), (XII), and (XIII) described in U.S. Pat. No. 5,340,694, col. 21–22 (in which the number of n12, n15, n17 and n18 is not limited and an integer of 0 or more, preferably 4 or more).

$D^1$ of formula (I) may or may not form a J-aggregate.

In formula (I), $L^1$ represents a linkage group (preferably a divalent linkage) or a single bond. $L^1$ is preferably a linkage group. The linkage group is preferably composed of an atom or an atom group including at least one of a carbon atom, a nitrogen atom, a sulfur atom and an oxygen atom. $L^1$ is preferably a linkage group having carbon atoms of 0 to 100 (more preferably 1 to 12), which is composed of at least one of an alkylene group (e.g., methylene, ethylene, trimethylene, tetramethylene, pentamethylene), an arylene group (e.g., phenylene, naphthylene), an alkenylene group (e.g., ethenylene, propenylene), an alkynylene group (e.g., ethynylene, propynylene), an amide group, an eater group, a sulfonamide group, a sulfonic acid ester group, an ureido group, a sulfonyl group, a sulfinyl group, a thioether group, an ether group, a carbonyl group, —N(Va)— (in which Va is a hydrogen atom or a univalent substituent, and examples of the univalent substituent include those of A described above) and a divalent heterocyclic group (e.g., 6-chloro-1, 3,5-triazine-2,4-diyl group, pyrimidine-2,4-diyl group, quinoxaline-2,3-diyl group).

The foregoing linkage group may contain a substituent represented by A described above. Further, the linkage group may contain a ring (such as an aromatic or non-aromatic hydrocarbon ring or heterocyclic ring).

The linkage group is more preferably a divalent linkage group having 1 to 30 carbon atoms, which is composed of at least one of an alkylene group having 1 to 30 carbon atoms (e.g., methylene, ethylene, trimethylene, tetramethylene, pentamethylene, hexamethylene, octamethylene, decamethylene, dodecamethylene), an arylene group having 6 to 10 carbon atoms (e.g., phenylene, naphthylene), alkenylene group having 2 to 30 carbon atoms (e.g., ethenylene, propenylene), an alkynylene group having 2 to 30 carbon atoms (e.g., ethynylene, propynylene), an ether group, an amide group, an ester group, a sulfoamide group, and sulfonic acid ester group.

The linkage group is still more preferably one having no heteroatom, except for an amide group and an ester group, and further still more preferably one having no heteroatom. Specifically preferred is an alkylene group (e.g., ethylene, trimethylene, tetramethylene, pentamethylene, hexamethylene, octamethylene, decamethylene, dodecamethylene) having 2 to 24 carbon atoms (preferably 40 to 20, more preferably 6 to 18, still more preferably 8 to 18 and optimally 12 to 14 carbon atoms). $L^1$ is specifically preferably a linkage group having a center of symmetry.

In formula (I), q1 and r1 are each an integer of 1 to 100, preferably 1 to 5, more preferably 1 or 2 and still more preferably 1. When r1 is 2 or more, plural $L^1$s may be different linkage groups or a single bond, and preferably an identical linkage group or a single bond. When q1 or r1 is 2 or more, plural $D^1$s bonded to $L^1$ must be the same dye chromophore.

In formula (I), q2 is an integer of 1 to 4. When q2 is 2 or more, it means that $D^1$ and $D^1$ may be linked at one portion or at plural portions (2 to 4 portions, and preferably 2 portions). When q2 is 2 or more, plural $L^1$ may be same or different, and preferably the same; and q2 is preferably 1 or 2, and more preferably 1.

$L^1$ may be bonded to any portion of $D^1$ and preferably not to the methine chain portion, and preferably to the N-position of a basic nucleus or an acidic nucleus, and more preferably to the N-position of a basic nucleus.

In formula (I), $D^1$ is preferably a methine dye represented by the foregoing formula (XI), (XII) or (XIII), more preferably a methine dye represented by the foregoing formula (XI) or (XII), and still more preferably a methine dye represented by the foregoing formula (XII).

In formula (XI), (XII) or (XIII), $Z^{11}$, $Z^{12}$, $Z^{13}$, $Z^{15}$ and $Z^{17}$ are each an atom group necessary to form a nitrogen containing heterocyclic ring and preferably a 5- or 6-membered nitrogen containing heterocyclic ring, which may be condensed. The condensed ring may be an aromatic ring or a non-aromatic ring, and preferably an aromatic ring, including an aromatic hydrocarbon ring such as a benzene ring or a naphthalene ring, and an aromatic heterocyclic ring such as a pyrazine ring and a thiophene ring. Examples of a nitrogen containing heterocyclic ring formed by $Z^{11}$, $Z^{12}$, $Z^{13}$, $Z^{15}$ or $Z^{17}$ include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, tellurazoline nucleus, a tellurazole nucleus, benzotellurazole nucleus, a 3,3-dialkylindolenine nucleus (e.g., 3,3-dimethylindolenine), an imidazoline nucleus, an imidazole nucleus, a benzoimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo [4,5-b]quinoxaline nucleus, an oxadiazole nucleus, a thiadiazole nucleus, a tetrazole nucleus, and a pyrimidine nucleus. Of these, a benzothiazole nucleus, a benzoxazole nucleus, a 3,3-dialkylindolenine nucleus (e.g., 3,3-dimethylindolenine), a benzoimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus are preferred; and a benzothiazole nucleus, a benzoxazole nucleus, a 3,3-dialkylindolenine nucleus (e.g., 3,3-dimethylindolenine), a benzoimidazole nucleus are more preferred; and a benzothiazole nucleus, a benzoxazole nucleus, and a benzoimidazole nucleus are still more preferred; and a benzothiazole nucleus and a benzoxazole nucleus are further still more preferred. These heterocyclic rings may be substituted by a substituents as described in the A described earlier and may further be condensed. Preferred substituents include an alkyl group, an aryl group, an alkoxy group, a halogen atom, a condensed aromatic ring group, a carboxy group and a hydroxy group. Specific examples of a nitrogen containing heterocyclic ring formed by $Z^{11}$, $Z^{12}$, $Z^{13}$, $Z^{15}$ or $Z^{17}$ include those as cited as examples of $Z^{11}$, $Z^{12}$, $Z^{13}$, $Z^{14}$ or $Z^{16}$ described in U.S. Pat. No. 5,340,694. A preferred substituent A onto $Z^{11}$, $Z^{12}$, $Z^{13}$, $Z^{15}$ or $Z^{17}$ is a halogen atom, an aromatic group or an aromatic heterocyclic condense group.

$Z^{14}$, $Z^{14'}$ and $(N—R^{14})_{q11}$ are each an atom group, which are combined to form a heterocyclic ring or an acyclic acidic end group. The heterocyclic ring (preferably, a 5- or 6-membered heterocyclic ring) may be any one and is preferably an acidic nucleus. Herein, the acidic nucleus and acidic end group may take a form of any conventional merocyanine dye or acyclic end group. In the preferred form, $Z^{14}$ is preferably a thiocarbonyl group, a carbonyl group, an ester group, an acyl group, a carbamoyl group, a cyano group or a sulfonyl group, and more preferably a thiocarbonyl group or a carbonyl group. $Z^{14'}$ represents an atom group which is combined with $Z^{14}$ to form an acidic nucleus or an acidic end group. In cases when an acyclic acidic end group is formed, it is preferably a thiocarbonyl group, a carbonyl group, an ester group, an acyl group, a carbamoyl group, a cyano group or a sulfonyl group. Further, q11 is 0 or 1, and preferably 1.

The foregoing acidic nucleus and acyclic acidic end group are described in T. H. James, The Theory of the Photographic Process, 4th Ed. (Macmillan, 1977) page 198–200. Herein, the acidic end group refers to one which does not form a ring among acidic, namely, an electron-accepting end groups. Specific examples of the acidic nucleus and acyclic acidic end group are described in U.S. Pat. Nos. 3,567,719, 3,575,869, 3,804,634, 3,837,862,4,002,480, 4,925,777; JP-A No. 3-167546; and U.S. Pat. Nos. 5,994,051 and 5,747,236.

The acidic nucleus is preferably formed of carbon, nitrogen and/or chalcogen (specifically, oxygen, sulfur, selenium, and tellurium) atoms, and more preferably a 5- or 6-membered nitrogen containing heterocyclic ring formed of carbon, nitrogen and/or chalcogen (specifically, oxygen, sulfur, selenium, and tellurium) atoms. Specific examples thereof include 2-pyrazoline-5-one, pyrazolidine-3,5-dione, imidazoline-5-one, hydantoin, 2- or 4-thiohydantoin, 2-iminooxazolidine-4-one, 2-oxazoline-5-one, 2-thiooxazolidine-2,5-dione, 2-thioxazoline-2,4-dione, isooxazoline-5-one, 2-thiazoline-4-one, thiazolidine-4-one, thiazolidine-2,4-dione, rhodanine, thiazolidine-2,4-dione, isorhodanine, indane-1,3-dione, thiophene-3-one, thiophene-3-one-1,1-dioxide, indoline-2-one, indoline-3-one, 2-oxoindazolinium, 5,7-dioxo6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chromane-2,4-pyrazolo[1,5-b]quinazolone, pyazolo[1,5-a]benzimidazole, pyrazolopyridone, 1,2,3,4-tetrahydroquinoline-2,4-dione, and 3-oxo-2,3-dihydrobenzo[d]thiophene-1,1-dioxide.

There are further cited a nucleus having an exomethylene structure in which the carbonyl group or thiocarbonyl group forming the foregoing nucleus is substituted at the position of the active methylene of the acidic nucleus; a nucleus having an exomethylene structure, substituted at he active methylene position of an active methylene compound having a structure such as ketomethylene of cyanomethylene as raw material for acidic nucleus; and a nucleus repeating the foregoing; and of these one not substituted by these is preferred. The acidic nucleus and acyclic acidic end group may be substituted by or condensed with a substituent or a ring as represented by the foregoing substituent A. Of the acidic nucleus and acyclic acidic end group, the acidic nucleus id preferred.

A heterocyclic ring formed of $Z^{14}$, $Z^{14'}$ and $(N—R^{14})_{q11}$ is preferably hydantoin, 2- or 4-thiohydantoin, 2-oxazoline-5-one, 2-thiooxazoline-2,4-dione, thiazoline-2,4-dione, rhodanine, thiazoline-2,4-dithione, barbituric acid, and 2-thiobaribituric acid, more preferably hydantoin, 2- or 4-thiohydantoin, 2-oxazoline-5-one, 2-thiooxazoline-2,4-dione, thiazoline-2,4-dione, rhodanine, barbituric acid, and 2-thiobaribituric acid, and 2- or 4-thiohydantoin, 2-oxazoline-5-one, and rhodanine are specifically preferred.

Heterocyclic rings formed of $Z^{16}$, $Z^{16'}$ and $(N—R^{16})_{q12}$ include those described in the foregoing heterocyclic ring formed of $Z^{14}$, $Z^{14'}$ and $(N—R^{14})_{q11}$. Acidic nucleuses described in the heterocyclic rings formed of $Z^{14}$, $Z^{14'}$ and $(N—R^{14})_{q11}$, provided that an oxo group or a thioxo group is removed, are preferred. Specific examples of an acidic nucleus described in the heterocyclic rings formed of $Z^{14}$, $Z^{14'}$ and $(N—R^{14})_{q11}$, provided that an oxo group and a thioxo group is removed, are more preferred. Specifically, those in which an oxo or thioxo group is removed from each of hydantoin, 2- or 4-thiohydantoin, 2-oxazoline-5-one, 2-thiooxazoline-2,4-dione, thiazoline-2,4-dione, rhodanine, thiazoline-2,4-dithione, barbituric acid, and 2-thiobaribituric acid, are more preferred; those in which an oxo or thioxo group is removed from each of hydantoin, 2- or 4-thiohydantoin, 2-oxazoline-5-one, rhodanine, barbituric acid, and 2-thiobaribituric acid, are still more preferred; those in which an oxo or thioxo group is removed from each of 2- or 4-thiohydantoin, 2-oxazoline-5-one, and rhodanine are further still more preferred; and one in which a thioxo group is removed from rhodanine, is specifically preferred. Further, q12 is 0 or 1, and preferably 1.

$R^{11}$, $R^{12}$, $R^{13}$, $R^{14}$, $R^{15}$, $R^{16}$ and $R^{17}$ are each a hydrogen atom, an alkyl group, an aryl group, or a heterocyclic group, and preferably an alkyl group, an aryl group or a heterocyclic group. Specific examples of an alkyl group, an aryl group or a heterocyclic group represented by $R^{11}$, $R^{12}$, $R^{13}$, $R^{14}$, $R^{15}$, $R^{16}$ and $R^{17}$ include a unsubstituted alkyl group having 1 to 18 carbon atoms, preferably 1 to 7 carbon atoms and more preferably 1 to 4 carbon atom (e.g., methyl, ethyl, propyl, isopropyl, butyl, isobutyl, hexyl, octyl, dodecyl, octadecyl), a substituted alkyl group having 1 to 18 carbon atoms, preferably 1 to 7 carbon atoms and more preferably 1 to 4 carbon atom (e.g., alkyl groups substituted by the alkyl group described above). Specifically, an alkyl group having an acid group described later is preferred.

Preferred examples include an aralkyl group (e.g., benzyl, 2-phenylethyl), an unsaturated hydrocarbon group (e.g., allyl, vinyl, thus, the foregoing substituted alkyl group includes an alkenyl group and an alkynyl group), a hydroxyalkyl group (e.g. 2-hydroxyethyl, 3-hydroxypropyl), a carboxyalkyl group (e.g., carboxymethyl, 2-carboxyethyl, 3-carboxyprpyl, 4-carboxybutyl, carboxymethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl9, an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfoethyl, 3-sulfopropyl, 3-sulfobutyl, 4-sulfobutyl, 2-[3-sulfopropoxyethoxy]ethyl, 2-hydroxy-3-sulfopropyl, 3-sulfopropoxyethoxyethyl), a sulfoalkenyl group, a sulfatoalkyl group (e.g., 2-sulfatoethyl, 3-sulfatopropyl, 4-sulfatobutyl), a heterocycle-substituted alkyl (e.g., 2-(pyroridine-2-one-1-yl)ethyl, tetrahydrofuryl), an alkylsulfonylcarbamoylalkyl group (e.g., methanesulfonylcarbamoylmethyl), an acylcarbamoylalkyl group (e.g., acetylcarbamoylmethyl), anacylsulfamoylalkyl group (e.g., acetylsulfamoylmethyl), an alkylsulfonylsulfamoylalkyl group (e.g., methanesulfonylsulfamoylmethyl), an unsubstituted aryl group having 6 to 20 carbon atoms, preferably 6 to 10 carbon atom and more preferably 6 to 8 carbon atoms (e.g., phenyl, 1-naphthyl), a substituted aryl group having 6 to 20 carbon atoms, preferably 6 to 10 carbon atom and more preferably 6 to 8 carbon atoms (e.g., substituted aryl groups described in the foregoing A, specifically, p-methoxyphenyl, p-methylphenyl, p-chlorophenyl), a unsubstituted heterocycric group having 1 to 20 carbon atoms, preferably 3 to 10 carbon atoms, and more preferably 4 to 8 carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrymidyl, 3-pyrazyl, 2-(1,3,5-triazolyl), 3-(1,2,4-triazolyl, 5-tetrazolyl), and a substituted heterocycric group having 1 to 20 carbon atoms, preferably 3 to 10 carbon atoms, and more preferably 4 to 8 carbon atoms (e.g., heterocycles substituted by the foregoing A, e.g., 5-methyl-2-thienyl, 4-methoxy-2-pyridyl).

A group represented by $R^{11}$, $R^{12}$, $R^{13}$, $R^{14}$, $R^{15}$, $R^{16}$ or $R^{17}$ is preferably an unsubstituted alkyl group, a substituted alkyl group; and the substituted alkyl group is preferably a substituted alkyl containing an acid group. Herein, the acid group is a group containing a dissociative proton. Specific examples thereof include a sulfo group, an carboxyl group, a sulfato group, —$CONHSO_2$— (sulfonylcarbamoyl, carbonylsulfamoyl), —CONHCO— (carbonylcarbamoyl), —$SO_2NHSO_2$-(sulfonylsulfamoyl), a sulfonamido group, boron group, and a phenolic hydroxyl group, in which a proton dissociates by their pka values and a pH value of the surrounding. For example, a proton-dissociative acid group at least 90% of which dissociate at a pH of 5 to 12. Of the foregoing, a sulfo group, carboxyl group, —$CONHSO_2$—, —CONHCO— and —$SO_2NHSO_2$— are more preferred, and a sulfo group and a carboxyl group are still more preferred, and a sulfo group is specifically preferred.

$L^{11}$, $L^{12}$, $L^{13}$, $L^{14}$, $L^{15}$, $L^{16}$, $L^{17}$, $L^{18}$, $L^{19}$, $L^{20}$, $L^{21}$, $L^{22}$, $L^{23}$, $L^{24}$, $L^{25}$, $L^{26}$, $L^{27}$, $L^{28}$, $L^{29}$ and $L^{30}$ each are independently a methine group. The methine group represented by $L^{11}$ to $L^{30}$ may be substituted and examples of a substituent are one such as A described earlier. Specific examples thereof include a substituted or unsubstituted alkyl group having 1 to 15 carbon atoms, preferably 1 to 10 carbon atoms, and more preferably 1 to 5 carbon atoms (e.g., methyl, ethyl, 2-carboxyethyl), a substituted or unsubstituted aryl group having 6 to 20 carbon atoms, preferably 6 to 15 carbon atom and more preferably 6 to 10 carbon atoms (e.g., phenyl, o-carboxyphenyl), a substituted or unsubstituted heterocyclic group having 3 to 20 carbon atoms, preferably 4 to 15 carbon atoms, and more preferably 6 to 10 carbon atoms (e.g., N,N-dimethylbarbituric acid), a halogen atom) e.g., chlorine, bromine, iodine, and fluorine), an alkoxy group having 1 to 15 carbon atoms, preferably 1 to 10 carbon atoms, and more preferably 1 to 5 carbon atoms (e.g., methoxy, ethoxy), an amino group having 0 to 15 carbon atoms, preferably 2 to 10 carbon atoms, and more preferably 4 to 10 carbon atoms (e.g., methylamino, N,N-dimetylamino, N-methyl-N-phenylamino, N-methylpiperazino), an alkylthio group having 1 to 15 carbon atoms, preferably 1 to 10 carbon atoms, and more preferably 1 to 5 carbon atoms (e.g., methylthio, ethylthio), and an arylthio group having 6 to 20 carbon atoms, preferably 6 to 12 carbon atoms, and more preferably 6 to 10 carbon atoms (e.g., phenylthio, p-methylphenylthio). The methine group may link with another methine group to form a ring or with $Z^{11}$ to $Z^{17}$ or $R^{11}$ to $R^{17}$ to form a ring. $L^{11}$, $L^{12}$, $L^{16}$, $L^{17}$, $L^{18}$, $L^{19}$, $L^{22}$, $L^{23}$, $L^{29}$ and $L^{30}$ are each preferably a unsubstituted methine group.

Further, n11, n12, n13 and n14 are each 0, 1, 2, 3 or 4, preferably 0, 1, 2 or 3, more preferably 1, 2 or 3, and still more preferably 2 or 3. N11 is specifically preferably 3, and n12 is specifically preferably 2. When n11, n12, n13 and n14 are 2 or more, methine groups are repeated and these methine groups may be the same or different. Further, p11, p12, p13, p14 and p15 are each 0 or 1, and preferably 0.

The position at which dye chromophore $D^1$ links with $L^1$ is any of a carbon atom portion or N-position of a basic nucleus, the N-position of an acidic nucleus and a methine chain of the dye chromophore, preferably a carbon atom portion or N-position of a basic nucleus, the N-position of an acidic nucleus, or more preferably N-position of a basic nucleus or the N-position of an acidic nucleus (namely, when linked with $R^{11}$, $R^{12}$, $R^{13}$, $R^{14}$, $R^{15}$, $R^{16}$ and $R^{17}$ in formulas (XI), (XII), and (XIII)), and specifically preferably N-position of a basic nucleus (namely, when linked with $R^{11}$, $R^{12}R^{13}$, $R^{14}$, $R^{15}$, $R^{16}$ and $R^{17}$ in formulas (XI), (XII), and (XIII)).

When $M^1$, $M^{11}$, $M^{12}$ and $M^{13}$ are necessary to neutralize ionic charge of the dye, they are included in the formula to the presence of a cation or an anion. Typical cations include a hydrogen ion ($H^+$), an inorganic cation such as an alkali metal ion (e.g., sodium ion, potassium ion, lithium ion) and an alkaline earth metal ion (calcium ion), and an organic ion such as an ammonium ion (e.g., ammonium ion, tetraalkylammonium ion, trimethylammonium ion, pyridinium ion, ethylpyridinium ion, 1,8-diazabicyclo[5,4,0]-7-undecenium ion). An anion may be any of an inorganic anion and an organic anion, including a halide anion (fluoride ion, chloride ion, iodide ion), a substituted arylsulfonic acid ion (e.g., p-toluenesulfonate ion, p-chlorobenzenesulfonate ion, 1,5-naphthalenedisulfonate ion, 2,6-naphthalenedisulfonate ion, 2,6-naphthalenedisulfonate ion), an alkylsulfate ion (e.g., methylsulfate ion), a sulfate ion, a thiocyanate ion, a perchlorate ion, a tetrafluoroborate ion, a picrate ion, a acetate ion, and a trifluoromethanesulfonate ion. In addition, there may be used an ionic polymer a dye having an opposite charge. Further, $CO_2^-$ and $SO_3^-$ may be represented as $CO_2H$ and $SO_3H$ when containing a proton as a cation. In the formulas, m1, m11, m12, and m13 each represent the number of 0 or more, necessary to counterbalance the charge, preferably 0 to 4, more preferably 0 to 2, and 0 when forming a salt within the molecule.

Further, in this invention, the compound represented by formula (I) is selected preferably from the compounds represented by formula (XXI) or (XXII).

In the formula (XXI) or (XXII), $L^{11}$, $L^{12}$, $L^{13}$, $L^{14}$, $L^{15}$, $L^{16}$, $L^{17}$, p11, p12, n11, $Z^{11}$, $Z^{12}$, $L^{18}$, $L^{19}$, $L^{20}$, $L^{21}$, p13, q11, n12, $Z^{13}$, $Z^{14}$, $Z^{14'}$ and $R^{14}$ are the same as defined in formulas (XI) and (XII). $M^{14}$ and m14, and $M^{15}$ and m15 are the same as defined in $M^1$ and m1 described earlier. $R^{21}$ is similar to $R^{12}$, including an alkyl group, an aryl group and a heterocyclic group, except for a hydrogen atom. $L^2$ and $L^3$ are each similar to a linkage group defined in the foregoing $L^1$, except for a single bond.

In the formula (XXI), the specifically preferred combination is the case when n11 is 2, at least of a basic nucleus formed of $Z^{11}$, $L^{11}$, $L^{12}$ and p11, and a basic nucleus formed of $Z^{12}$, $L^{16}$, $L^{17}$ and p12 is a 4-quinoline nucleus and the other one is a benzoxazole ring, or the case when n11 is 3, a basic nucleus formed of $Z^{11}$, $L^{11}$, $L^{12}$ and p11, and a basic nucleus formed of $Z^{12}$ , $L^{16}$, $L^{17}$ and p12 are a benzoxazole nucleus or a benzothiazole nucleus (at least one of them is preferably a benzothiazole nucleus, and both are preferably a benzothiazole nucleus).

In the formula (XXII), the specifically preferred combination is the case when n12 is 2, a basic nucleus formed of $Z^{13}$, $L^{18}$, $L^{19}$ and p13 is a benzoxazole nucleus or benzothiazole nucleus, and an acidic nucleus formed of $Z^{14}$, $Z^{14'}$ and $(N—R^{14})_{q11}$ is a rhodanine nucleus, or the case when n12 is 3, a basic nucleus formed of $Z^{13}$, $L^{18}$, $L^{19}$ and p13 is a benzothiazole nucleus, and an acidic nucleus formed of $Z^{14}$, $Z^{14'}$ and $(N—R^{14})_{q11}$ is a rhodanine nucleus. Formula (XXII) is preferred of the formulas (XXI) and (XXII).

In this invention, the compound of formula (I) is specifically preferably a compound selected from compounds of formulas (XXXIa), (XXXIb) and (XXXII).

In the formulas (XXXIa), (XXXIb) and (XXXII), $Z^{51}$, $Z^{52}$, $Z^{53}$ and $Z^{54}$ are each an oxygen atom a sulfur atom, a nitrogen atom ($N—V^{80}$) or a carbon atom ($CV^{81}V_{82}$), in which $V^{81}$, $V^{82}$ and $V^{83}$ are each a hydrogen atom or a substituent (for example, such as A described earlier), preferably an alkyl group, an aryl group or a heterocyclic group, similar to $R^{11}$, and more preferably an alkyl group. $Z^{51}$ and $Z^{52}$ are each preferably an oxygen atom or a sulfur atom, and at least one of them is preferably a sulfur atom and both of them are more preferably sulfur atoms. $Z^{53}$ is preferably an oxygen atom or a sulfur atom, and more preferably a sulfur atom. $Z^{54}$ is preferably an oxygen atom or a sulfur atom, and more preferably an oxygen atom when n51 is 1 and more preferably a sulfur atom when n51 is 2. $Z^{55}$ is an oxygen atom, a sulfur atom or a nitrogen atom ($N—V^{83}$), in which $V^{83}$ is a hydrogen atom or a substituent (such as A described earlier), preferably an alkyl group, an aryl group or a heterocyclic group, as defined in $R^{11}$, and more preferably an alkyl group.

$V^{51}$, $V^{52}$, $V^{53}$, $V^{54}$, $V^{55}$, $V^{56}$, $V^{57}$, $V^{58}$, $V^{59}$, $V^{60}$, $V^{61}$, $V^{62}$, $V^{63}$, $V^{64}$, $V^{65}$, $V^{66}$, $V^{67}$, $V^{68}$, $V^{69}$, $V^{70}$, $V^{71}$ and $V^{72}$ are each a hydrogen atom or a substituent (such as A described earlier), of which two adjacent substituents may combine with each other to form a saturated or unsaturated condensed ring. These are each preferably a hydrogen atom, an alkyl group (e.g., methyl), an aryl group (e.g., phenyl), an aromatic heterocyclic group (e.g., 1-pyrrolyl, 2-thienyl), an alkoxy group (e.g., methoxy), an alkylthio group (e.g., methylthio), cyano group, an acyl group (e.g., acetyl), an alkoxycarbonyl group (e.g., methoxycarbonyl), a halogen atom (e.g., fluorine, chlorine, bromine, iodine), or tow adjacent ones combine with each other to form an unsaturated condensed ring (e.g., a benzene ring).

$R^{51}$, $R^{52}$, $R^{53}$ and $R^{54}$ are each an alkyl group, an aryl group or a heterocyclic group, provided that at least one of two $R^{52}$s and two $R^{53}$s forms $L^5$. $R^{51}$, $R^{52}$, $R^{53}$ and $R^{54}$ are each similar to $R^{11}$ described above. $R^{54}$ is more preferably a carboxyalkyl group, and still more preferably carboxymethyl.

$L^{51}$, $L^{52}$, $L^{53}$, $L^{54}$, $L^{55}$, $L^{56}$, $L^{57}$, $L^{58}$, $L^{59}$, $L^{60}$, $L^{61}$, $L^{62}$, $L^{63}$, $L^{64}$, $L^{65}$, and $L^{66}$ are each a methine group, including one similar to the foregoing $L^{13}$, $L^{14}$, $L^{15}$, $L^{16}$, $L^{20}$, and $L^{21}$. With respect to $L^{51}$, $L^{52}$, $L^{53}$, $L^{54}$, $L^{55}$, $L^{56}$, $L^{57}$, at least one of $L^{52}$ and $L^{54}$, $L^{53}$ and $L^{55}$, $L^{54}$ and $L^{56}$, $L^{52}$ and $L^{54}$, and $L^{52}$, $L^{54}$ and $L^{56}$, preferably combine with each other to form a ring. The ring may be any one and is preferably a 5- or 6-membered hydrocarbon ring. Of the foregoing, when three methine groups combine to form a ring, it is preferably a condensed structure of two 5- or 6-membered hydrocarbon rings or two heterocyclic rings, and more preferably a condensed structure of two 5- or 6-membered hydrocarbon rings. These rings may be substituted by substituents as described in the foregoing A.

Specifically, a preferred ring structure is shown below:

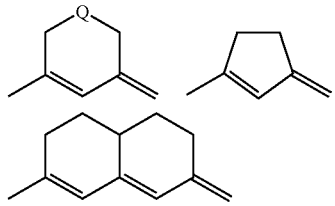

wherein Q is $CH_2$, O, S or $NR_{100}$, in which $R_{100}$ is a hydrogen atom or a univalent substituent (such as one described in A). In the foregoing ring structure, a substituent (such as one described in A) may be substituted at any position.

Specifically preferred ring structures as shown below.

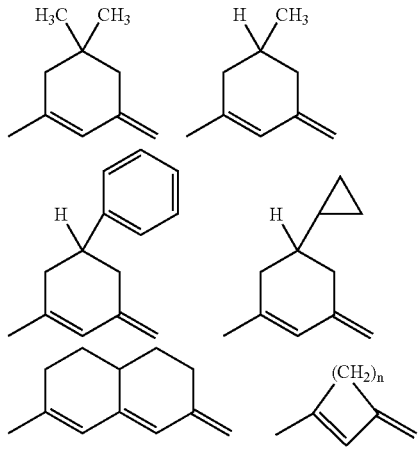

-continued

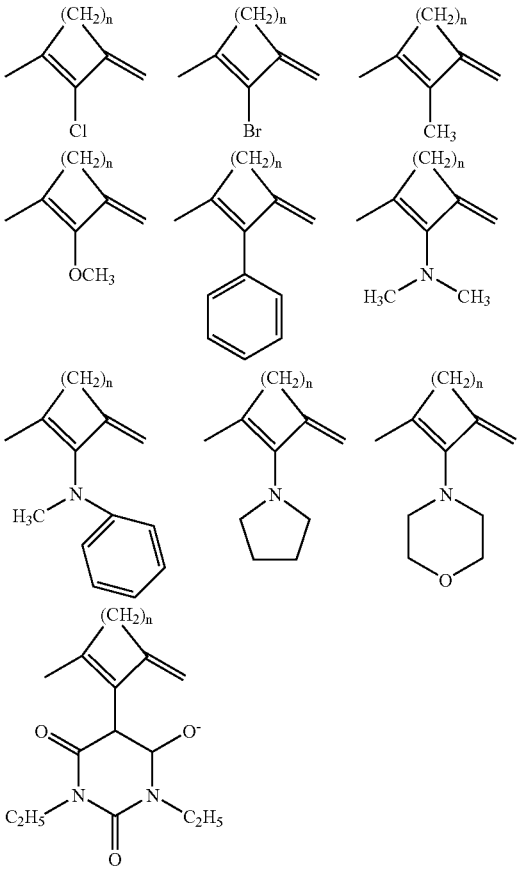

-continued n = 2,3

Of $L^{51}$, $L^{52}$, $L^{53}$, $L^{54}$, $L^{55}$, $L^{56}$ and $L^{57}$, a methine group forming no ring is preferably an unsubstituted methine group.

$L^{58}$, $L^{59}$, $L^{61}$ and $L^{62}$ are each preferably an unsubstituted methine group; $L^{60}$ is preferably an unsubstituted methine group or an alkyl-substituted methine group, and more preferably a methyl-substituted methine group. $L^{63}$, $L^{64}$ and $L^{66}$ are each preferably an unsubstituted methine group and $L^{65}$ is preferably an unsubstituted methine group or an alkyl-substituted methine group, and more preferably a methyl-substituted methine group. When n51 is 2, $L^{64}$ and $L^{65}$ are each repeated, and they are not each necessarily the same but they are each preferably the same, or it is preferred that $L_{64}$ to $L_{66}$ form such a ring as explained in the preferred case of $L^{51}$, $L^{52}$, $L^{53}$, $L^{54}$, $L^{55}$, $L^{56}$and $L^{57}$ and a methine group forming no ring is unsubstituted one.

$M^{51}$ and m51, $M^{52}$ and m52, $M^{53}$ and m53 are each the same as defined in the foregoing $M^1$ and m1. $L^4$, $L^5$ and $L^6$ are each the same as $L^1$ described earlier. except for a single bond.

Of the formulas (XXXIa), (XXXIb) and (XXXII), formulas (XXXIa) and (XXXII) are preferred and formula (XXXII) is more preferred.

Specifically preferred examples of the dye compound represented by formula (A) or (I) are shown below, but are not limited to these. First, specific examples of $D^1$, $D^a$ or $D^b$ as a dye chromophore are shown below, provided a charge balancing counter ion is not described therein but any possible counter ion may exist.

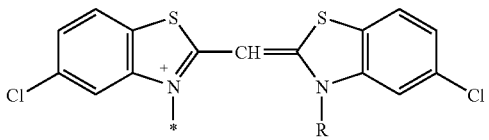

DS-1 R = $C_2H_5$
DS-2 R = $(CH_2)_3SO_3^-$
DS-3 R = $CH_2CONHSO_2CH_3$
DS-4 R = $CH_2CO_2H$

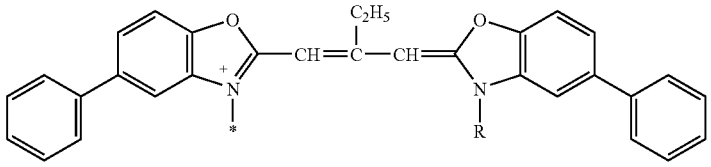

DS-5 R = $C_2H_5$
DS-6 R = $(CH_2)_4SO_3^-$

DS-7 R = $(CH_2)_2O$— 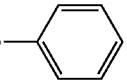

-continued
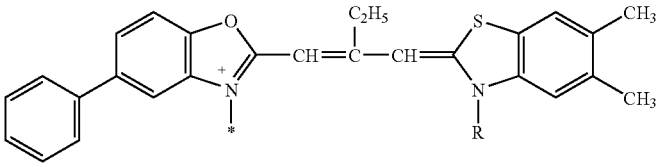
DS-8 R = $(CH_2)_2OH$
DS-9 R = $(CH_2)_2CH(CH_3)SO_3^-$
DS-10 R = $(CH_2)_3CONHSO_2$—
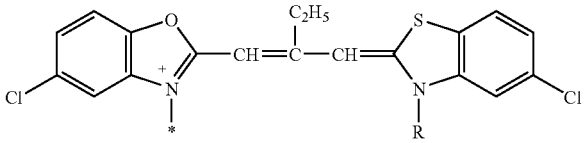
DS-11 R = $C_2H_5$
DS-12 R = $(CH_2)_3SO_3^-$
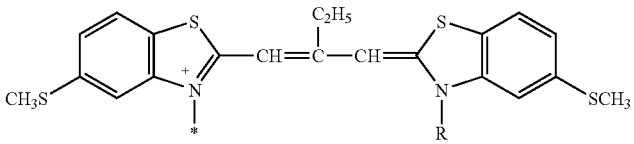
DS-13 R = $C_2H_5$
DS-14 R = $(CH_2)_3SO_3^-$
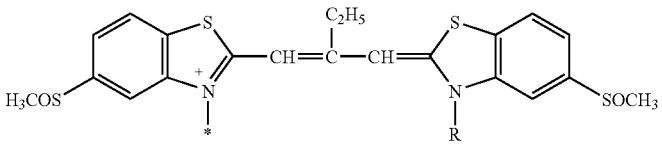
DS-15 R = $C_2H_5$
DS-16 R = $(CH_2)_3SO_3^-$
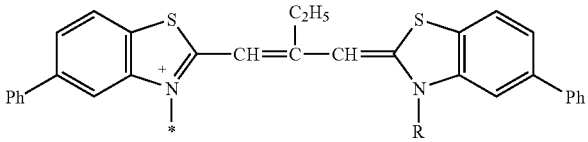
DS-17 R = $C_2H_5$
DS-18 R = $(CH_2)_3SO_3^-$
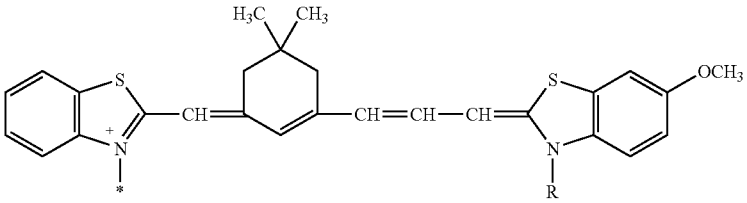
DS-19 R = $C_2H_5$
DS-20 R = $(CH_2)_3SO_3^-$
DS-21 R = $(CH_2)_2O$—
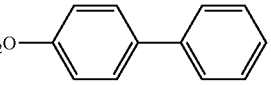

-continued
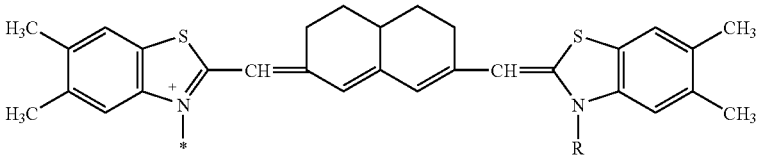
DS-22 R = (n)$C_5H_{11}$
DS-23 R = $(CH_2)_2O(CH_2)_2O$—
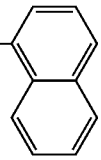
DS-24 R = $(CH_2)_2SO_3^-$
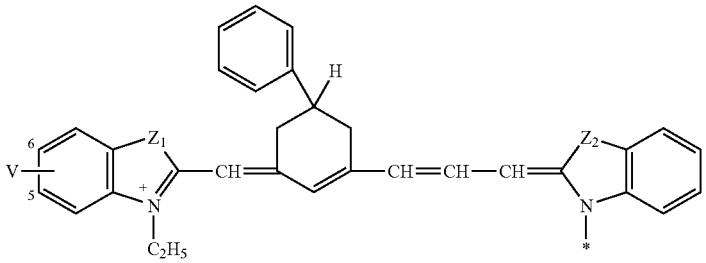
DS-25 $Z_1$ = Se, V = 5-$CH_3$, $Z_2$ = S
DS-26 $Z_1$ = N—$C_2H_5$, V = 5-CN, 6-Cl, $Z_2$ = O)
DS-27 $Z_1$ = Te, V = H, $Z_2$ = —CH═CH—
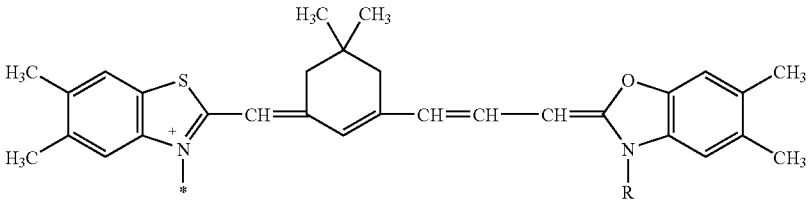
DS-28 R = $C_2H_5$
DS-29 R = $(CH_2)_2O$—
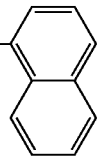
DS-30 R = $(CH_2)_2CHSO_3^-$
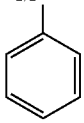
DS-31 R = $(CH_2)_2O$—
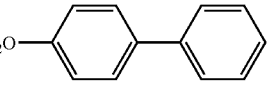

-continued
DS-32
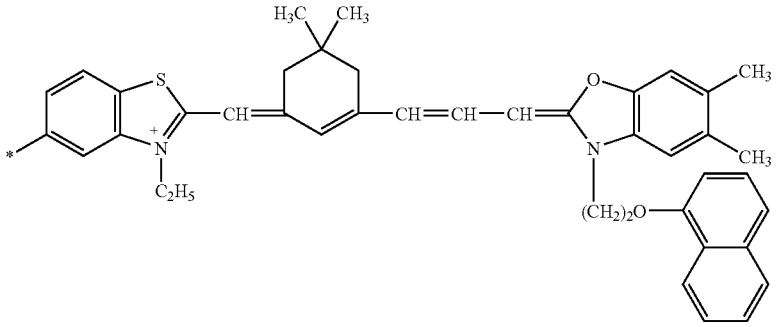
DS-33
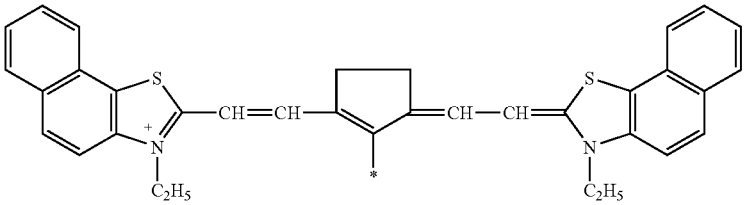
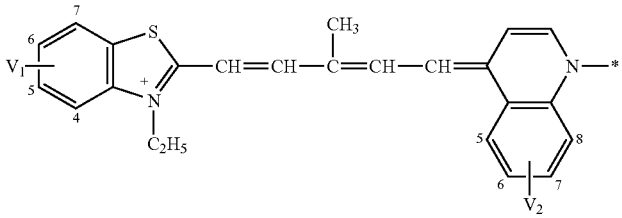
DS-34 $V_1$ = 5, 6-$(CH_3)_2$, $V_2$ = H
DS-35 $V_1$ = 5, 6-$(CH_3)_2$, $V_2$ = 6, 7-$(CH_3)_2$
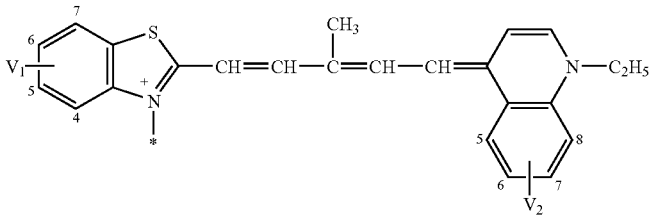
DS-36 $V_1$ = 5-$SOCH_3$, $V_2$ = 6, 7-$(OCH_3)_2$
DS-37 $V_1$ = 5, 6-$(CH_3)_2$, $V_2$ = 6, 7-$(CH_3)_2$
DS-38 $V_1$ = 5-$SCH_3$, $V_2$ = H
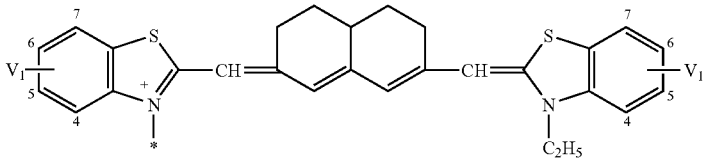
DS-39 $V_1$ = H
DS-40 $V_1$ = 5-$SCH_3$
DS-41 $V_1$ = 6-$OCH_3$
DS-42 $V_1$ = 6, 7-Benzo
DS-43 $V_1$ = 5-$SOCH_3$ -continued
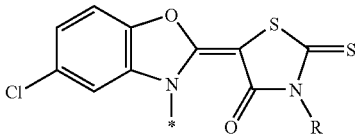
DS-44 R = $C_2H_5$
DS-45 R = $CH_2CO_2H$
DS-46 R = $(CH_2)_2SO_3^-$
DS-47 R = 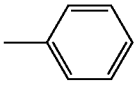
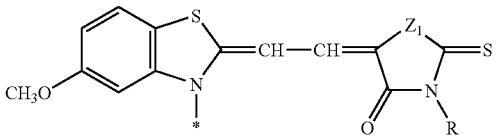
DS-48 $Z_1$ = S, R = $CH_2$ 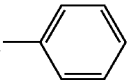
DS-49 $Z_1$ = $N(CH_2)_2O(CH_2)_2OH$, R = 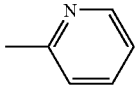
DS-50 $Z_1$ = O, R = $CH_2CO_2H$
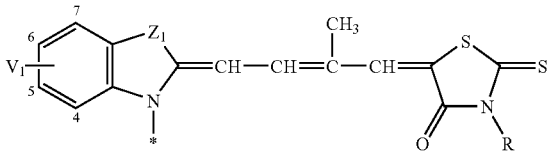
DS-51 $V_1$ = 5, 6-$(CH_3)_2$, $Z_1$ = O, R = $CH_2CO_2H$
DS-52 $V_1$ = 6, 7-Benzo, $Z_1$ = O, R = $CH_2CO_2H$
DS-53 $V_1$ = 6-$CH_3$, $Z_1$ = S, R = $CH_2CO_2H$
DS-54 $V_1$ = 5, 6-$Cl_2$, $Z_1$ = N—$C_2H_5$, R = $C_2H_5$
DS-55 $V_1$ = 5-Cl, $Z_1$ = Se, R= 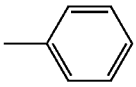
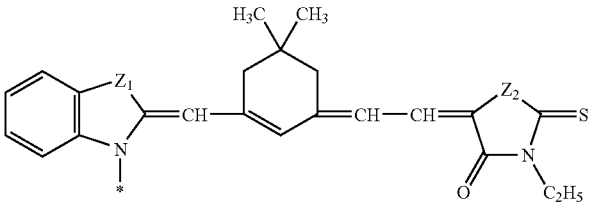
DS-56 $Z_1$ = S, $Z_2$ = S
DS-57 $Z_1$ = O, $Z_2$ = N—$C_2H_5$
DS-58 $Z_1$ = N—$C_2H_5$, $Z_2$ = O
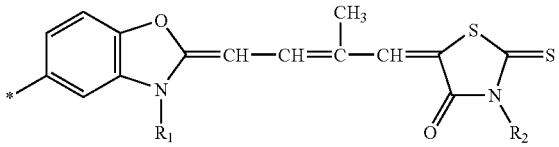
DS-59 $R_1$ = (n)$C_8H_{17}$, $R_2$ = $CH_2CO_2H$
DS-60 $R_1$ = $(CH_2)_2$ 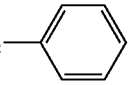 , $R_2$ = $C_2H_5$ -continued
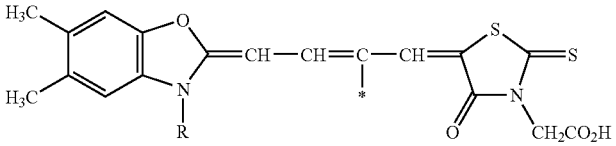
DS-61 R = $C_2H_5$
DS-62 R = $CH_2CO_2H$
DS-63 R = $(CH_2)_3CONHSO_2CH_3$
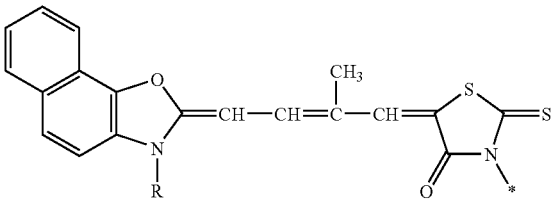
DS-64 R = $(n)C_8H_{17}$
DS-65 R = $CH_2CO_2H$
DS-66 R = $(CH_2)_4SO_3^-$
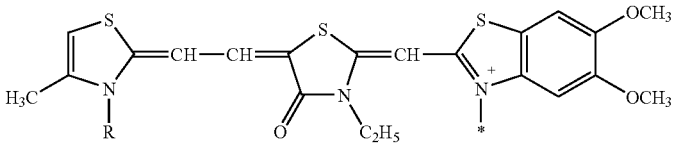
DS-67 R = $C_2H_5$
DS-68 R = $CH_2CO_2H$
DS-69 R = $(CH_2)_3SO_3^-$
DS-70 R = $(CH_2)_2OSO_3^-$
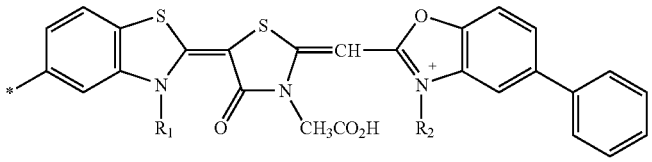
DS-71 $R_1 = R_2 = C_2H_5$
DS-72 $R_1 = (CH_2)_2SO_3^-$, $R_2 = CH_2CO_2H$
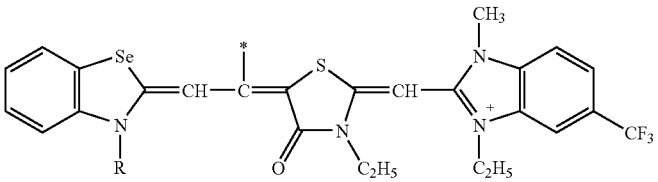
DS-73 R = $C_2H_5$
DS-74 R = $(CH_2)_3SO_3^-$
DS-75 R = 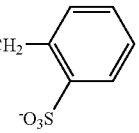
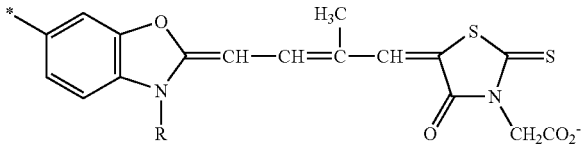
DS-76 R = $(CH_2)_3SO_3^-$
DS-77 R = $C_2H_5$ -continued
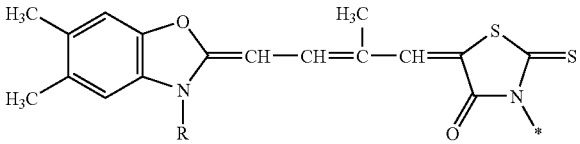
DS-78 R= $(CH_2)_4SO_3^-$
DS-79 R = $C_2H_5$
DS-80 R = $(n)C_5H_{11}$
DS-81 R = $(CH_2)_5CO_2H$
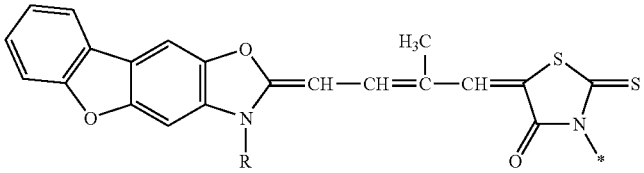
DS-82 R = $(CH_2)_3SO_3^-$
DS-83 R = $C_2H_5$
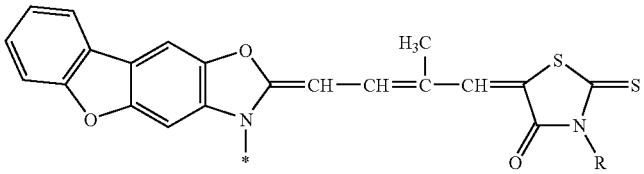
DS-84 R = $(CH_2)_3SO_3^-$
DS-85 R = $CH_2CO_2H$
Specific examples of linkage group $-L^1-$ or $-L_a-$ are shown below, provided that a charge balancing counter ion is not described therein but any possible counter ion may exist.
Examples of Linkage Group:
L-1 $-(CH_2)_4-$
L-2 $-(CH_2)_8-$
L-3 $-(CH_2)_7CH{=}CH-(CH_2)_7-$
L-4
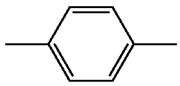
L-5
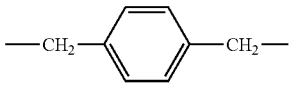
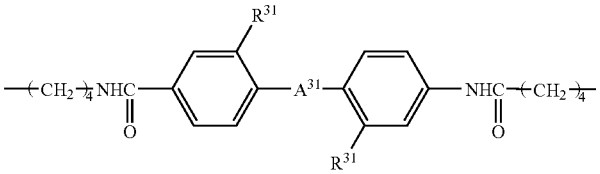
$A^{31}$ $R^{31}$ -continued
| | | |
|---|---|---|
| L-6 | — | H |
| L-7 | — | $—SO_3^-$ |
| L-8 | —O— | H |
| L-9 | —O— | $—SO_3^-$ |
| L-10 | $—SO_2—$ | H |
L-11
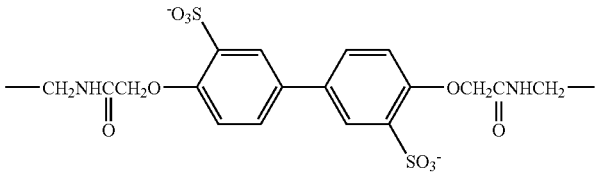
L-12
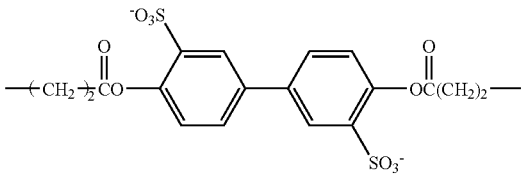
L-13
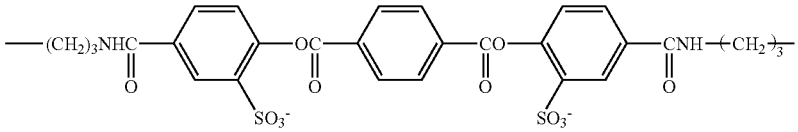
L-14
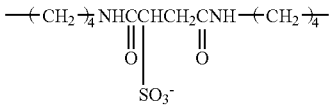
L-15
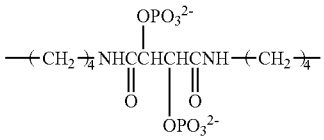
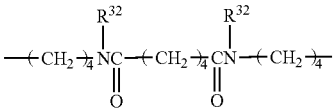
| | $R^{32}$ |
|---|---|
| L-16 | $—(CH_2)_3SO_3^-$ |
| L-17 | $—(CH_2)_2COO^-$ |
| L-18 | $—(CH_2)_2PO_3^-$ |
L-19
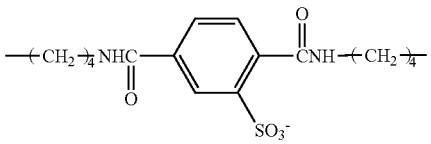
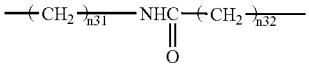
| n31 | n32 |
|---|---|

-continued
| | | |
|---|---|---|
| L-20 | 4 | 5 |
| L-21 | 8 | 5 |
| L-22 | 8 | 1 |
| L-23 | 4 | 3 |
| L-24 | 4 | 1 |
L-25
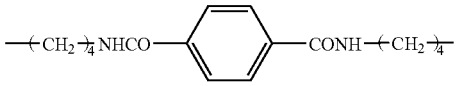
L-26
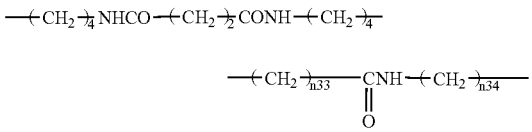
| | n33 | n34 |
|---|---|---|
| L-27 | 5 | 4 |
| L-28 | 5 | 8 |
| L-29 | 1 | 6 |
L-30
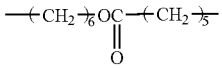
L-31
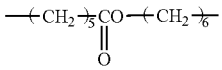
L-32
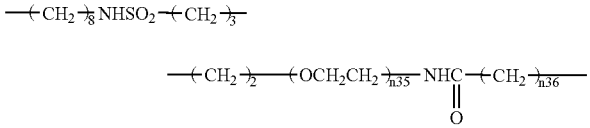
| | n35 | n36 |
|---|---|---|
| L-33 | 2 | 5 |
| L-34 | 2 | 1 |
| L-35 | 3 | 1 |
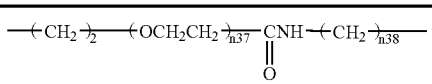
| | n37 | n38 |
|---|---|---|
| L-36 | 2 | 3 |
| L-37 | 2 | 4 |
| L-38 | 2 | 8 |
L-39
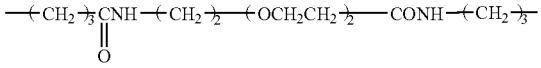
L-40
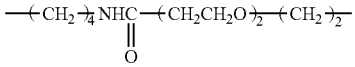
L-41
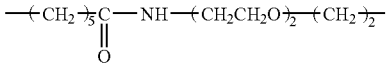
L-42
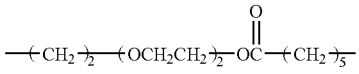
L-43

-continued
| | $-(CH_2)_2-(A^{32}CH_2CH_2)_3-NHCO-(CH_2)_5-$ |
|---|---|
| | $A^{32}$ |
| L-44 | —S— |
| L-45 | $-N(CH_3)-$ |
| L-46 | $-CH(OH)-$ |
L-47 $-(CH_2)_2SO_2-(CH_2)_2NHCO-(CH_2)_5-$
L-48 —
$-[(CH_2)_2-O]_n-(CH_2)_2-$
L-49 n = 1
L-50 n = 2
L-51 n = 3
L-52 n = 4
$-(CH_2)_n-$
L-53 n = 2
L-54 n = 5
L-55 n = 12
L-56 $-CH_2C{\equiv}CCH_2-$
L-57 $-S-(CH_2)_5-S-$
L-58
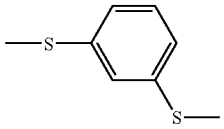
L-59 $-(CH_2)_5-CONH-(CH_2)_2-N(-(CH_2)_2-NHCO-(CH_2)_5-)-(CH_2)_2-NH-CO-(CH_2)_5-$
$-(CH_2)_n-$
L-60 n = 1
L-61 n = 3
L-62 n = 6
L-63 n = 10
L-64 n = 9
L-65 n = 18
L-66 n = 14
L-67 n = 16
L-68 n = 24
$-[-(CH_2)_2-O]_n-(CH_2)_2-$
L-69 n = average 44

-continued

L-70

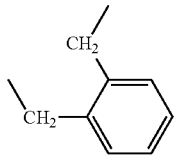

L-71

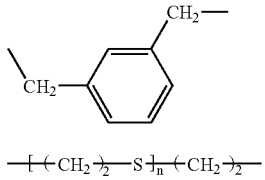

L-72 n = 1
L-73 n = 2
L-74 n = 3

Next, specific examples of the compound represented by formula (A) or (I) are shown. First, there are shown examples of $D^1$-$L^1$-$D^1$ $M^1{}_{m1}$ (which corresponds to the case when q1, q2 and r1 are 1). Thus, in the respective structures of the foregoing dye chromophore examples (DS), $L^1$ is attached to the position designated as "*".

| No. | $D^1$ | $L^1$ | $M^1$ | m1 |
|---|---|---|---|---|
| DD-1 | DS-1 | L-2 | p-TsO⁻ | 2 |
| DD-2 | DS-2 | L-50 | — | — |
| DD-3 | DS-7 | L-51 | p-TsO⁻ | 2 |
| DD-4 | DS-11 | L-5 | p-TsO⁻ | 2 |
| DD-5 | DS-13 | L-2 | $Br^-$ | 2 |
| DD-6 | DS-16 | L-11 | — | — |
| DD-7 | DS-15 | L-2 | $Br^-$ | 2 |
| DD-8 | DS-24 | L-14 | $Na^+$ | 1 |
| DD-9 | DS-26 | L-21 | $Br^-$ | 2 |
| DD-10 | DS-28 | L-50 | $CH_3SO_3^-$ | 2 |
| DD-11 | DS-29 | L-50 | $CH_3SO_3^-$ | 2 |
| DD-12 | DS-31 | L-5 | p-TsO⁻ | 2 |
| DD-13 | DS-32 | L-30 | p-TsO⁻ | 2 |
| DD-14 | DS-33 | L-58 | $Cl^-$ | 2 |
| DD-15 | DS-51 | L-33 | — | — |
| DD-16 | DS-54 | L-41 | — | — |
| DD-17 | DS-57 | L-50 | — | — |
| DD-18 | DS-57 | L-51 | — | — |
| DD-19 | DS-58 | L-50 | — | — |
| DD-20 | DS-58 | L-54 | — | — |
| DD-21 | DS-17 | L-2 | $Br^-$ | 2 |
| DD-22 | DS-65 | L-7 | $Na^+$ | 2 |
| DD-23 | DS-68 | L-52 | — | — |
| DD-24 | DS-70 | L-16 | $HN^+(C_2H_5)_3$ | 2 |
| DD-25 | DS-75 | L-56 | $K^+$ | 2 |
| DD-26 | DS-100 | L-50 | p-TsO⁻ | 2 |
| DD-27 | DS-104 | L-1 | $Cl^-$ | 2 |
| DD-28 | DS-107 | L-9 | $Na^+$ | 2 |
| DD-29 | DS-40 | L-2 | $Br^-$ | 2 |
| DD-30 | DS-43 | L-2 | p-TsO⁻ | 2 |
| DD-31 | DS-28 | L-1 | $CH_3SO_3^-$ | 2 |
| DD-32 | DS-28 | L-2 | $CH_3SO_3^-$ | 2 |
| DD-33 | DS-28 | L-63 | $CH_3SO_3^-$ | 2 |
| DD-34 | DS-57 | L-1 | — | — |
| DD-35 | DS-57 | L-2 | — | — |
| DD-36 | DS-57 | L-63 | — | — |
| DD-37 | DS-58 | L-1 | — | — |
| DD-38 | DS-58 | L-2 | — | — |
| DD-39 | DS-58 | L-63 | — | — |
| DD-40 | DS-35 | L-2 | p-TsO⁻ | 2 |
| DD-41 | DS-37 | L-63 | $CH_3SO_3^-$ | 2 |

-continued

| | | | | |
|---|---|---|---|---|
| DD-42 | DS-39 | L-1 | $Br^-$ | 2 |
| DD-43 | DS-40 | L-2 | p-TsO⁻ | 2 |
| DD-44 | DS-43 | L-63 | $BF_4^-$ | 2 |
| DD-45 | DS-29 | L-2 | $CH_3SO_3^-$ | 2 |

| No. | $D^a$ | $D^b$ | $L^{a(1)}$ | $M^a$ | ma |
|---|---|---|---|---|---|
| DD-50 | DS-28 | DS-29 | L-55 | $CH_3SO_3^-$ | 2 |
| DD-51 | DS-28 | DS-30 | L-54 | $CH_3SO_3^-$ | 1 |
| DD-52 | DS-57 | DS-58 | L-55 | — | — |
| DD-53 | DS-28 | DS-57 | L-3 | $CH_3SO_3^-$ | 1 |
| DD-54 | DS-57 | DS-58 | L-2 | — | — |

p-TsO⁻ = $CH_3$ 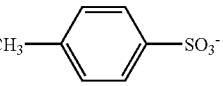 $SO_3^-$ (1)$D^a$ being on the left side of $L^a$

Specific examples of the case when two $D^1$s are linked through $L^1$ [namely, q1 and r1 are each 1, and q2 is 2 in formula (I)]. The foregoing DS-44 is linked to L-55 at the position designated "*".

DS-69

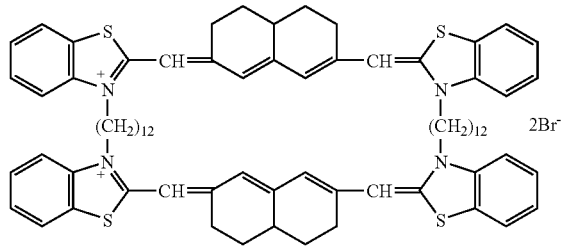

There are shown specific examples of the case of at least three $D^1$s [or when q2 is 1, one of q1 and r1 is 1 and the other one is 2 in formula (I)]. Thus, in the respective structures of the foregoing dye chromophore examples (DS), $L^1$ is attached to the position designated as "*".

DD-71

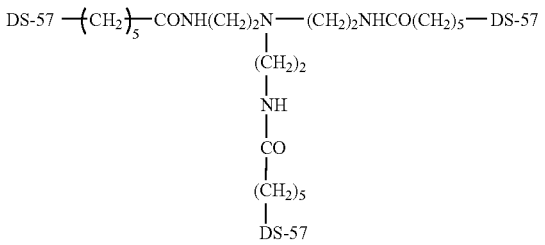

DD-72

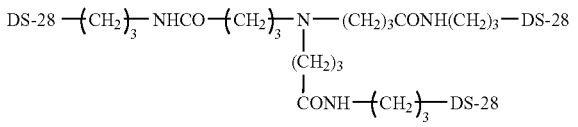

Specific examples $D^a$-$L^a$-$D^b$ $M^a{}_{ma}$ are shown below, corresponding the case when qa, qb and ra are each 1 in formula (A). Thus, in the respective structures of the foregoing dye chromophore examples (DS), $L^a$ is attached to the position designated as "*"

| No. | $D^a$ | $D^b$ | $L^{a1)}$ | $M^a$ | ma |
|---|---|---|---|---|---|
| DD-73 | DS-28 | DS-29 | L-55 | $CH_3SO_3^-$ | 2 |
| DD-74 | DS-28 | DS-30 | L-54 | $CH_3SO_3^-$ | 1 |
| DD-75 | DS-57 | DS-58 | L-55 | — | — |
| DD-76 | DS-28 | DS-57 | L-3 | $CH_3SO_3^-$ | 1 |
| DD-77 | DS-57 | DS-58 | L-2 | — | — |

[1)] $D^a$ being on the left side of $L^a$

The compounds represented by formula (A) or (I) can be synthesized in accordance with methods described in F. M. Harmer, Heterocyclic Compounds-Cyanine Dyes and Related Compounds (John Wiley & Sons, New York, London, 1964): D. M. Sturmer, Heterocyclic Compounds-Special topics in heterocyclic chemistry, chapter 18, sect. 14, page 482–515 (John Wiley & Sons, New York, London, 1977); Rodd's Chemistry of Carbon Compounds, 2nd Ed. vol. IV, part B, published in 1977, page 369–422, Elsevier Science Publishing Company Inc., New York.

The foregoing compound containing at least two dye chromophores is preferably incorporated through solution in an organic solvent or a mixture of an organic solvent and water. Organic solvents are alcohols, ketones, nitrites and alkoxyalcohols. Specific examples thereof include methanol, ethanol, n-propyl alcohol, isopropyl alcohol, ethylene glycol, propylene glycol, 1,3-propanediol, acetone, acetonitrile, 2-methoxyethanol, and 2-ethoxyethanol. Of these, methanol and ethanol are preferred and methanol is specifically preferred.

The compound containing at least two dye chromophores may be incorporated in the form of solid particles dispersed in an aqueous colloid. When incorporated in the form of such a hydrophilic colloid dispersion, gelatin is advantageously used as hydrophilic colloid but other hydrophilic colloids may be used. Examples thereof include gelatin derivatives, graft polymer of gelatin with other polymers, proteins such as albumin and casein, cellulose derivatives such as hydroxyethyl cellulose, carboxymethyl cellulose and cellulose sulfuric acid ester, saccharides such as sodium alginate and starch derivatives, and various synthetic polymeric materials including a homopolymer and a copolymer, such as polyvinyl alcohol, polyacrylic acid, polymethacrylic acid, polyacrylamide, polyvinyl imidazole. Of hydrophilic colloids, gelatin is specifically preferred. The compound containing at least two dye chromophores is incorporated preferably in an amount of from 0.001% to 10%, 0.01% to 5%, and still more preferably 0.1% to 2% by weight, based on silver of 1 mol of silver halide.

Fine particles of the compound containing at least two dye chromophores promotes dissolution and becomes possible to complete adsorption onto silver halide grains, compared to the case of coarse particles.

Silver halide emulsion in general exhibits a relatively high viscosity and stirring by high-speed rotation of the emulsion is not preferred in terms of bubbling. When powder of the compound containing at least two dye chromophores is directly added to a solution of silver halide emulsion, the compound often causes irregular-formed blocks, producing problems in practice, for example, causing scattering in adsorption of the compound containing at least two dye chromophores onto silver halide grains. In light of the foregoing., the particle size of a solid particle dispersion of the compound containing at least two dye chromophores is not more than 20 μm, preferably from 0.005 to 10 μm, and more preferably 0.01 to 5 μm. The particle size can be determined by methods known in the art, such as a method of determination from the projected area of an electron-micrograph, a method of light scattering diffraction based on Mie scattering and Fraunhofer's diffraction and a method of determination from electric resistance based on Coulter Principle. The method of light scattering diffraction is preferred in terms of simplicity of measurement. In this invention, measurement was done using SALD-2000, produced by Shimadzu Corp.

A solid particle dispersion of a compound containing at least two dye chromophores can be obtained by mechanically pulverizing or dispersing the compound in an aqueous medium. Specifically, a solid fine particle dispersion of a compound containing at least two dye chromophores can be obtained using various types of dispersing machines, such as a high-speed stirrer, a ball mill, a sand mill, a colloid mill, atreiter and a ultrasonic dispersing machine. The compound containing at least two dye chromophores is dispersed in aqueous medium at a temperature of from 0 to 100° C., preferably 20 to 80° C. and more preferably 50 to 70° C.

The compound containing at least two dye chromophores can be stored in the form of a hydrophilic colloid gel containing the compound, exhibiting superior sedimentation stability by cooling an aqueous solution of the compound. In a hydrophilic colloid gel containing a compound containing at least two dye chromophores, the hydrophilic colloid concentration is preferably at least 0.5%, more preferably from 1% to 50%, and from 2% to 10% by weight.

It is known that when the pH of an aqueous solution of a compound containing at least two dye chromophores deviates from the neutral region, chemical stability of the compound is impaired and it is effective to make dispersion in the neutral region, as disclosed in JP-B No. 61-45217 (hereinafter, the term, JP-B refers to Japanese Patent Publication). Accordingly, it is preferred to adjust the pH within the range of from 4 to 10, preferably from 5 to 9, and more preferably from 6 to 8.

There may be further used sensitizing dyes other than those described above as long as they do not result in adversely effects. Examples of the spectral sensitizing dye include cyanine, merocyanine, complex cyanine, complex merocyanine, holo-polar cyanine, styryl, hemicyanine, oxonol and hemioxonol dyes, as described in JP-A Nos. 63-159841, 60-140335, 63-231437, 63-259651, 63-304242, 63-15245; U.S. Pat. Nos. 4,639,414, 4,740,455, 4,741,966, 4,751,175 and 4,835,096. Usable sensitizing dyes are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners. Examples thereof include compounds described in JP-A Nos. 9-34078, 9-54409 and 9-80679.

Useful cyanine dyes include, for example, cyanine dyes containing a basic nucleus, such as thiazoline, oxazoline, pyrroline, pyridine, oxazole, thiazole, selenazole and imidazole nuclei. Useful merocyanine dyes preferably contain, in addition to the foregoing nucleus, an acidic nucleus such as thiohydatoin, rhodanine, oxazolidine-dione, thiazolinedione, barbituric acid, thiazolinone, malononitrile and pyrazolone nuclei. In the invention, there are also preferably used sensitizing dyes having spectral sensitivity within the infrared region. Examples of the preferred infrared sensitizing dye include those described in U.S. Pat. Nos. 4,536,478, 4,515,888 and 4,959,294.

The photothermographic material preferably contains at least one of sensitizing dyes described in Japanese Patent Application No. 2003-102726, represented by the following formulas (SD-1) and (SD-2):

formula (SD-1)

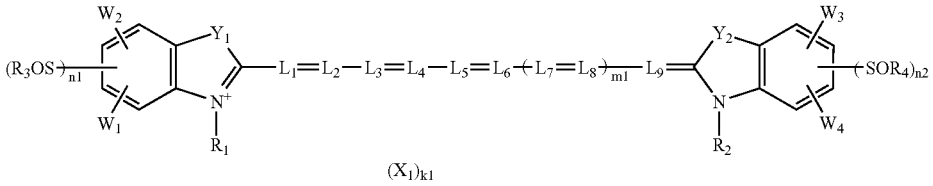

formula (SD-2)

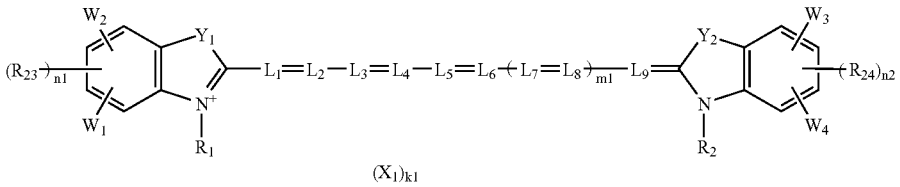

wherein $Y_1$ and $Y_2$ are each an oxygen atom, a sulfur atom, a selenium atom or —CH═CH—; $L_1$, to $L_9$ are each a methine group; $R_1$ and $R_2$ are an aliphatic group; $R_3$, $R_4$, $R_{23}$ and $R_{24}$ are each a lower alkyl group, a cycloalkyl group, an alkenyl group, an aralkyl group, an aryl group or a heterocyclic group; $W_1$, $W_2$, $W_3$ and $W_4$ are each a hydrogen atom, a substituent or an atom group necessary to form a ring by $W_1$ and $W_2$ or $W_3$ and $W_4$, or an atom group necessary to form a 5- or 6-membered ring by $R_3$ and $W_1$, $R_3$ and $W_2$, $R_{23}$ and $W_1$, $R_{23}$ and $W_2$, $R_4$ and $W_3$, $R_4$ and $W_4$, $R_{24}$ and $W_3$, or $R_{24}$ and $W_4$; $X_1$ is an ion necessary to compensating for a charge within the molecule; k1 is the number of ions necessary to compensate for a charge within the molecule; m1 is 0 or 1; n1 and n2 are each 0, 1 or 2, provided that n1 and n2 are not 0 at the same time.

The infrared sensitizing dyes and spectral sensitizing dyes described above can be readily synthesized according to the methods described in F. M. Hammer, The Chemistry of Heterocyclic Compounds vol. 18, "The cyanine Dyes and Related Compounds" (A. Weissberger ed. Interscience Corp., New York, 1964).

The infrared sensitizing dyes can be added at any time after preparation of silver halide. For example, the dye can be added to a light sensitive emulsion containing silver halide grains/organic silver salt grains in the form of by dissolution in a solvent or in the form of a fine particle dispersion, so-called solid particle dispersion. Similarly to the heteroatom containing compound having adsorptivity to silver halide, after adding the dye prior to chemical sensitization and allowing it to be adsorbed onto silver halide grains, chemical sensitization is conducted, thereby preventing dispersion of chemical sensitization center specks and achieving enhanced sensitivity and minimized fogging.

These sensitizing dyes may be used alone or in combination thereof. The combined use of sensitizing dyes is often employed for the purpose of supersensitization, expansion or adjustment of the light-sensitive wavelength region. A super-sensitizing compound, such as a dye which does not exhibit spectral sensitization or substance which does not substantially absorb visible light may be incorporated, in combination with a sensitizing dye, into the emulsion containing silver halide grains and organic silver salt grains used in photothermographic imaging materials of the invention.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula (6) is preferred as a supersensitizer:

Ar—SM formula (6)

wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

Ar—S—S—Ar Formula [7]

wherein Ar is the same as defined in the mercapto compound represented by the formula described earlier.

The aromatic heterocyclic rings described above may be substituted with a halogen atom (e.g., Cl, Br, I), a hydroxy group, an amino group, a carboxy group, an alkyl group (having one or more carbon atoms, and preferablyl 1 to 4 carbon atoms) or an alkoxy group (having one or more carbon atoms, and preferablyl 1 to 4 carbon atoms). In addition to the foregoing supersensitizers, there are usable heteroatom-containing macrocyclic compounds described in JP-A No. 2001-330918, as a supersensitizer. The supersensitizer is incorporated into a light-sensitive layer containing organic silver salt and silver halide grains, preferably in an amount of 0.001 to 1.0 mol, and more preferably 0.01 to 0.5 mol per mol of silver.

It is preferred that a sensitizing dye is allowed to adsorb onto the surface of light-sensitive silver halide grains to achieve spectral sensitization and the spectral sensitization effect substantially disappears after being subjected to thermal development. The effect of spectral sensitization substantially disappearing means that the sensitivity of the photothermographic material, obtained by a sensitizing dye or a supersensitizer is reduced, after thermal development, to not more than 1.1 times that of the case not having been subjected to spectral sensitization. To allow the effect of spectral sensitization to disappear, it is preferred to use a spectral sensitizing dye easily releasable from silver halide grains and/or to allow an oxidizing agent such as a halogen radical-releasing compound which is capable of decomposing a spectral sensitizing dye through an oxidation reaction to be contained in an optimum amount in the light-sensitive layer and/or the light-insensitive layer. The content of an oxidizing agent is adjusted in light of oxidizing strength of the oxidizing agent and its spectral sensitization effects.

The light-insensitive silver salt of an aliphatic carboxylic acid relating to this invention will be described. The light-insensitive silver salts of aliphatic carboxylic acids (hereinafter, denoted as silver salts of fatty acids and also denoted as silver aliphatic carboxylates or organic silver salts) are a reducible silver source, and silver salts of organic acids are preferred and silver salts of long chain aliphatic carboxylic acid (also called fatty carboxylic acid or simply fatty acid) having 10 to 30 carbon atom, preferably 15 to 25 carbon atoms are more preferred. Examples of silver salt of long chain aliphatic carboxylic acids include silver salts of gallic acid, citric acid, behenic acid, stearic acid, arachidic acid, palmitic acid and lauric acid, and of these, silver behenate, silver arachidate and silver stearate are preferred.

The combined use of at least two kinds of silver salts of aliphatic carboxylic acids is preferable to enhance developability and to form images with high density and high contrast. For example, such silver salts can be prepared by adding an aqueous silver salt solution to a mixture of at least two kinds of fatty acids. On the other hand, it is preferred from the point of view of image lasting quality that the content of silver salts of aliphatic carboxylic acids exhibiting a melting point of 50° C. or more (preferably 60° C. or more) is at least 60% (more preferably at least 70% and still more preferably at least 80%). In view thereof, the higher content of silver behenate is more preferable.

Aliphatic carboxylic acid silver salts can be obtained by mixing an aqueous-soluble silver compound with a compound capable of forming a complex. Normal precipitation, reverse precipitation, double jet precipitation and controlled double jet precipitation, as described in JP-A 9-127643 are preferably employed. For example, to an organic acid can be added an alkali metal hydroxide (e.g., sodium hydroxide, potassium hydroxide, etc.) to form an alkali metal salt soap of the organic acid (e.g., sodium behenate, sodium arachidate, etc.), thereafter, the soap and silver nitrate are mixed by the controlled double jet method to form organic silver salt crystals. In this case, silver halide grains may be concurrently present.

Alkali metal salts usable in this invention include, for example, sodium hydroxide, potassium hydroxide and lithium hydroxide, and the combined use of sodium hydroxide and potassium hydroxide is preferred. The ratio of both hydroxides used in combination is preferably from 10:90 to 75:25. The combined use falling within the foregoing range can control the viscosity of a reaction mixture in a favorable state. When an aliphatic carboxylic acid silver salt is prepared in the presence of silver halide grains having grain sizes of 0.050 μm or less, A higher proportion of potassium of alkali metals of an alkali metal salt suitably inhibits dissolution and Ostwald ripening of silver halide grains. A higher potassium proportion results in reduced particle size of a fatty acid silver salt. The potassium salt proportion is preferably 50% to 100%, based total alkali metal salts used in the preparation of an aliphatic carboxylic acid silver salt. The alkali metal concentration is preferably from 0.1 to 0.3 mol per 1000 ml.

With regard to the difference in constitution between a conventional silver salt photographic material and a photothermographic imaging material, the photothermographic imaging material contains relatively large amounts of light sensitive silver halide, a carboxylic acid silver salt and a reducing agent which often cause fogging and silver printing-out (print out silver). In the photothermographic imaging material, therefore, an enhanced technique for antifogging and image-lasting quality is needed to maintain storage stability not only before development but also after development. In addition to commonly known aromatic heterocyclic compounds to restrain growth of fog specks and development thereof, there were used mercury compounds having a function of allowing the fog specks to oxidatively die away. However, such a mercury compound causes problems with respect to working safety and environment protection.

The important points for achieving technologies for antifogging and image stabilizing are to prevent formation of metallic silver or silver atoms caused by reduction of silver ion during preserving the material prior to or after development; and to prevent the formed silver from effecting as a catalyst for oxidation (to oxidize silver into silver ions) or reduction (to reduce silver ions to silver).

Antifoggants as well as image stabilizing agents which are employed in the silver salt photothermographic dry imaging material of this invention will now be described.

In the photothermographic material of, one of the features is that bisphenols are mainly employed as a reducing agent, as described below. It is preferable that compounds are incorporated which are capable of deactivating reducing agents upon generating active species capable of extracting hydrogen atoms from the foregoing reducing agents. Preferred compounds are those which are capable of: preventing the reducing agent from forming a phenoxy radial; or trapping the formed phenoxy radial so as to stabilize the phenoxy radial in a deactivated form to be effective as a reducing agent for silver ions. Preferred compounds having the above-mentioned properties are non-reducible compounds having a functional group capable of forming a hydrogen bonding with a hydroxyl group in a bis-phenol compound. Examples are compounds having in the molecule such as, a phosphoryl group, a sulfoxide group, a sulfonyl group, a carbonyl group, an amido group, an ester group, a urethane group, a ureido group, a tertiary amino group, or a nitrogen containing aromatic group. More preferred are compounds having a sulfonyl group, a sulfoxide group or a phosphoryl group in the molecule. Specific examples are disclosed in, JP-A Nos. 6-208192, 20001-215648, 3-50235, 2002-6444, 2002-18264. Another examples having a vinyl group are disclosed in, Japanese translated PCT Publication No. 2000-515995, JP-A Nos. 2002-207273, and 2003-140298.

Further, it is possible to simultaneously use compounds capable of oxidizing silver (metallic silver) such as compounds which release a halogen radical having oxidizing capability, or compounds which interact with silver to form a charge transfer complex. Specific examples of compounds which exhibit the aforesaid function are disclosed in JP-A Nos. 50-120328, 59-57234, 4-232939, 6-208193, and 10-197989, as well as U.S. Pat. No. 5,460,938, and JP-A No. 7-2781. Specifically, in the imaging materials according to this invention, specific examples of preferred compounds include halogen radical releasing compounds which are represented by the following formula (OFI):

$$Q_2\text{-}Y\text{—}C(X_1)(X_3)(X_2) \qquad \text{formula (OFI)}$$

wherein $Q_2$ is an aryl group or a heterocyclic group; $X_1$, $X_2$ and $X_3$ are each a hydrogen atom, a halogen atom, a haloalkyl group, an acyl group, an alkoxycarbonyl group, an aryloxycarbonyl group, a sulfonyl group, an aryl group or a heterocyclic group, provided that at least of them a halogen atom; Y is —C(═O)—, —SO— or —$SO_2$—. The aryl group represented by $Q_2$ may be a monocyclic group or condensed ring group and is preferably a monocyclic or di-cyclic aryl group having 6 to 30 carbon atoms (e.g., phenyl, naphthyl), more preferably a phenyl or naphthyl group, and still more preferably a phenyl group. The heterocyclic group represented by $Q_2$ is a 3- to 10-membered, saturated or unsaturated heterocyclic group containing at least one of N, o and S, which may be a monocyclic or condensed with another ring to a condensed ring.

The heterocyclic group is preferably a 5- or 6-membered unsaturated heterocyclic group, which may be condensed, more preferably a 5- or 6-membered aromatic heterocyclic group, which may be condensed, still more preferably a N-containing 5- or 6-membered aromatic heterocyclic group, which may be condensed, and optimally a 5- or 6-membered aromatic heterocyclic group containing one to four N atoms, which may be condensed. Exemplary examples of heterocyclic rings included in the heterocyclic group include imidazole, pyrazole, pyridine, pyrimidine, pyrazine, pyridazine, triazole, triazines, indole, indazole, purine, thiazole, oxadiazole, quinoline, phthalazine, naphthyridine, quinoxaline, quinazoline, cinnoline, pteridine, acrydine, phenanthroline, phenazine, tetrazole, thiazole, oxazole, benzimidazole, benzoxazole, benzthiazole, indolenine and tetrazaindene. Of these are preferred imidazole, pyridine, pyrimidine, pyrazine, pyridazine, triazole, triazines, thiadiazole, oxadiazole, quinoline, phthalazine, naphthylizine, quinoxaline, quinazoline, cinnoline, tetrazole, thiazole, oxazole, benzimidazole, and tetrazaindene; more preferably imidazole, pyrimidine, pyridine, pyrazine, pyridazine, triazole, triazines, thiadiazole, quinoline, phthalazine, naphthyridine, quinoxaline, quinazoline, cinnoline, tetrazole, thiazole, benzimidazole, and benzthiazole; and still more preferably pyridine, thiazole, quinoline and benzthiazole.

The aryl group or heterocyclic group represented by $Q^2$ may be substituted by a substituent, in addition to —Y—C$(X_1)(X_2)(X_3)$. Preferred examples of the substituent include an alkyl group, an alkenyl group, an aryl group, an alkoxyl group, an aryloxyl group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, phosphoramido group, a halogen atom, cyano group, sulfo group, carboxy group, nitro group and heterocyclic group. Of these are preferred an alkyl group, an aryl group, an alkoxyl group, an aryloxyl group, an acyl group, an acylamino group, an aryloxyl group, acyl group, an acylamino group, an alkoxycarbonyl group, an aryloxycarbonylamino group, a sulfonylamino group, a sulfamoyl group, a carbamoyl group, a ureido group, phosphoramido group, a halogen atom, cyano group, nitro group, and a heterocyclic group; and more preferably an alkyl group, an aryl group, an alkoxyl group, an aryloxyl group, an acyl group, an acylamino group, a sulfonylamino group, a sulfamoyl group, a carbamoyl group, a halogen group, cyano group, nitro group and a heterocyclic group; and still more preferably an alkyl group, an aryl group and a halogen atom. $X_1$, $X_2$ and $X_3$ are preferably a halogen atom, a haloalkyl group, an acyl group, an alkoxycarbonyl group, an aryloxycarbonyl group, a carbamoyl group, a sulfamoyl group, a sulfonyl group, and a heterocyclic group, more preferably a halogen atom, a haloalkyl group, an acyl group, an alkoxycarbonyl group, an aryloxycarbonyl group, and a sulfonyl group; and still more preferably a halogen atom and trihalomethyl group; and most preferably a halogen atom. Of halogen atoms are preferably chlorine atom, bromine and iodine atom, and more preferably chlorine atom and bromine atom, and still more preferably bromine atom. Y is —C(═O)—, —SO—, and —$SO_2$—, and preferably —$SO_2$—.

The addition amount of these compounds is preferably from $1\times10^{-4}$ to 1 mol, and more preferably from $1\times10^{-3}$ to $5\times10^{-2}$ mol per mol of silver.

Compounds disclosed in JP-A No. 2003-5041 can also be used similarly to the compounds represented by the foregoing formula (OFI).

Specific examples of the compounds represented by formula (OFI) are shown below but are not limited to these.

OFI-1

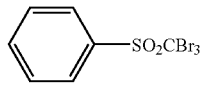

OFI-2

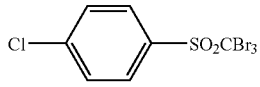

-continued
OFI-3
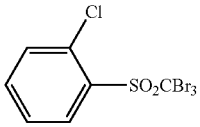
OFI-4
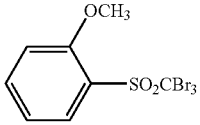
OFI-5
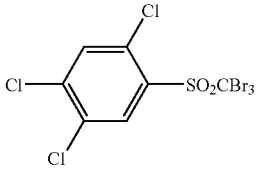
OFI-6
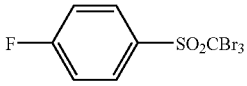
OFI-7
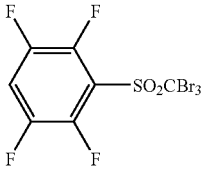
OFI-8
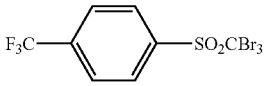
OFI-9
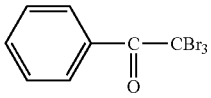
OFI-10
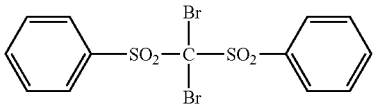
OFI-11
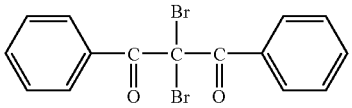
OFI-12
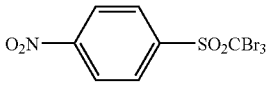
OFI-13
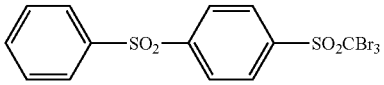
OFI-14
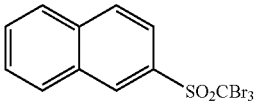
-continued
OFI-15
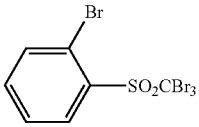
OFI-16
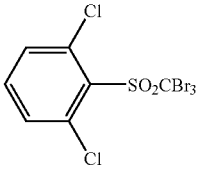
OFI-17
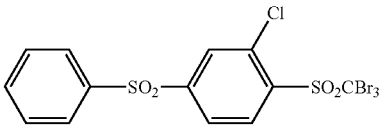
OFI-18
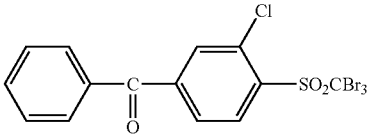
OFI-19
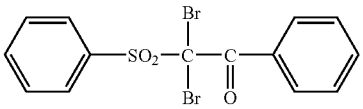
OFI-20
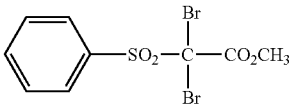
OFI-21
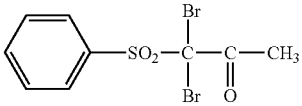
OFI-22
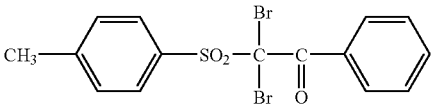
OFI-23
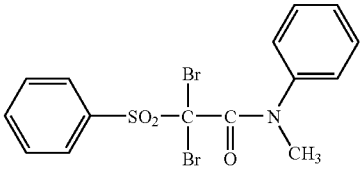
OFI-24
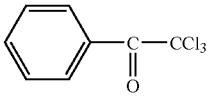
OFI-25
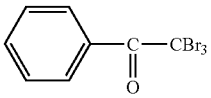
OFI-26
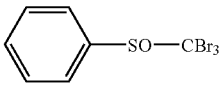

-continued
OFI-27
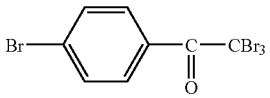
OFI-28
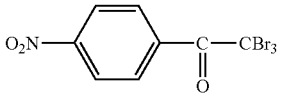
OFI-29
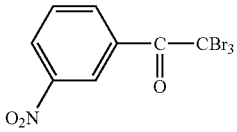
OFI-30
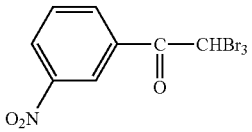
OFI-31
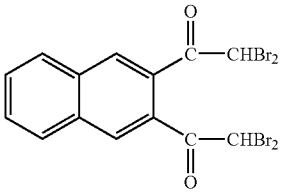
OFI-32
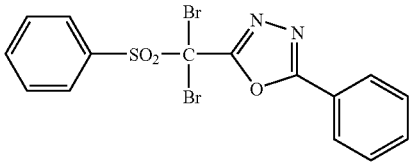
OFI-33
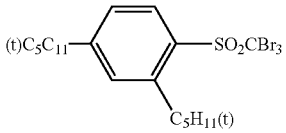
OFI-34
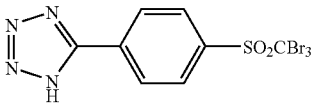
OFI-35
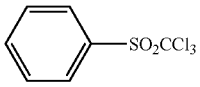
OFI-36
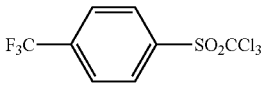
OFI-37
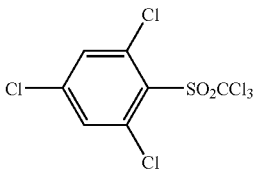
-continued
OFI-38
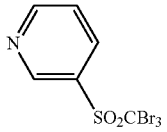
OFI-39
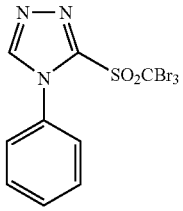
OFI-40
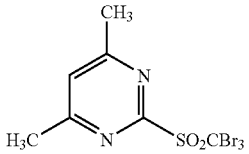
OFI-41
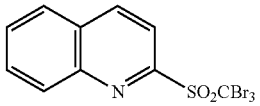
OFI-42
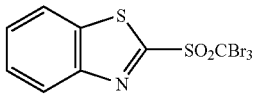
OFI-43
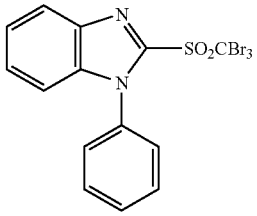
OFI-44
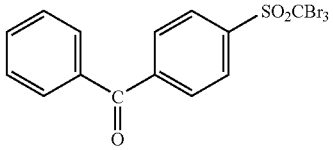
OFI-45
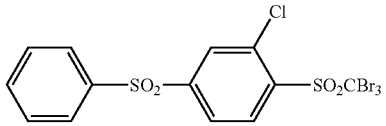
OFI-46
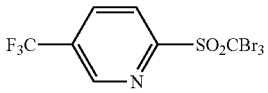
OFI-47
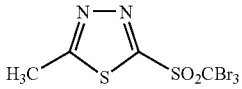
OFI-48
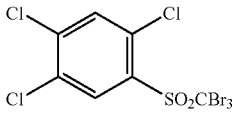

-continued

OFI-49

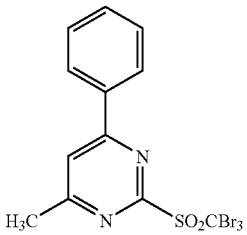

OFI-50

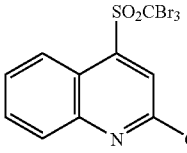

OFI-51

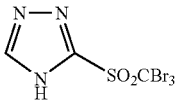

OFI-52

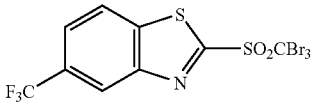

OFI-53

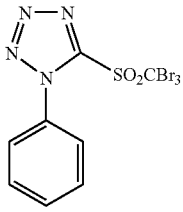

OFI-54

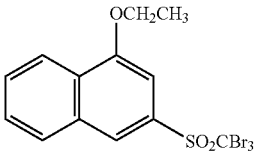

OFI-55

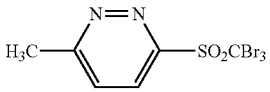

OFI-56

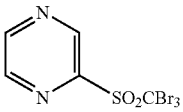

OFI-57

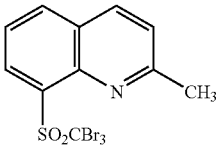

OFI-58

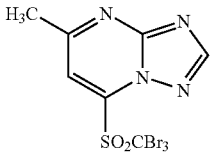

-continued

OFI-59

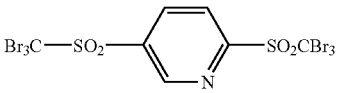

OFI-60

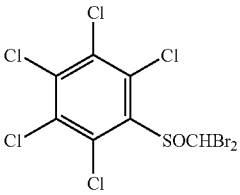

OFI-61

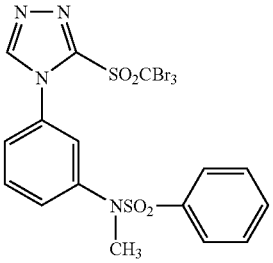

OFI-62

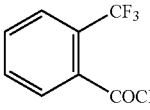

OFI-63

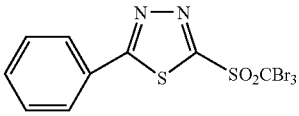

OFI-64

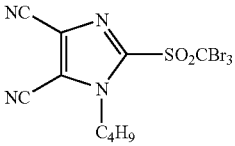

OFI-65

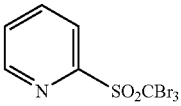

OFI-66

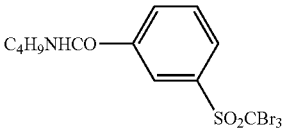

Further, in view of the capability of more stabilizing of silver images, as well as an increase in photographic speed and covering power, it is preferable to use, in the photothermographic materials according, as an image stabilizer, polymers which have at least one repeating unit of the monomer having a radical releasing group disclosed in JP-A No. 2003-91054. Specifically, in the photothermographic imaging materials according to this invention, desired results are unexpectedly obtained.

In this invention, there may be as a silver ion reducing agent (hereinafter occasionally referred simply to as a reducing agent) polyphenols described in U.S. Pat. Nos. 3,589,903 and 4,021,249, British Patent No. 1,486,148, JP-A Nos. 51-5193350-36110, 50-116023, and 52-84727, and Japanese Patent Publication No. 51-35727; bisnaphthols such as 2,2'-dihydroxy-1,1'-binaphthyl and 6,6'-dibromo-2,2'-dihydroxy-1,1'-binaphthyl described in U.S. Pat. No. 3,672,904; sulfonamidophenols and sulfonamidonaphthols such as 4-benzenesulfonamidophenol, 2-benznesulfonamidophenol, 2,6-dichloro-4-benenesulfonamidophenol, and 4-benznesulfonamidonaphthol described in U.S. Pat. No. 3,801,321.

In this invention, preferred reducing agents for silver ions are compounds represented by the following formula (RED):

formula (RED)

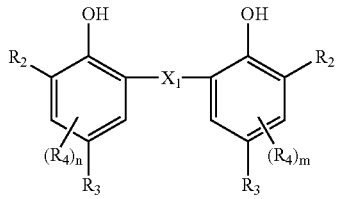

In the formula (RED), $X_1$ in Formula (RED) represents a chalcogen atom or $CHR_1$. Specifically listed as chalcogen atoms are a sulfur atom, a selenium atom, and a tellurium atom. Of these, a sulfur atom is preferred; $R_1$ in $CHR_1$ represents a hydrogen atom, a halogen atom, an alkyl group, an alkenyl group, an alkynyl group, an aryl group or a heterocyclic group. Halogen atoms include, for example, a fluorine atom, a chlorine atom, and a bromine atom. Alkyl groups are an alkyl groups having 1–20 carbon atoms and specific examples thereof include a methyl group, an ethyl group, a propyl group, a butyl group, a hexyl group, a heptyl group and a cycloalkyl group. Examples of alkenyl groups are, a vinyl group, an allyl group, a butenyl group, a hexenyl group, a hexadienyl group, an ethenyl-2-propenyl group, a 3-butenyl group, a 1-methyl-3-propenyl group, a 3-pentenyl group, a 1-methyl-3-butenyl group and a cyclohexenyl group. Examples of aryl groups are, a phenyl group and a naphthyl group. Examples of heterocyclic groups are, a thienyl group, a furyl group, an imidazolyl group, a pyrazolyl group and a pyrrolyl group. Of these, cyclic groups such as cycloalkyl groups and cycloalkenyl groups are preferred.

These groups may have a substituent. Listed as the substituents are a halogen atom (for example, a fluorine atom, a chlorine atom, or a bromine atom), a cycloalkyl group (for example, a cyclohexyl group or a cyclobutyl group), a cycloalkenyl group (for example, a 1-cycloalkenyl group or a 2-cycloalkenyl group), an alkoxy group (for example, a methoxy group, an ethoxy group, or a propoxy group), an alkylcarbonyloxy group (for example, an acetyloxy group), an alkylthio group (for example, a methylthio group or a trifluoromethylthio group), a carboxyl group, an alkylcarbonylamino group (for example, an acetylamino group), a ureido group (for example, a methylaminocarbonylamino group), an alkylsulfonylamino group (for example, a methanesulfonylamino group), an alkylsulfonyl group (for example, a methanesulfonyl group and a trifluoromethanesulfonyl group), a carbamoyl group (for example, a carbamoyl group, an N,N-dimethylcarbamoyl group, or an N-morpholinocarbonyl group), a sulfamoyl group (for example, a sulfamoyl group, an N,N-dimethylsulfamoyl group, or a morpholinosulfamoyl group), a trifluoromethyl group, a hydroxyl group, a nitro group, a cyano group, an alkylsulfonamido group (for example, a methanesulfonamido group or a butanesulfonamido group), an alkylamino group (for example, an amino group, an N,N-dimethylamino group, or an N,N-diethylamino group), a sulfo group, a phosphono group, a sulfite group, a sulfino group, an alkylsulfonylaminocarbonyl group (for example, a methanesulfonylaminocarbonyl group or an ethanesulfonylaminocarbonyl group), an alkylcarbonylaminosulfonyl group (for example, an acetamidosulfonyl group or a methoxyacetamidosulfonyl group), an alkynylaminocarbonyl group (for example, an acetamidocarbonyl group or a methoxyacetamidocarbonyl group), and an alkylsulfinylaminocarbonyl group (for example, a methanesulfinylaminocarbonyl group or an ethanesulfinylaminocarbonyl group). Further, when at least two substituents are present, they may be the same or different. Most preferred substituent is an alkyl group.

$R_2$ represents an alkyl group. The alkyl groups are preferably those having 1 to 20 carbon atoms, which may be substituted or unsubstituted. Specific examples thereof include a methyl, ethyl, i-propyl, butyl, i-butyl, t-butyl, t-pentyl, t-octyl, cyclohexyl, 1-methylcyclohexyl, or 1-methylcyclopropyl.

Substituents of the alkyl group are not particularly limited and include, for example, an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom. In addition, $(R_4)_n$ and $(R_4)_m$ may form a saturated ring. $R_2$ is preferably a secondary or tertiary alkyl group and preferably has 2–20 carbon atoms. $R_2$ is more preferably a tertiary alkyl group, is still more preferably a t-butyl group, a t-pentyl group, or a methylcyclohexyl group, and is most preferably a t-butyl group.

$R_3$ represents a hydrogen atom or a group capable of being substituted to a benzene ring. Listed as groups capable of being substituted to a benzene ring are, for example, a halogen atom such as fluorine, chlorine, or bromine, an alkyl group, an aryl group, a cycloalkyl group, an alkenyl group, a cycloalkenyl group, an alkynyl group, an amino group, an acyl group, an acyloxy group, an acylamino group, a sulfonylamino group, a sulfamoyl group, a carbamoyl group, an alkylthio group, a sulfonyl group, an alkylsulfonyl group, a sulfonyl group, a cyano group, and a heterocyclic group.

$R_3$ is preferably methyl, ethyl, i-propyl, t-butyl, cyclohexyl, 1-methylcyclohexyl, or 2-hydroxyethyl. Of these, 2-hydroxyethyl is more preferred.

These groups may further have a substituent. There may be employed as such substituents those listed in aforesaid $R_1$.

Further, $R_3$ is more preferably an alkyl group having 1 to 10 carbon atoms. Specifically listed is the hydroxyl group disclosed in Japanese Patent Application No. 2002-120842, or an alkyl group, such as a 2-hydroxyethyl group, which has as a substituent a group capable of forming a hydroxyl group while being de-protected. In order to achieve high maximum density (Dmax) at a definite silver coverage, namely to result in silver image density of high covering power (CP), the sole use or the use in combination with other kinds of reducing agents is preferred.

The most preferred combination of $R_2$ and $R_3$ is that $R_2$ is a tertiary alkyl group (t-butyl, or 1-methylcyclohexyl) and $R_3$ is an alkyl group, such as a 2-hydoxyethyl group, which has, as a substituent, a hydroxyl group or a group capable of forming a hydroxyl group while being deprotected. Incidentally, a plurality of $R_2$ and $R_3$ is may be the same or different.

$R_4$ represents a group capable of being substituted on a benzene ring. Specific examples include an alkyl group having 1 to 25 carbon-atoms (e.g., methyl, ethyl, propyl, i-propyl, t-butyl, pentyl, hexyl, or cyclohexyl), a halogenated alkyl group (e.g., trifluoromethyl or perfluorooctyl), a cycloalkyl group (e.g., cyclohexyl or cyclopentyl); an alkynyl group (e.g., propargyl), a glycidyl group, an acrylate group, a methacrylate group, an aryl group (e.g., phenyl), a heterocyclic group (e.g., pyridyl, thiazolyl, oxazolyl, imidazolyl, furyl, pyrrolyl, pyradinyl, pyrimidyl, pyridadinyl, selenazolyl, piperidinyl, sulforanyl, piperidinyl, pyrazolyl, or tetrazolyl), a halogen atom (e.g., chlorine, bromine, iodine or fluorine), an alkoxy group (e.g., methoxy, ethoxy, propyloxy, pentyloxy, cyclopentyloxy, hexyloxy, or cyclohexyloxy), an aryloxy group (e.g., phenoxy), an alkoxycarbonyl group (e.g., methyloxycarbonyl, ethyloxycarbonyl, or butyloxycarbonyl), an aryloxycarbonyl group (e.g., phenyloxycarbonyl), a sulfonamido group (e.g., methanesulfonamido, ethanesulfonamido, butanesulfonamido, hexanesulfonamido, cyclohexabesulfonamido, benzenesulfonamido), sulfamoyl group (e.g., aminosulfonyl, methyaminosulfonyl, dimethylaminosulfonyl, butylaminosulfonyl, hexylaminosulfonyl, cyclohexylaminosufonyl, phenylaminosulfonyl, or 2-pyridylaminosulfonyl), a urethane group (e.g., methylureido, ethylureido, pentylureido, cyclopentylureido, phenylureido, or 2-pyridylureido), an acyl group (e.g., acetyl, propionyl, butanoyl, hexanoyl, cyclohexanoyl, benzoyl, or pyridinoyl), a carbamoyl group (e.g., aminocarbonyl, methylaminocarbonyl, dimethylaminocarbonyl, propylaminocarbonyl, a pentylaminocarbonyl group, cyclohexylaminocarbonyl, phenylaminocarbonyl, or 2-pyridylaminocarbonyl), an amido group (e.g., acetamide, propionamide, butaneamide, hexaneamide, or benzamide), a sulfonyl group (e.g., methylsulfonyl, ethylsulfonyl, butylsulfonyl, cyclohexylsulfonyl, phenylsulfonyl, or 2-pyridylsulfonyl), an amino group (e.g., amino, ethylamino, dimethylamino, butylamino, cyclopentylamino, anilino, or 2-pyridylamino), a cyano group, a nitro group, a sulfo group, a carboxyl group, a hydroxyl group, and an oxamoyl group. Further, these groups may further be substituted with these groups. Each of n and m represents an integer of from 0 to 2. However, the most preferred case is that both n and m are 0. Plural $R^4S$ may be the same or different.

Further, $R_4$ may form a saturated ring together with $R_2$ and $R_3$. $R_4$ is preferably a hydrogen atom, a halogen atom, or an alkyl group, and is more preferably a hydrogen atom.

Specific examples of the compounds represented by formula (RED) are shown below but are not limited these.

(RED-1)

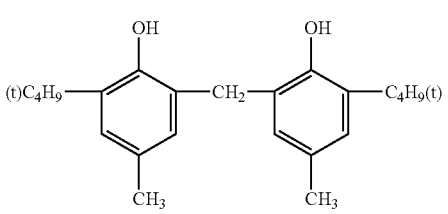

-continued (RED-2)

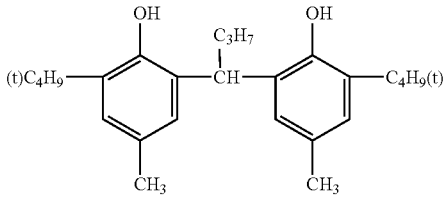

(RED-3)

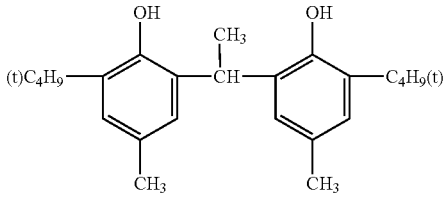

(RED-4)

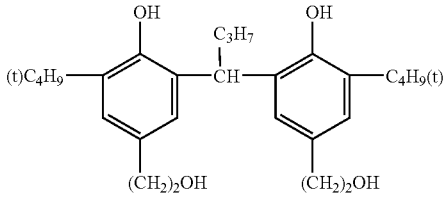

(RED-5)

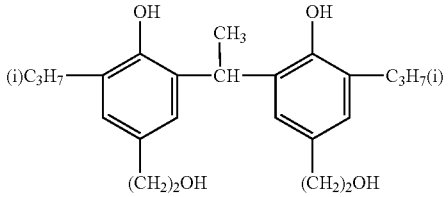

(RED-6)

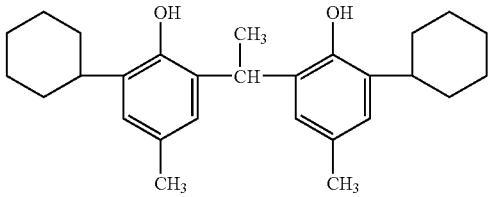

(RED-7)

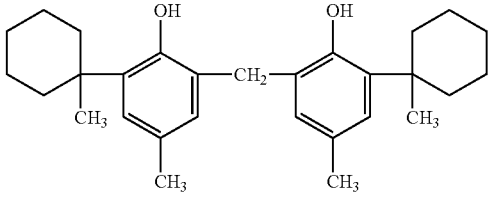

(RED-8)

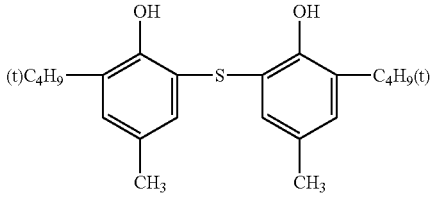

-continued
(RED-9)
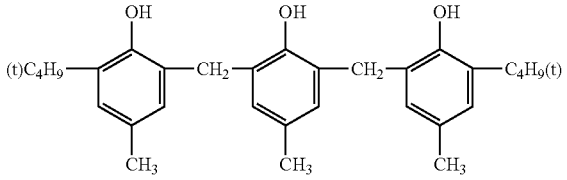
(RED-10)
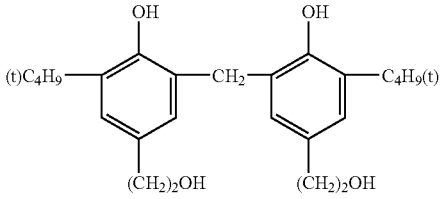
(RED-11)
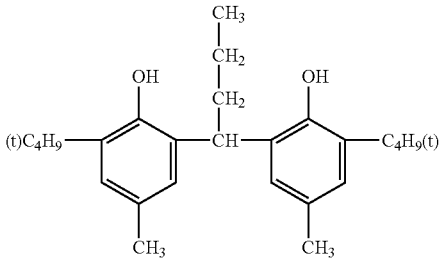
(RED-12)
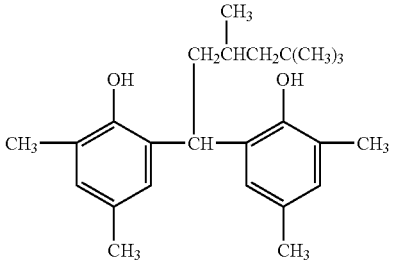
(RED-13)
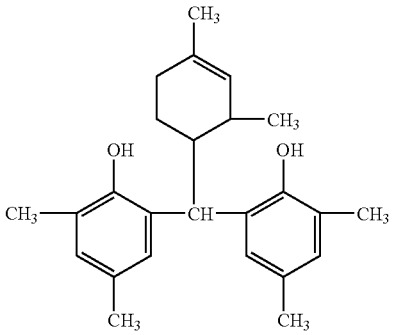
(RED-14)
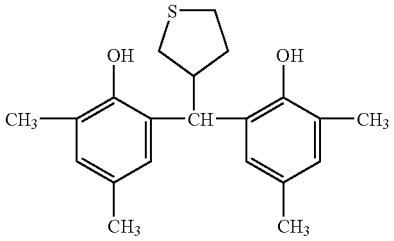
-continued
(RED-15)
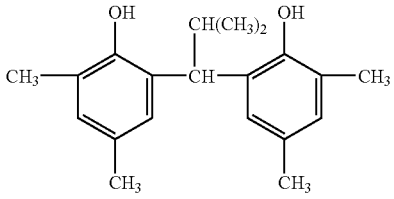
(RED-16)
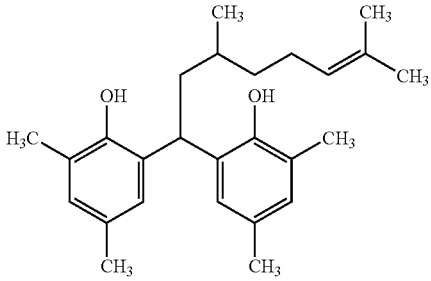
(RED-17)
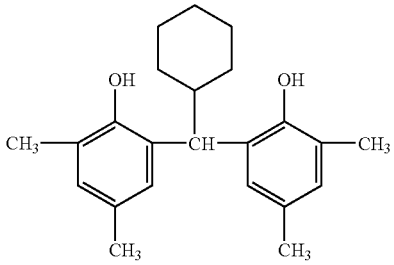
(RED-18)
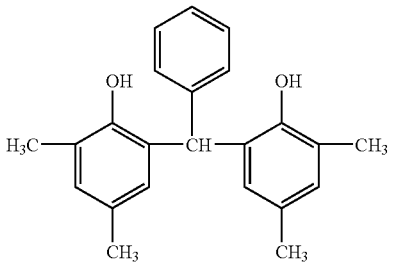
(RED-19)
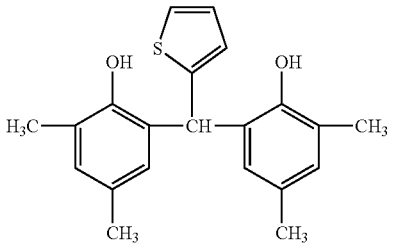

-continued (RED-20)

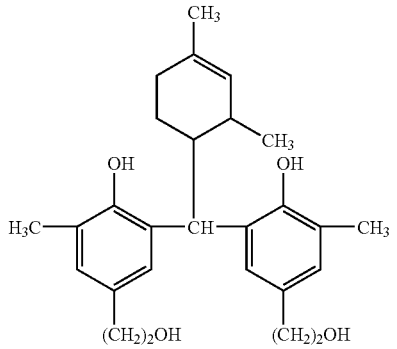

(RED-21)

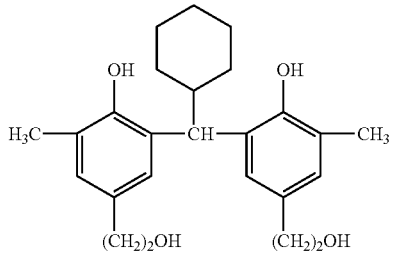

These compounds (bisphenol compounds) represented by formula (RED) can be readily synthesized employing conventional methods known in the art (for example, Japanese Patent Application No. 2002-147562).

The amount of silver ion reducing agents employed in the photothermographic dry imaging materials of this invention varies depending on the types of organic silver salts, reducing agents and other additives. However, the aforesaid amount is customarily from 0.05 to 10 mol per mol of organic silver salts, and is preferably from 0.1 to 3 mol. Further, in the aforesaid range, silver ion reducing agents of this invention may be employed in combinations of at least two types. Namely, in view of achieving images exhibiting excellent storage stability, high image quality and high CP, it is preferable to simultaneously use reducing agents which differ in reactivity, due to a different chemical structure.

In this invention, preferred cases occasionally occur in which the aforesaid reducing agents are added, just prior to coating, to a photosensitive emulsion comprised of photosensitive silver halide, organic silver salt particles, and solvents and the resulting mixture is coated to minimize variations of photographic performance due to the standing time.

Further, hydrazine derivatives and phenol derivatives represented by general formulas (1) to (4) described in JP-A No. 2003-43614, and general formulas (1) to (3) described in JP-A 2003-66559 are preferably employed as a development accelerator which are simultaneously employed with the aforesaid reducing agents.

The oxidation potential of development accelerators employed in the silver salt photothermographic materials of this invention, which is determined by polarographic measurement, is preferably lower 0.01 to 0.4 V, and is more preferably lower 0.01 to 0.3 V than that of the compounds represented by Formula (RED). Incidentally, the oxidation potential of the aforesaid development accelerators is preferably 0.2 to 0.6 V, which is polarographically determined in a solvent mixture of tetrahydrofuran:Britton Robinson buffer solution=3:2 the pH of which is adjusted to 6 employing an SCE counter electrode, and is more preferably 0.3 to 0.55 V. Further, the pKa value in a solvent mixture of tetrahydrofuran:water=3:1 is preferably 3 to 12, and is more preferably 5 to 10. It is particularly preferable that the oxidation potential which is polarographically determined in the solvent mixture of tetrahydrofuran:Britton Robinson buffer solution=3:2, the pH of which is adjusted to 6, employing an SCE counter electrode is 0.3 to 0.55, and the pKa value in the solvent mixture of tetrahydrofuran:water=3:2 is 5 to 10.

Further there may be employed, as silver ion reducing agents, various types of reducing agents disclosed in European Patent No. 1,278,101 and JP-A No. 2003-15252.

The amount of silver ion reducing agents employed in the photothermographic imaging materials of this invention varies depending on the types of organic silver salts, reducing agents, and other additives. However, the aforesaid amount is preferably from 0.05 to 10 mol and more preferably from 0.1 to 3 mol per mol of organic silver salts. Further, in this amount range, silver ion reducing agents of this invention may be employed in combinations of at least two types. Namely, in view of achieving images exhibiting excellent storage stability, high image quality, and high covering power, it is preferable to simultaneously employ reducing agents differing in reactivity due to different chemical structure.

The photothermographic material relating to this invention preferably contains a compounds represented by the following formula (ST):

$$Z\text{-}SO_2.S\text{-}M \qquad \text{formula (ST)}$$

wherein Z is a substituted or unsubstituted alkyl, aryl, heterocyclic ring, or aromatic ring group; and M is a metal atom or an organic cation.

In the compounds represented by the foregoing formula (ST), the alkyl group, aryl group, heterocyclic group, aromatic ring and heterocyclic ring, which are represented by Z may be substituted. Listed as the substituents may be, for example, a lower alkyl group such as a methyl group or an ethyl group, an aryl group such as a phenyl group, an alkoxyl group having 1 to 8 carbon atoms, a halogen atom such as chlorine, a nitro group, an amino group, or a carboxyl group. Metal atoms represented by M are alkaline metals such as a sodium ion or a potassium ion, while an ammonium ion or a guanidine group are preferred as the organic cation.

In this invention, antifoggants described in Japanese Patent Application No. 2003-199555, represented by the following formula (CV):

formula (CV)

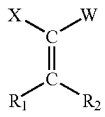

wherein, X represents an electron-withdrawing group; W represents a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, a N-sulfonylimino group, an ammonium group, a sulfonium group, a phosphonium group, a pyrylium group or an immonium group; $R_1$ represents a hydroxyl group or a salt thereof; and $R_2$ represents an alkyl group, an alkenyl group, an alkynyl group, an aryl group or a heterocyclic group, provided that X and W may form a ring structure by bonding to each other, X and $R_1$ may be a cis-form or a trans-form.

An electron-withdrawing group represented by X is a substituent, Hammett's constant "σp" of which is positive. Specific example thereof include substituted alkyl groups (such as halogen-substituted alkyl), substituted alkenyl groups (such as cyanovinyl), substituted and non-substituted alkynyl groups (such as trifluoroacetylenyl, cyanoacetylenyl and formylacetylenyl), substituted aryl groups (such as cyanophenyl), substituted and non-substituted heterocyclic groups (pyridyl, triazinyl and benzooxazolyl), a halogen atom, a cyano group, acyl groups (such as acetyl, trifluoroacetyl and formyl), thioacyl groups (such as thioformyl and thioacetyl), oxalyl groups (such as methyloxalyl), oxyoxalyl groups (such as ethoxalyl), —S-oxalyl groups (such as ethylthiooxalyl), oxamoyl groups (such as methyloxamoyl), oxycarbonyl groups (such as ethoxycarbonyl and carboxyl), —S-carbonyl groups (such as ethylthiocarbonyl), a carbamoyl group, a thiocarbamoyl group, a sulfonyl group, a sulfinyl group, oxysulfonyl groups (such as ethoxysulfonyl), —S-sulfonyl groups (such as ethylthiosulfonyl), a sulfamoyl group, oxysulfinyl groups (such as methoxysulfinyl), —S-sulfinyl groups (such as methylthiosulfinyl), a sulfinamoyl group, a phosphoryl group, a nitro group, imino groups (such as imino, N-methylimino, N-phenylimino, N-pyridylimino, N-cyanoimino and N-nitroimino), N-carbonylimino groups (such as N-acetylimino, N-ethoxycarbonylimino, N-ethoxalylimino, N-formylimino, N-trifluoroacetylimino and N-carbamoylimino), N-sulfonylimino groups (such as N-methanesulfonylimino, N-trifluoromethanesulfonylimino, N-methoxysulfonylimino and N-sulfamoylimino), an ammonium group, a sulfonium group, a phosphonium group, a pyrylium group or an immonium group, and also listed are heterocyclic groups in which rings are formed by such as an ammonium group, a sulfonium group, a phosphonium group and an immonium group. Provided that X does not represent a formyl group. The σp value is preferably not less than 0.2 and more preferably not less than 0.3.

W includes a hydrogen atom, alkyl groups (such as methyl, ethyl and trifluoromethyl), alkenyl groups (such as vinyl, halogen substituted vinyl and cyano vinyl), alkynyl groups (such as acetylenyl and cyanoacetylenyl), aryl groups (such as phenyl, chlorophenyl, nitrophenyl, cyanophenyl and pentafluorophenyl), a heterocyclic group (such as pyridyl, pyrimidyl, pyrazinyl, quinoxalinyl, triazinyl, succineimido, tetrazonyl, triazolyl, imidazolyl and benzooxazolyl), in addition to these, also include those explained in aforesaid X such as a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, N-sulfonylimino group, an ammonium group, a sulfonium group, a phosphonium group, a pyrilium group and an immonium group. Provided that W does not represent a formyl group. Preferable as W are also aryl groups and heterocyclic groups as described above, in addition to electron-withdrawing groups having a positive Hammett's substituent constant σp, except a formyl group. X and W may form a ring structure by bonding to each other. Rings formed by X and W include a saturated or unsaturated carbon ring or heterocyclic ring, which may be provided with a condensed ring, and also a cyclic ketone. Heterocyclic rings are preferably those having at least one atom among N, O, and S and more preferably those containing one or two of said atoms.

$R_1$ includes a hydroxyl group or organic or inorganic salts of the hydroxyl group. Specific examples of alkyl groups, alkenyl groups, alkynyl groups, aryl groups and heterocyclic groups represented by $R_2$ include each example of alkyl groups, alkenyl groups, alkynyl groups, aryl groups and heterocyclic groups exemplified as W.

Further, any of X, W and $R_2$ may contain a ballast group. A ballast group means a so-called ballasted group in such as a photographic coupler, which makes the added compound one having a bulky molecular weight not to migrate in a coated film of a light-sensitive material.

Further, X, W and $R_2$ may contain a group enhancing adsorption to a silver salt. Groups enhancing adsorption to a silver salt include a thioamido group, an aliphatic mercapto group, an aromatic mercapto group, a heterocyclic mercapto group, and each group represented by 5- or 6-membered nitrogen-containing heterocyclic rings such as benzotriazole, triazole, tetrazole, indazole, benzimidazole, imidazole, benzothiazole, thiazole, benzoxazole, oxazole, thiadiazole, oxadiazole and triazine. In this invention, it is preferred that at least one of X and W represents a cyano group, or X and W form a cyclic structure by bonding to each other. Further, in this invention, preferable are compounds in which a thioether group (—S—) is contained in the substituents represented by X, W and $R_2$.

Further, preferable are those in which at least one of X and W is provided with an alkene group represented by following formula (CV1):

$$—C(R)=C(Y)(Z) \qquad \text{formula (CV1)}$$

wherein R represents a hydrogen atom or a substituent, Y and Z each represent a hydrogen atom or a substituent, however, at least one of Y and Z represents an electron-withdrawing group.

Examples of electron-withdrawing groups among the substituents represented by Y and Z include the aforesaid electron-withdrawing groups listed as X and W, such as a cyano group and a formyl group.

X and W represented by above Formula (CV1) include, for example, the following groups:

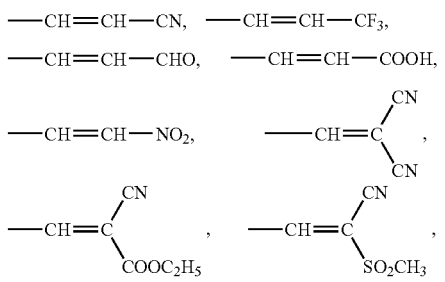

-continued

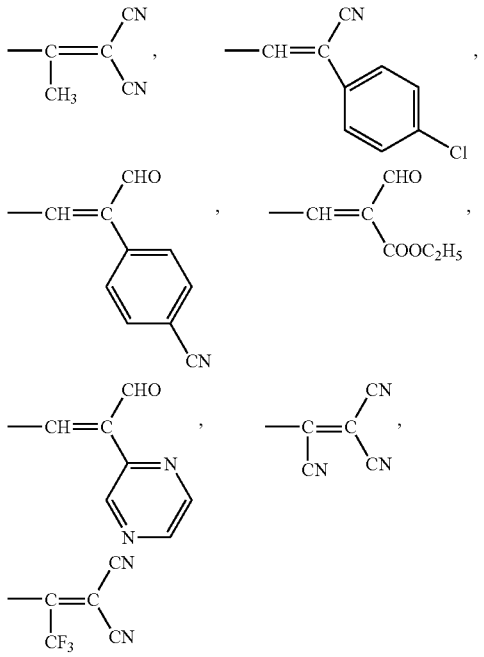

Further, preferable are those in which at least one of X and W is provided with alkynyl groups described below.

—C≡C—$R_5$

R represents a hydrogen atom or a substituent, and the substituent is preferably an electron-withdrawing group such as those listed in the aforesaid X and W. X and W represented by the above Formula (CV1) include the following groups.

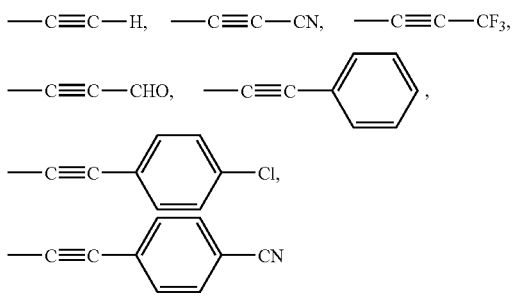

Further, at least one of X and W is preferably provided with an acyl group selected from a substituted alkylcarbonyl group, alkenylcarbonyl group and alkynylcarbonyl group, and X and W, for example, include the following groups.

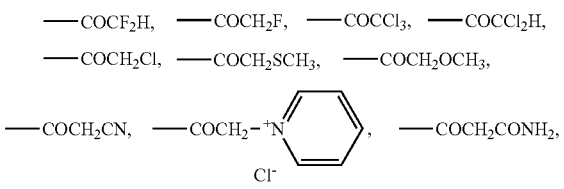

-continued

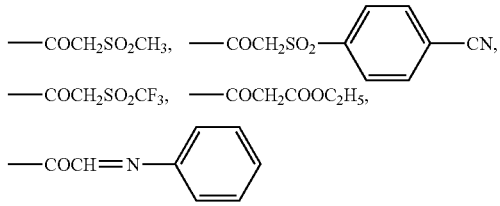

Further, at least one of X and W is preferably provided with an oxalyl group, and X and W provided with an oxalyl group include the following:

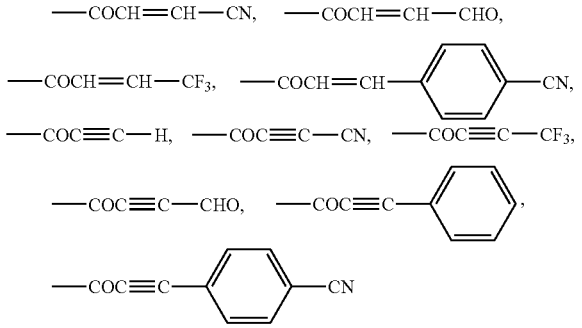

—$COCOCH_3$, —$COCOOC_2H_5$, —$COCONHCH_3$, —$COCOSC_2H_5$ and $COCOOC_2H_4SCH_3$.

Further, at least one of X and W is also preferably provided with an aryl group or a nitrogen containing heterocyclic group substituted by an electron-withdrawing group, and such X and W, for example, include the following groups.

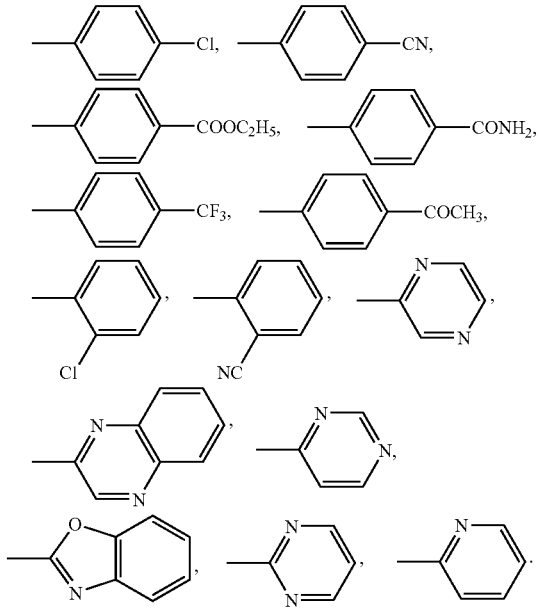

In this invention, alkene compounds represented by Formula (CV) include every isomers when they can take isomeric structures with respect to a double bond, where X, W, $R_1$ and $R_2$ substitute, and also include every isomers when They can take tautomeric structures such as a keto-enol form.

The compound represented by the formula (CV) is incorporated at least in one of a light-sensitive layer and light-insensitive layers on said light-sensitive layer side, of a thermally developable light-sensitive material, and preferably at least in a light-sensitive layer. The addition amount of compounds represented by Formula (1) is preferably from $1\times10^{-8}$ to 1 mol/Ag mol, more preferably from $1\times10^{-6}$ to $1\times10^{-1}$ mol/Ag mol and most preferably from $1\times10^{-4}$ to $1\times10^{-2}$ mol/Ag mol.

The compound represented by the formula (CV) can be added in a light-sensitive layer or a light-insensitive layer according to commonly known methods. That is, they can be added in light-sensitive layer or light-insensitive layer coating solution by being dissolved in alcohols such as methanol and ethanol, ketones such as methyl ethyl ketone and acetone, and polar solvents such as dimethylsulfoxide and dimethylformamide. Further, they can be added also by being made into fine-particles of not more than 1 μm followed by being dispersed in water or in an organic solvent. As for fine-particle dispersion techniques, many techniques have been disclosed and the compound can be dispersed according to these techniques.

A light-sensitive layer or a light-insensitive layer of the photothermographic material may contains silver saving agents.

The silver saving agents, used in this invention, refer to compounds capable of reducing the silver amount to obtain a given silver image density. Although various mechanisms may be considered to explain functions regarding a decrease in the silver amount, compounds having functions to enhance covering power of developed silver are preferable. The covering power of developed silver, as described herein, refers to optical density per unit amount of silver. These silver saving agents may be incorporated in either a photosensitive layer or a light-insensitive layer or in both such layers.

Preferred silver saving agents are hydrazine derivatives represented by formula (H) described below, vinyl compounds represented by formula (G) described below, and quaternary onium compounds represented by formula (P) described below:

formula (H)

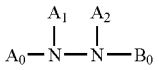

formula (G)

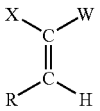

Formula (P)

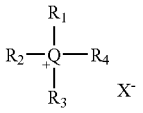

In the foregoing formula (H), $A_0$ represents an aliphatic group, an aromatic group, a heterocyclic group, or a $-G_0-D_0$ group, each of which may have a substituent; $B_0$ represents a blocking group; and $A_1$ and $A_2$ each represents a hydrogen atom, or one of them represents a hydrogen atom and the other one represents an acyl group, a sulfonyl group, or a oxalyl group. Herein, $G_0$ represents a —CO— group, a —COCO— group, a —CS— group, a —C(═N$G_1D_1$)— group, a —SO— group, a —$SO_2$— group, or a —P(O)($G_1D_1$)— group, wherein $G_1$ represents a simple bonding atom or a group such as an —O— group, a —S-group, or an —N($D_1$)— group, wherein $D_1$ represents an aliphatic group, an aromatic group, a heterocyclic group, or a hydrogen atom; when there are plural $D_1$s in the molecule, those may be the same or different; and $D_0$ represents a hydrogen atom, an aliphatic group, an aromatic group, a heterocyclic group, an amino group, an alkoxy group, an aryloxy group, an alkylthio group, or an arylthio group. Listed as preferred $D_0$ are a hydrogen atom, an alkyl group, an alkoxy group, and an amino group.

In the foregoing formula (H), the aliphatic group represented by $A_0$ is preferably a straight chain, branched, or cyclic alkyl group having from 1 to 30 carbon atoms and more preferably from 1 to 20 carbon atoms. Listed as the alkyl groups are, for example, a methyl group, an ethyl group, a t-butyl group, an octyl group, a cyclohexyl group, and a benzyl group. The groups may be substituted with a suitable substituent (for example, an aryl group, an alkoxy group, an aryloxy group, an alkylthio group, an arylthio group, a sulfoxyl group, a sulfonamido group, a sulfamoyl group, an acylamino group, and a ureido group).

In Formula (H), the aromatic group represented by $A_0$ is preferably a monocyclic or condensed aryl group. Examples thereof include a benzene ring or a naphthalene ring. Preferably listed as heterocyclic groups represented by $A_0$ are those containing at least one heteroatom selected from nitrogen, sulfur and oxygen atoms. Examples include a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring, and a furan ring. The aromatic ring, heterocyclic group, and $-G_0-D_0$ group may each have a substituent. Particularly preferred as $A_0$ are an aryl group and a $-G_0-D_0-$ group.

Further, in the foregoing formula (H), $A_0$ preferably contains at least one of a non-diffusive groups or a adsorption group onto silver halide. Non-diffusive groups are preferably ballast groups which are commonly employed for immobilized photographic additives such as couplers. Ballast groups include, for example, an alkyl group, an alkenyl group, an alkynyl group, an alkoxy group, a phenyl group, a phenoxy group, and an alkylphenoxy group, which are photographically inactive. The total number of carbon atoms of the portion of the substituent is preferably at least 8.

In the formula (H), Examples of an adsorption group onto silver halide include a thiourea group, a thiourethane group, a mercapto group, a thioether group, a thione group, a heterocyclic group, a thioamido heterocyclic group, a mercapto heterocyclic group, or the adsorption groups described in JP-A No. 64-90439.

In the formula (H), $B_0$ represents a blocking group, and preferably represents $-G_0-D_0$ group, wherein $G_0$ represents a —CO— group, a —COCO— group, a —CS— group, a —C(═N$G_1D_1$)- group, an —SO— group, an —$SO_2$— group, or a —P(O) ($G_1D_1$) group. Examples of preferred $G_0$ include a —CO— group and a —COCO— group. $G_1$ represents a simple bonding atom or group such as an —O— atom, an —S— atom or an —N($D_1$)- group, wherein $D_1$ represents an aliphatic group, an aromatic group, a heterocyclic group, or a hydrogen atom, and when there is a plurality of $D_1$ in a molecule, they may be the same or different. $D_0$ represents a hydrogen atom, an aliphatic group, an aromatic group, a heterocyclic group, an amino group, an alkoxy group, an aryloxy group, an alkylthio group, and an arylthio group. Listed as preferred $D_0$ are a hydrogen atom, an alkyl group, an alkoxy group, or an amino group. $A_1$ and $A_2$, each represents a hydrogen atom, or when one represents a hydrogen atom, the other represents an acyl group (such as an acetyl group, a trifluoroacetyl group, and a benzoyl group), a sulfonyl group (such as a methanesulfonyl group and a toluenesulfonyl group), or an oxalyl group (such as an ethoxalyl group).

The compounds represented by the forgoing formula (H) can be easily synthesized employing methods known in the art. They can be synthesized with reference to, for example, U.S. Pat. Nos. 5,464,738 and 5,496,695.

Other preferred hydrazine derivatives include Compounds H-1 through H-29 described in columns 11 through 20 of U.S. Pat. No. 5,545,505, and Compounds 1 through 12 in columns 9 through 11 of U.S. Pat. No. 5,464,738. The hydrazine derivatives can be synthesized employing methods known in the art.

In Formula (G), X as well as R is illustrated utilizing a cis-form, while X and R include a trans-form. This is applied to the structure illustration of specific compounds.

In the foregoing formula (G), X represents an electron-withdrawing group, while W represents a hydrogen atom, an alkyl group, an alkenyl group, an alkynyl group, an aryl group, a heterocyclic group, a halogen atom, an acyl group, a thioacyl group, an oxalyl group, an oxyoxalyl group, a thioxyalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfamoyl group, a phosphoryl group, a nitro group, an imino group, an N-carbonylimino group, an N-sulfonylimino group, a dicyanoethylene group, an ammonium group, a sulfonium group, a phosphonium group, a pyrylium group, and an immonium group.

R represents a halogen atom, a hydroxyl group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, a hydroxyl group, an organic or inorganic salt (for example, a sodium salt, a potassium salt, and a silver salt) of a mercapto group, an amino group, an alkylamino group, a cyclic amino group (for example, a pyrrolidino group), an acylamino group, an oxycarbonylamino group, a heterocyclic group (a nitrogen-containing 5- or 6-membered heterocyclic ring such as a benztriazolyl group, an imidazolyl group, a triazolyl group, and a tetrazolyl group), a ureido group, and a sulfonamido group. X and W may be joined together to form a ring structure, while X and R may also be joined together in the same manner. Listed as rings which are formed by X and W are, for example, pyrazolone, pyrazolidinone, cyclopentanedione, β-ketolactone, β-ketolactum.

In the formula (G), the electron-withdrawing group represented by X refers to the substituent of which substituent constant σp is able to take a positive value. Specifically, included are a substituted alkyl group (such as a halogen-substituted alkyl group), a substituted alkenyl group (such as a cyanovinyl group), a substituted or unsubstituted alkynyl group (such as a trifluoromethylacetylenyl group and a cyanoacetylenyl group), a substituted aryl group (such as a cyanophenyl group), a substituted or unsubstituted heterocyclic group (such as a pyridyl group, a triazinyl group, or a benzoxazolyl group), a halogen atom, a cyano group, an acyl group (such as an acetyl group, a trifluoroacetyl group, and a formyl group), a thioacetyl group (such as a thioacetyl group and a thioformyl group), an oxalyl group (such as a methyloxalyl group), an oxyoxalyl group (such as an ethoxyoxalyl group), a thiooxyalyl group (such as an ethylthiooxyalyl group), an oxamoyl group (such as a methyloxamoyl group), an oxycarbonyl group (such as an ethoxycarbonyl group), a carboxyl group, a thiocarbonyl group (such as an ethylthiocarbonyl group), a carbamoyl group, a thiocarbamoyl group, a sulfonyl group, a sulfinyl group, an oxysulfonyl group (such as an ethoxysulfonyl group), a thiosulfonyl group (such as an ethylthiosulfonyl group), a sulfamoyl group, an oxysulfinyl group (such as a methoxysulfinyl group), a thiosulfinyl group (such as a methylthiosulfinyl group), a sulfinamoyl group, a phosphoryl group, a nitro group, an imino group, an N-carbonylimino group (such as an N-acetylimino group), an N-sulfonylimino group (such as an N-methanesulfonylimino group), a dicyanoethylene group, an ammonium group, a sulfonium group, a phosphonium group, a pyrylium group, and an immonium group. However, also included are heterocyclic rings which are formed employing an ammonium group, a sulfonium group, a phosphonium group, or an immonium group. Substituents having a σp value of at least 0.30 are particularly preferred.

Alkyl groups represented by W include a methyl group, an ethyl group, and a trifluoromethyl group; alkenyl groups represented by W include a vinyl group, a halogen-substituted vinyl group, and a cyanovinyl group; aryl groups represented by W include a nitrophenol group, a cyanophenyl group, and a pentafluorophenyl group; heterocyclic groups represented by W include a pyridyl group, a triazinyl group, a succinimido group, a tetrazolyl group, an imidazolyl group, and a benzoxyazolyl group. Preferred as W are electron-withdrawing groups having a positive σp value, and more preferred are those having a σp value of at least 0.30.

Of the above-described substituents of R, a hydroxyl group, a mercapto group, an alkoxy group, an alkylthio group, a halogen atom, an organic or inorganic salt of a hydroxyl group or a mercapto group, and a heterocyclic group are preferred and a hydroxyl group, and an organic or inorganic salt of a hydroxyl group and a mercapto group are more preferred.

Further, of the aforesaid substituents of X and W, preferred are those having an thioether bond in the substituent.

In the formula (P), Q represents a nitrogen atom or a phosphorus atom; $R_1$, $R_2$, $R_3$, and $R_4$, each represent a hydrogen atom or a substituents; and $X^-$ represents an anion. Incidentally, $R_1$ through $R_4$ may be joined together to form a ring.

The substituents represented by $R_1$ through $R_4$ include, for example, an alkyl group (such as a methyl group, an ethyl group, a propyl group, a butyl group, a hexyl group, and a cyclohexyl group), an alkenyl group (such as an allyl group and a butenyl group), an alkynyl group (such as a propargyl group and a butynyl group), an aryl group (such as a phenyl group and a naphthyl group)., a heterocyclic group (such as a piperidinyl group, a piperazinyl group, a morpholinyl group, a pyridyl group, a furyl group, a thienyl group, a tetrahydrofuryl group, a tetrahydrothienyl group, and a sulforanyl group), and an amino group. Examples of a ring which is formed by joining $R_1$ through $R_4$ are a piperidine ring, a morpholine ring, a piperazine ring, quinuclidine ring, a pyridine ring, a pyrrole ring, an imidazole ring, a triazole ring, and a tetrazole ring. Groups represented by $R_1$ through $R_4$ may have a substituent such as a hydroxyl group, an alkoxy group, an aryloxy group, a carboxyl group, a sulfo group, an alkyl group, and an aryl group. $R_1$, $R_2$, $R_3$, and $R_4$ each is preferably a hydrogen atom or an alkyl group.

Anions represented by $X^-$ include inorganic or organic anions such as a halogen ion, a sulfate ion, a nitrate ion, an acetate ion, and a p-toluenesulfonate ion.

The aforesaid quaternary onium compounds can easily be synthesized employing methods known in the art. For instance, the aforesaid tetrazolium compounds can be synthesized based on the method described in Chemical Reviews Vol. 55. pages 335 through 483. The added amount of the aforesaid silver saving agents is commonly from $10^{-5}$ to 1 mol with respect to mol of aliphatic carboxylic acid silver salts, and is preferably from $10^{-4}$ to $5\times10^{-1}$ mol.

In this invention, it is preferable that at least one of silver saving agents is a silane compound.

The silane compounds employed as a silver saving agent in this invention are preferably alkoxysilane compounds having at least two primary or secondary amino groups or salts thereof, as described in Japanese Patent Application No. 2003-5324.

When alkoxysilane compounds or their salts, or Schiff bases are incorporated in the image forming layer as a silver saving agent, the added amount of these compound is preferably in the range of 0.00001 to 0.05 mol per mol of silver. Further, both of alkoxysilane compounds or salt thereof and Schiff bases are added, the added amount is in the same range as above.

Suitable binders for the silver salt photothermographic material are to be transparent or translucent and commonly colorless, and include natural polymers, synthetic resin polymers and copolymers, as well as media to form film. The binders include, for example, gelatin, gum Arabic, casein, starch, poly(acrylic acid), poly(methacrylic acid), poly(vinyl chloride), poly(methacrylic acid), copoly(styrene-maleic anhydride), coply(styrene-acrylonitrile), coply (styrene-butadiene), poly(vinyl acetals) (for example, poly (vinyl formal) and poly(vinyl butyral), poly(esters), poly (urethanes), phenoxy resins, poly(vinylidene chloride), poly (epoxides), poly(carbonates), poly(vinyl acetate), cellulose esters, poly(amides). The binders may be hydrophilic ones or hydrophobic ones.

Preferable binders for the photosensitive layer of the silver salt photothermographic material of this invention are poly(vinyl acetals), and a particularly preferable binder is poly(vinyl butyral), which will be detailed hereunder. Polymers such as cellulose esters, especially polymers such as triacetyl cellulose, cellulose acetate butyrate, which exhibit higher softening temperature, are preferable for an overcoating layer as well as an undercoating layer, specifically for a light-insensitive layer such as a protective layer and a backing layer. Incidentally, if desired, the binders may be employed in combination of at least two types.

Such binders are employed in the range of a proportion in which the binders function effectively. Skilled persons in the art can easily determine the effective range. For example, preferred as the index for maintaining aliphatic carboxylic acid silver salts in a photosensitive layer is the proportion range of binders to aliphatic carboxylic acid silver salts of 15:1 to 1:2 and most preferably of 8:1 to 1:1. Namely, the binder amount in the photosensitive layer is preferably from 1.5 to 6 g/m$^2$, and is more preferably from 1.7 to 5 g/m$^2$. When the binder amount is less than 1.5 g/m$^2$, density of the unexposed portion markedly increases, whereby it occasionally becomes impossible to use the resultant material.

In this invention, it is preferable that thermal transition point temperature, after development is at higher or equal to 100° C., is from 46 to 200° C. and is more preferably from 70 to 105° C. Thermal transition point temperature, as described in this invention, refers to the VICAT softening point or the value shown by the ring and ball method, and also refers to the endothermic peak which is obtained by measuring the individually peeled photosensitive layer which has been thermally developed, employing a differential scanning calorimeter (DSC), such as EXSTAR 6000 (manufactured by Seiko Denshi Co.), DSC220C (manufactured by Seiko Denshi Kogyo Co.), and DSC-7 (manufactured by Perkin-Elmer Co.). Commonly, polymers exhibit a glass transition point, Tg. In silver salt photothermographic dry imaging materials, a large endothermic peak appears at a temperature lower than the Tg value of the binder resin employed in the photosensitive layer. The inventors of this invention conducted diligent investigations while paying special attention to the thermal transition point temperature. As a result, it was discovered that by regulating the thermal transition point temperature to the range of 46 to 200° C., durability of the resultant coating layer increased and in addition, photographic characteristics such as speed, maximum density and image retention properties were markedly improved. Based on the discovery, this invention was achieved.

The glass transition temperature (Tg) is determined employing the method, described in Brandlap, et al., "Polymer Handbook", pages from III-139 through III-179, 1966 (published by Wiley and Son Co.). The Tg of the binder composed of copolymer resins is obtained based on the following formula.

Tg of the copolymer (in ° C.)$=v_1Tg_1+v_2Tg_2+\ldots+v_nTg_n$ wherein $v_1$, $v_2$, . . . $v_n$ each represents the mass ratio of the monomer in the copolymer, and $Tg_1$, $Tg_2$, . . . $Tg_n$ each represents Tg (in ° C.) of the homopolymer which is prepared employing each monomer in the copolymer. The accuracy of Tg, calculated based on the formula calculation, is ±5° C.

In the silver salt photothermographic material of this invention, employed as binders, which are incorporated into the photosensitive layer, on the support, comprising aliphatic carboxylic acid silver salts, photosensitive silver halide grains and reducing agents, may be conventional polymers known in the art. The polymers have a Tg of 70 to 105° C., a number average molecular weight of 1,000 to 1,000,000, preferably from 10,000 to 500,000, and a degree of polymerization of about 50 to about 1,000. Examples of such polymers include polymers or copolymers comprised of constituent units of ethylenic unsaturated monomers such as vinyl chloride, vinyl acetate, vinyl alcohol, maleic acid, acrylic acid, acrylic acid esters, vinylidene chloride, acrylonitrile, methacrylic acid, methacrylic acid-esters, styrene, butadiene, ethylene, vinyl butyral, and vinyl acetal, as well as vinyl ether, and polyurethane resins and various types of rubber based resins.

Further listed are phenol resins, epoxy resins, polyurethane hardening type resins, urea resins, melamine resins, alkyd resins, formaldehyde resins, silicone resins, epoxy-polyamide resins, and polyester resins. Such resins are detailed in "Plastics Handbook", published by Asakura Shoten. These polymers are not particularly limited, and may be either homopolymers or copolymers as long as the resultant glass transition temperature, Tg is in the range of 70 to 105° C.

Ethylenically unsaturated monomers as constitution units forming homopolymers or copolymers include alkyl acrylates, aryl acrylates, alkyl methacrylates, aryl methacrylates, alkyl cyano acrylate, and aryl cyano acrylates, in which the alkyl group or aryl group may not be substituted. Specific alkyl groups and aryl groups include a methyl group, an ethyl group, an n-propyl group, an isopropyl group, an n-butyl group, an isobutyl group, a sec-butyl group, a tert-butyl group, an amyl group, a hexyl group, a cyclohexyl group, a benzyl group, a chlorophenyl group, an octyl group, a stearyl group, a sulfopropyl group, an N-ethyl-phenylaminoethyl group, a 2-(3-phenylpropyloxy)ethyl group, a dimethylaminophenoxyethyl group, a furfuryl group, a tetrahydrofurfuryl group, a phenyl group, a cresyl group, a naphthyl group, a 2-hydroxyethyl group, a 4-hydroxybutyl group, a triethylene glycol group, a dipropylene glycol group, a 2-methoxyethyl group, a 3-methoxybutyl group, a 2-actoxyethyl group, a 2-acetacttoxyethyl group, a 2-methoxyethyl group, a 2-iso-proxyethyl group, a 2-butoxyethyl group, a 2-(2-methoxyethoxy)ethyl group, a 2-(2-ethoxyetjoxy)ethyl group, a 2-(2-bitoxyethoxy)ethyl group, a 2-diphenylphsophorylethyl group, an ω-methoxypolyethylene glycol (the number of addition mol n=6), an ally group, and dimethylaminoethylmethyl chloride.

In addition, there may be employed the monomers described below. Vinyl esters: specific examples include vinyl acetate, vinyl propionate, vinyl butyrate, vinyl isobutyrate, vinyl corporate, vinyl chloroacetate, vinyl methoxyacetate, vinyl phenyl acetate, vinyl benzoate, and vinyl salicylate; N-substituted acrylamides, N-substituted methacrylamides and acrylamide and methacrylamide: N-substituents include a methyl group, an ethyl group, a propyl group, a butyl group, a tert-butyl group, a cyclohexyl group, a benzyl group, a hydroxymethyl group, a methoxyethyl group, a dimethylaminoethyl group, a phenyl group, a dimethyl group, a diethyl group, a β-cyanoethyl group, an N-(2-acetacetoxyethyl) group, a diacetone group; olefins: for example, dicyclopentadiene, ethylene, propylene, 1-butene, 1-pentane, vinyl chloride, vinylidene chloride, isoprene, chloroprene, butadiene, and 2,3-dimethylbutadiene; styrenes; for example, methylstyrene, dimethylstyrene, trimethylstyrene, ethylstyrene, isopropylstyrene, tert-butylstyrene, chloromethylstryene, methoxystyrene, acetoxystyrene, chlorostyrene, dichlorostyrene, bromostyrene, and vinyl methyl benzoate; vinyl ethers: for example, methyl vinyl ether, butyl vinyl ether, hexyl vinyl ether, methoxyethyl vinyl ether, and dimethylaminoethyl vinyl ether; N-substituted maleimides: N-substituents include a methyl group, an ethyl group, a propyl group, a butyl group, a tert-butyl group, a cyclohexyl group, a benzyl group, an n-dodecyl group, a phenyl group, a 2-methylphenyl group, a 2,6-diethylphenyl group, and a 2-chlorophenyl group; others include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxalzolidone, N-vinyl pyrrolidone, acrylonitrile, metaacrylonitrile, methylene malonnitrile, vinylidene chloride.

Of these, preferable examples include alkyl methacrylates, aryl methacrylates, and styrenes. Of such polymers, those having an acetal group are preferably employed because they exhibit excellent compatibility with the resultant aliphatic carboxylic acid, whereby an increase in flexibility of the resultant layer is effectively minimized.

Particularly preferred as polymers having an acetal group are the compounds represented by Formula (V) described below.

Formula (V)

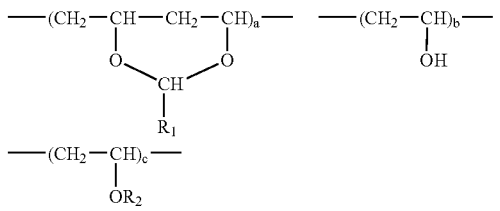

wherein $R_1$ represents a substituted or unsubstituted alkyl group, and a substituted or unsubstituted aryl group, however, groups other than the aryl group are preferred; $R_2$ represents a substituted or unsubstituted alkyl group, a substituted or unsubstituted aryl group, —$COR_3$ or —$CONHR_3$, wherein $R_3$ represents the same as defined above for $R_1$.

Unsubstituted alkyl groups represented by $R_1$, $R_2$, and $R_3$ preferably have 1 to 20 carbon atoms and more preferably have 1 to 6 carbon atoms. The alkyl groups may have a straight or branched chain, but preferably have a straight chain. Listed as such unsubstituted alkyl groups are, for example, a methyl group, an ethyl group, an n-propyl group, an isopropyl group, an n-butyl group, an isobutyl group, a t-butyl group, an n-amyl group, a t-amyl group, an n-hexyl group, a cyclohexyl group, an n-heptyl group, an n-octyl group, a t-octyl group, a 2-ethylhexyl group, an n-nonyl group, an n-decyl group, an n-dodecyl group, and an n-octadecyl group. Of these, particularly preferred is a methyl group or a propyl group.

Unsubstituted aryl groups preferably have from 6 to 20 carbon atoms and include, for example, a phenyl group and a naphthyl group. Listed as groups which can be substituted for the alkyl groups as well as the aryl groups are an alkyl group (for example, a methyl group, an n-propyl group, a t-amyl group, a t-octyl group, an n-nonyl group, and a dodecyl group), an aryl group (for example, a phenyl group), a nitro group, a hydroxyl group, a cyano group, a sulfo group, an alkoxy group (for example, a methoxy group), an aryloxy group (for example, a phenoxy group), an acyloxy group (for example, an acetoxy group), an acylamino group (for example, an acetylamino group), a sulfonamido group (for example, methanesulfonamido group), a sulfamoyl group (for example, a methylsulfamoyl group), a halogen atom (for example, a fluorine atom, a chlorine atom, and a bromine atom), a carboxyl group, a carbamoyl group (for example, a methylcarbamoyl group), an alkoxycarbonyl group (for example, a methoxycarbonyl group), and a sulfonyl group (for example, a methylsulfonyl group). When at least two of the substituents are employed, they may be the same or different. The number of total carbons of the substituted alkyl group is preferably from 1 to 20, while the number of total carbons of the substituted aryl group is preferably from 6 to 20.

$R_2$ is preferably —$COR_3$ (wherein $R_3$ represents an alkyl group or an aryl group) and —$CONHR_{53}$ (wherein $R_3$ represents an aryl group). "a", "b", and "c" each represents the value in which the weight of repeated units is shown utilizing mol percent; "a" is in the range of 40 to 86 mol percent; "b" is in the range of from 0 to 30 mol percent; "c" is in the range of 0 to 60 mol percent, so that a+b+c=100 is satisfied. Most preferably, "a" is in the range of 50 to 86 mol percent, "b" is in the range of 5 to 25 mol percent, and "c"

is in the range of 0 to 40 mol percent. The repeated units having each composition ratio of "a", "b", and "c" may be the same or different.

Employed as polyurethane resins usable in this invention may be those, known in the art, having a structure of polyester polyurethane, polyether polyurethane, polyether polyester polyurethane, polycarbonate polyurethane, polyester polycarbonate polyurethane, or polycaprolactone polyurethane. It is preferable that, if desired, all polyurethanes described herein are substituted, through copolymerization or addition reaction, with at least one polar group selected from the group consisting of —COOM, —$SO_3M$, —$OSO_3M$, —P═O$(OM)_2$, —O—P═O$(OM)_2$ (wherein M represents a hydrogen atom or an alkali metal salt group), —N$(R_4)_2$, —$N^+(R_4)_3$ (wherein $R_{54}$ represents a hydrocarbon group, and a plurality of $R_{54}$ may be the same or different), an epoxy group, —SH, and —CN. The amount of such polar groups is commonly from $10^{-1}$ to $10^{-8}$ mol/g, and is preferably from $10^{-2}$ to $10^{-6}$ mol/g. Other than the polar groups, it is preferable that the molecular terminal of the polyurethane molecule has at least one OH group and at least two OH groups in total. The OH group cross-links with polyisocyanate as a hardening agent so as to form a 3-dimensinal net structure. Therefore, the more OH groups which are incorporated in the molecule, the more preferred. It is particularly preferable that the OH group is positioned at the terminal of the molecule since thereby the reactivity with the hardening agent is enhanced. The polyurethane preferably has at least three OH groups at the terminal of the molecules, and more preferably has at least four OH groups. When polyurethane is employed, the polyurethane preferably has a glass transition temperature of 70 to 105° C., a breakage elongation of 100 to 2,000 percent, and a breakage stress of 0.5 to 100 M/$mm^2$.

Polymers represented by aforesaid Formula (V) of this invention can be synthesized employing common synthetic methods described in "Sakusan Binihru Jushi (Vinyl Acetate Resins)", edited by Ichiro Sakurada (Kohbunshi Kagaku Kankoh Kai, 1962).

It is known that by employing cross-linking agents in the aforesaid binders, uneven development is minimized due to the improved adhesion of the layer to the support. In addition, it results in such effects that fogging during storage is minimized and the creation of printout silver after development is also minimized.

Employed as cross-linking agents used in this invention may be various conventional cross-linking agents, which have been employed for silver halide photosensitive photographic materials, such as aldehyde type, epoxy type, ethyleneimine type, vinylsulfone type, sulfonic acid ester type, acryloyl type, carbodiimide type, and silane compound type cross-linking agents, which are described in JP-A No. 50-96216.

The tone of images obtained by thermal development of the imaging material is described.

It has been pointed out that in regard to the output image tone for medical diagnosis, cold image tone tends to result in more accurate diagnostic observation of radiographs. The cold image tone, as described herein, refers to pure black tone or blue black tone in which black images are tinted to blue. On the other hand, warm image tone refers to warm black tone in which black images are tinted to brown.

The tone is more described below based on an expression defined by a method recommended by the Commission Internationale de l'Eclairage (CIE) in order to define more quantitatively.

"Colder tone" as well as "warmer tone", which is terminology of image tone, is expressed, employing minimum density $D_{min}$ and hue angle $h_{ab}$ at an optical density D of 1.0. The hue angle $h_{ab}$ is obtained by the following formula, utilizing color specifications a* and b* of L*a*b* Color Space which is a color space perceptively having approximately a uniform rate, recommended by Commission Internationale de l'Eclairage (CIE) in 1976.

$$h_{ab}=\tan^{-1}(b^*/a^*)$$

In this invention, $h_{ab}$ is preferably in the range of 180 degrees<$h_{ab}$<270 degrees, is more preferably in the range of 200 degrees<$h_{ab}$<270 degrees, and is most preferably in the range of 220 degrees<$h_{ab}$<260 degrees.

This finding is also disclosed in JP-A 2002-6463.

Incidentally, as described, for example, in JP-A No. 2000-29164, it is conventionally known that diagnostic images with visually preferred color tone are obtained by adjusting, to the specified values, u* and v* or a* and b* in CIE 1976. (L*u*v*) color space or (L*a*b*) color space near an optical density of 1.0.

Extensive investigation was performed for the silver salt photothermographic material according to the present invention. As a result, it was discovered that when a linear regression line was formed on a graph in which in the CIE 1976 (L*u*v*) color space or the (L*a*b*) color space, u* or a* was used as the abscissa and v* or b* was used as the ordinate, the aforesaid materiel exhibited diagnostic properties which were equal to or better than conventional wet type silver salt photosensitive materials by regulating the resulting linear regression line to the specified range. The condition ranges of the present invention will now be described.

(1) It is preferable that the coefficient of determination value $R^2$ of the linear regression line, which is made by arranging u* and v* in terms of each of the optical densities of 0.5, 1.0, and 1.5 and the minimum optical density, is also from 0.998 to 1.000.

The value v* of the intersection point of the aforesaid linear regression line with the ordinate is −5–+5; and gradient (v*/u*) is 0.7 to 2.5.

(2) The coefficient of determination value $R^2$ of the linear regression line is 0.998 to 1.000, which is formed in such a manner that each of optical density of 0.5, 1.0, and 1.5 and the minimum optical density of the aforesaid imaging material is measured, and a* and b* in terms of each of the above optical densities are arranged in two-dimensional coordinates in which a* is used as the abscissa of the CIE 1976 (L*a*b*) color space, while b* is used as the ordinate of the same.

In addition, value b* of the intersection point of the aforesaid linear regression line with the ordinate is from −5 to +5, while gradient (b*/a*) is from 0.7 to 2.5.

A method for making the above-mentioned linear regression line, namely one example of a method for determining u* and v* as well as a* and b* in the CIE 1976 color space, will now be described.

By employing a thermal development apparatus, a 4-step wedge sample including an unexposed portion and optical densities of 0.5, 1.0, and 1.5 is prepared. Each of the wedge density portions prepared as above is determined employing a spectral chronometer (for example, CM-3600d, manufactured by Minolta Co., Ltd.) and either u* and v* or a* and b* are calculated. Measurement conditions are such that an F7 light source is used as a light source, the visual field angle is 10 degrees, and the transmission measurement mode is used. Subsequently, either measured u* and v* or measured a* and b* are plotted on the graph in which u* or a* is used as the abscissa, while v* or b* is used as the ordinate, and a linear regression line is formed, whereby the coefficient of determination value $R^2$ as well as intersection points and gradients are determined.

The specific method enabling to obtain a linear regression line having the above-described characteristics will be described below. In this invention, by regulating the added amount of the aforesaid toning agents, developing agents, silver halide grains, and aliphatic carboxylic acid silver, which are directly or indirectly involved in the development reaction process, it is possible to optimize the shape of developed silver so as to result in the desired tone. For example, when the developed silver is shaped to dendrite, the resulting image tends to be bluish, while when shaped to filament, the resulting imager tends to be yellowish. Namely, it is possible to adjust the image tone taking into account the properties of shape of developed silver.

Usually, image toning agents such as phthalazinones or a combinations of phthalazine with phthalic acids, or phthalic anhydride are employed. Examples of suitable image toning agents are disclosed in Research Disclosure, Item 17029, and U.S. Pat. Nos. 4,123,282, 3,994,732, 3,846,136, and 4,021,249.

Other than such image toning agents, it is preferable to control color tone employing couplers disclosed in JP-A No. 11-288057 and EP 1134611A2 as well as leuco dyes detailed below.

Further, it is possible to unexpectedly minimize variation of tone during storage of silver images by simultaneously employing silver halide grains which are converted into an internal latent image-forming type after the thermal development according to the present invention.

Leuco dyes are employed in the silver salt photothermographic materials relating to this invention. There may be employed, as leuco dyes, any of the colorless or slightly tinted compounds which are oxidized to form a colored state when heated at temperatures of about 80 to about 200° C. for about 0.5 to about 30 seconds. It is possible to use any of the leuco dyes which are oxidized by silver ions to form dyes. Compounds are useful which are sensitive to pH and oxidizable to a colored state.

Representative leuco dyes suitable for the use in the present invention are not particularly limited. Examples include bisphenol leuco dyes, phenol leuco dyes, indoaniline leuco dyes, acrylated azine leuco dyes, phenoxazine leuco dyes, phenodiazine leuco dyes, and phenothiazine leuco dyes. Further, other useful leuco dyes are those disclosed in U.S. Pat. Nos. 3,445,234, 3,846,136, 3,994,732, 4,021,249, 4,021,250, 4,022,617, 4,123,282, 4,368,247, and 4,461,681, as well as JP-A Nos. 50-36110, 59-206831, 5-204087, 11-231460, 2002-169249, and 2002-236334.

In order to control images to specified color tones, it is preferable that various color leuco dyes are employed individually or in combinations of a plurality of types. In the present invention, for minimizing excessive yellowish color tone due to the use of highly active reducing agents, as well as excessive reddish images especially at a density of at least 2.0 due to the use of minute silver halide grains, it is preferable to employ leuco dyes which change to cyan. Further, in order to achieve precise adjustment of color tone, it is further preferable to simultaneously use yellow leuco dyes and other leuco dyes which change to cyan.

It is preferable to appropriately control the density of the resulting color while taking into account the relationship with the color tone of developed silver itself. In the present invention, color formation is performed so that the sum of maximum densities at the maximum adsorption wavelengths of dye images formed by leuco dyes is customarily 0.01 to 0.30, is preferably 0.02 to 0.20, and is most preferably 0.02 to 0.10. Further, it is preferable that images be controlled within the preferred color tone range described below.

In this invention, particularly preferably employed as yellow forming leuco dyes are color image forming agents represented by the following formula (YL) which increase absorbance between 360 and 450 nm via oxidation:

formula (YL)

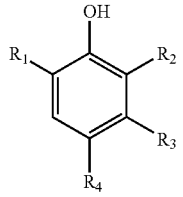

The compounds represented by Formula (YL) will now be detailed. In the foregoing formula (YL), the alkyl groups represented by $R_1$ are preferably those having 1–30 carbon atoms, which may have a substituent. Specifically preferred is methyl, ethyl, butyl, octyl, i-propyl, t-butyl, t-octyl, t-pentyl, sec-butyl, cyclohexyl, or 1-methyl-cyclohexyl. Groups (i-propyl, i-nonyl, t-butyl, t-amyl, t-octyl, cyclohexyl, 1-methyl-cyclohexyl or adamantyl) which are three-dimensionally larger than i-propyl are preferred. Of these, preferred are secondary or tertiary alkyl groups and t-butyl, t-octyl, and t-pentyl, which are tertiary alkyl groups, are particularly preferred. Examples of substituents which $R_1$ may have include a halogen atom, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, and a phosphoryl group.

$R_2$ represents a hydrogen atom, a substituted or unsubstituted alkyl group, or an acylamino group. The alkyl group represented by $R_2$ is preferably one having 1–30 carbon atoms, while the acylamino group is preferably one having 1–30 carbon atoms. Of these, description for the alkyl group is the same as for aforesaid $R_1$.

The acylamino group represented by $R_2$ may be unsubstituted or have a substituent. Specific examples thereof include an acetylamino group, an alkoxyacetylamino group, and an aryloxyacetylamino group. $R_2$ is preferably a hydrogen atom or an unsubstituted group having 1–24 carbon atoms, and specifically listed are methyl, i-propyl, and t-butyl. Further, neither $R_1$ nor $R_2$ is a 2-hydroxyphenylmethyl group.

$R_3$ represents a hydrogen atom, and a substituted or unsubstituted alkyl group. Preferred as alkyl groups are those having 1 to 30 carbon atoms. Description for the above alkyl groups is the same as for $R_1$. Preferred as $R_3$ are a hydrogen atom and an unsubstituted alkyl group having 1 to 24 carbon atoms, and specifically listed are methyl, i-propyl and t-butyl. It is preferable that either $R_{12}$ or $R_{13}$ represents a hydrogen atom.

$R_4$ represents a group capable of being substituted to a benzene ring, and represents the same group which is described for substituent $R_4$, for example, in aforesaid Formula (RED). $R_4$ is preferably a substituted or unsubstituted alkyl group having 1 to 30 carbon atoms, as well as an oxycarbonyl group having 2 to 30 carbon atoms. The alkyl group having 1 to 24 carbon atoms is more preferred. Listed as substituents of the alkyl group are an aryl group, an amino group, an alkoxy group, an oxycarbonyl group, an acylamino group., an acyloxy group, an imido group, and a ureido group. Of these, more preferred are an aryl group, an amino group, an oxycarbonyl group, and an alkoxy group. The substituent of the alkyl group may be substituted with any of the above alkyl groups.

Among the compounds represented by the foregoing formula (YL), preferred compounds are bis-phenol compounds represented by the following formula:

formula (YL')

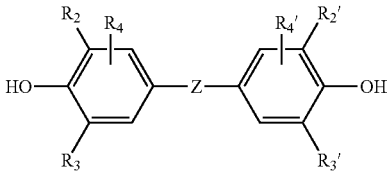

wherein, Z represents a —S— or —C($R_1$) ($R_{1'}$)— group. $R_1$ and $R_{1'}$ each represent a hydrogen atom or a substituent. The substituents represented by $R_1$ and $R_{1'}$ are the same substituents listed for $R_1$ in the aforementioned Formula (RED). $R_1$ and $R_{1'}$ are preferably a hydrogen atom or an alkyl group.

$R_2$, $R_3$, $R_2$' and $R_3$' each represent a substituent. The substituents represented by $R_2$, $R_3$, $R_2$' and $R_3$' are the same substituents listed for $R_2$ and $R_3$ in the aforementioned Formula (RED). $R_2$, $R_3$, $R_2$' and $R_3$' are preferably, an alkyl group, an alkenyl group, an alkynyl group, an aryl group, a heterocyclic group, and more preferably, an alkyl group. Substituents on the alkyl group are the same substituents listed for the substituents in the aforementioned Formula (RED). $R_2$, $R_3$, $R_2$' and $R_3$' are more preferably tertiary alkyl groups such as t-butyl, t-amino, t-octyl and 1-methyl-cyclohexyl.

$R_4$ and $R_{4'}$ each represent a hydrogen atom or a substituent, and the substituents are the same substituents listed for $R_4$ in the aforementioned formula (RED).

Examples of the bis-phenol compounds represented by the formula (YL) are, the compounds disclosed in JP-A No. 2002-169249, Compounds (II-1) to (II-40), paragraph Nos. [0032]–[0038]; and EP 1211093, Compounds (ITS-1) to (ITS-12), paragraph No. [0026].

Specific examples of bisphenol compounds represented by Formula (YL) are shown below.

(YL-1)

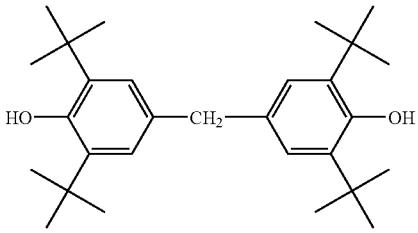

-continued (YL-2)

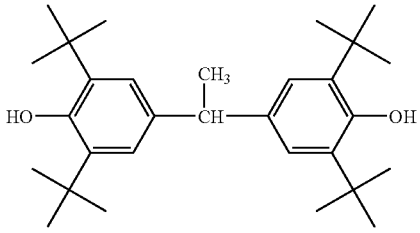

(YL-3)

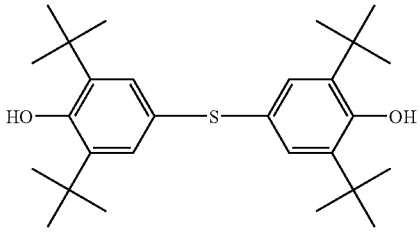

(YL-4)

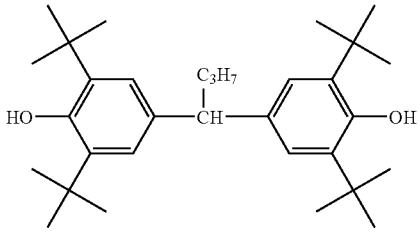

(YL-5)

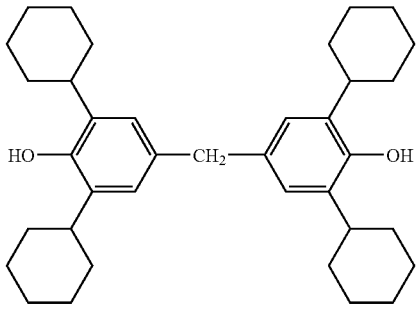

(YL-6)

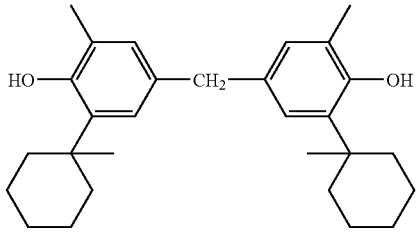

(YL-7)

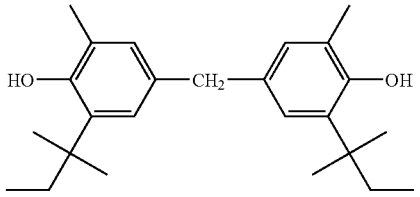

-continued (YL-8)

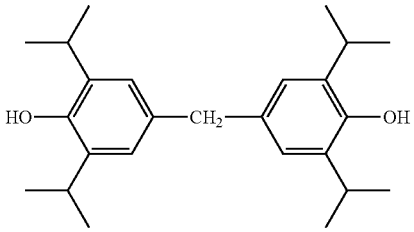

(YL-9)

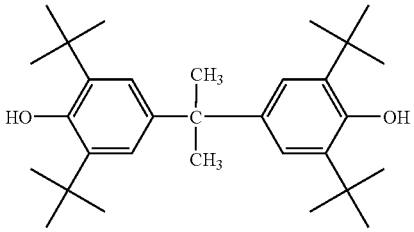

(YL-10)

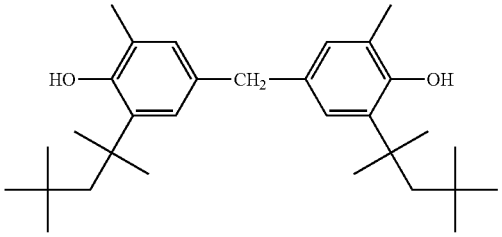

(YL-11)

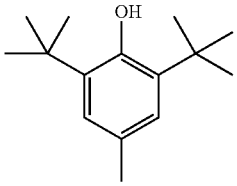

(YL-12)

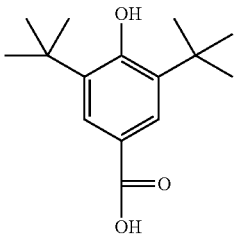

(YL-13)

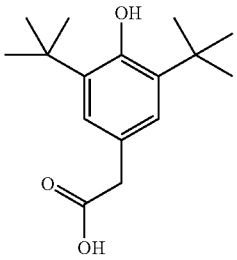

-continued (YL-14)

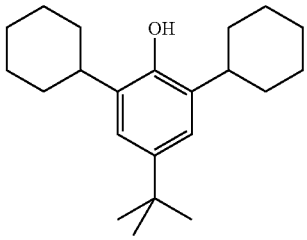

(YL-15)

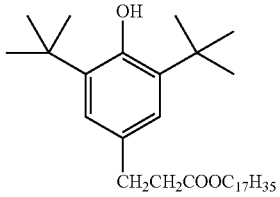

An amount of an incorporated compound represented by formula (YL) is; usually, 0.00001 to 0.01 mol, and preferably, 0.0005 to 0.01 mol, and more preferably, 0.001 to 0.008 mol per mol of Ag.

Cyan forming leuco dyes will now be described. In the present invention, particularly preferably employed as cyan forming leuco dyes are color image forming agents which increase absorbance between 600 and 700 nm via oxidation, and include the compounds described in JP-A No. 59-206831 (particularly, compounds of λmax in the range of 600–700 nm), compounds represented by formulas (I) through (IV) of JP-A No. 5-204087 (specifically, compounds (1) through (18) described in paragraphs [0032] through [0037]), and compounds represented by formulas 4–7 (specifically, compound Nos. 1 through 79 described in paragraph [0105]) of JP-A No. 11-231460.

Cyan forming leuco dyes which are particularly preferably employed in the present invention are represented by the following formula (CL):

formula (CL)

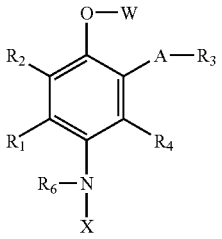

wherein $R_1$ and $R_2$ each represent a hydrogen atom, a substituted or unsubstituted alkyl group, an NHCO—$R_{10}$ group wherein $R_{10}$ is an alkyl group, an aryl group, or a heterocyclic group, while $R_1$ and $R_2$ may bond to each other to form an aliphatic hydrocarbon ring, an aromatic hydrocarbon ring, or a heterocyclic ring; A represents —NHCO—, —CONH—, or —NHCONH—; $R_3$ represents a substituted or unsubstituted alkyl group, an aryl group, or a heterocyclic group, or -A-$R_3$ is a hydrogen atom; W represents a hydrogen atom or a —CONH$R_5$— group, —CO$R_5$ or a —CO—O—$R_5$ group wherein $R_5$ represents a substituted or unsubstituted alkyl group, an aryl group, or a heterocyclic group; $R_4$ represents a hydrogen atom, a halogen atom, a substituted or unsubstituted alkyl group, an alkoxy group, a carbamoyl group, or a nitrile group; $R_6$ represents a —CONH—$R_7$ group, a —CO—$R_7$ group, or a —CO—O—$R_7$ group wherein $R_7$ is a substituted or unsubstituted alkyl group, an aryl group, or a heterocyclic group; and X represents a substituted or unsubstituted aryl group or a heterocyclic group.

In the foregoing formula (CL), halogen atoms include fluorine, bromine, and chlorine; alkyl groups include those having at most 20 carbon atoms (methyl, ethyl, butyl, or dodecyl); alkenyl groups include those having at most 20 carbon atoms (vinyl, allyl, butenyl, hexenyl, hexadienyl, ethenyl-2-propenyl, 3-butenyl, 1-methyl-3-propenyl, 3-pentenyl, or 1-methyl-3-butenyl); alkoxy groups include those having at most 20 carbon atoms (methoxy or ethoxy); aryl groups include those having 6–20 carbon atoms such as a phenyl group, a naphthyl group, or a thienyl group; heterocyclic groups include each of thiophene, furan, imidazole, pyrazole, and pyrrole groups. A represents —NHCO—, —CONH—, or —NHCONH—; $R_3$ represents a substituted or unsubstituted alkyl group (preferably having at most 20 carbon atoms such as methyl, ethyl, butyl, or dodecyl), an aryl group (preferably having 6–20 carbon atoms, such as phenyl, naphthyl, or thienyl), or a heterocyclic group (thiophene, furan, imidazole, pyrazole, or pyrrole); -A-$R_3$ is a hydrogen atom; W represents a hydrogen atom or a —CONH$R_5$ group, a —CO—$R_5$ group or a —CO—O$R_5$ group wherein $R_5$ represents a substituted or unsubstituted alkyl group (preferably having at most 20 carbon atoms, such as methyl, ethyl, butyl, or dodecyl), an aryl group (preferably having 6–20 carbon atoms, such as phenyl, naphthyl, or thienyl), or a heterocyclic group (such as thiophene, furan, imidazole, pyrazole, or pyrrole); $R_4$ is preferably a hydrogen atom, a halogen atom (e.g., fluorine, chlorine, bromine, iodine), a chain or cyclic alkyl group (e.g., a methyl group, a butyl group, a dodecyl group, or a cyclohexyl group), an alkoxy group (e.g., a methoxy group, a butoxy group, or a tetradecyloxy group), a carbamoyl group (e.g., a diethylcarbamoyl group or a phenylcarbamoyl group), and a nitrile group and of these, a hydrogen atom and an alkyl group are more preferred. Aforesaid $R_1$ and $R_2$, and $R_3$ and $R_4$ bond to each other to form a ring structure. The aforesaid groups may have a single substituent or a plurality of substituents. For example, typical substituents which may be introduced into aryl groups include a halogen atom (e.g., fluorine, chlorine, or bromine), an alkyl group (e.g., methyl, ethyl, propyl, butyl, or dodecyl), a hydroxyl group, a cyan group, a nitro group, an alkoxy group (methoxy or ethoxy), an alkylsulfonamide group (e.g., methylsulfonamido or octylsulfonamido), an arylsulfonamide group (e.g., phenylsulfonamido or naphthylsulfonamido), an alkylsulfamoyl group (e.g., butylsulfamoyl), an arylsulfamoyl group (e.g., phenylsulfamoyl), an alkyloxycarbonyl group (e.g., methoxycarbonyl), an aryloxycarbonyl group (e.g., phenyloxycarbonyl), an aminosulfonamide group, an acylamino group, a carbamoyl group, a sulfonyl group, a sulfinyl group, a sulfoxy group, a sulfo group, an aryloxy group, an alkoxy group, an alkylcarbonyl group, an arylcarbonyl group, or an aminocarbonyl group. It is possible to introduce two different groups of these groups into an aryl group. Either $R_{10}$ or $R_{85}$ is preferably a phenyl group, and is more preferably a phenyl group having a plurality of substituents containing a halogen atom or a cyano group.

$R_6$ is a —CONH—$R_7$ group, a —CO—$R_7$ group, or —CO—O—$R_7$ group, wherein $R_7$ is a substituted or unsubstituted alkyl group (preferably having at most 20 carbon atoms, such as methyl, ethyl, butyl, or dodecyl), an aryl group (preferably having 6 to 20 carbon atoms, such as phenyl, naphthol, or thienyl), or a heterocyclic group (thiophene, furan, imidazole, pyrazole, or pyrrole). Employed as substituents of the alkyl group represented by $R_7$ may be the same ones as substituents in $R_1$ to $R_4$. $X_8$ represents a substituted or unsubstituted aryl group or a heterocyclic group. These aryl groups include groups having 6 to 20 carbon atoms such as phenyl, naphthyl, or thienyl, while the heterocyclic groups include any of the groups such as thiophene, furan, imidazole, pyrazole, or pyrrole. Employed as substituents which may be substituted to the group represented by X may be the same ones as the substituents in $R_1$ to $R_4$. As the groups represented by X, preferred are an aryl group, which is substituted with an alkylamino group (a diethylamino group) at the para-position, or a heterocyclic group. These may contain other photographically useful groups.

Specific examples of cyan forming leuco dyes (CL) are listed below, however are not limited thereto.

(CL-1)

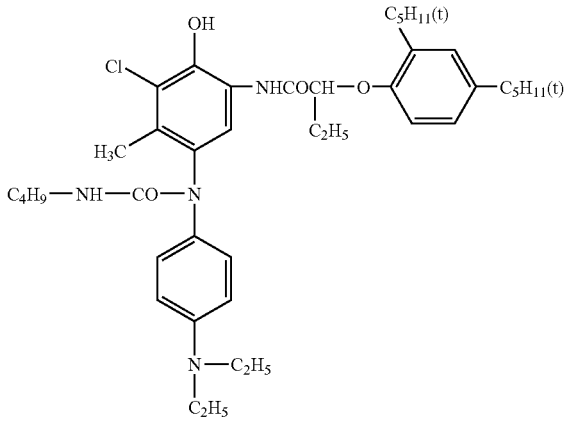

(CL-2)

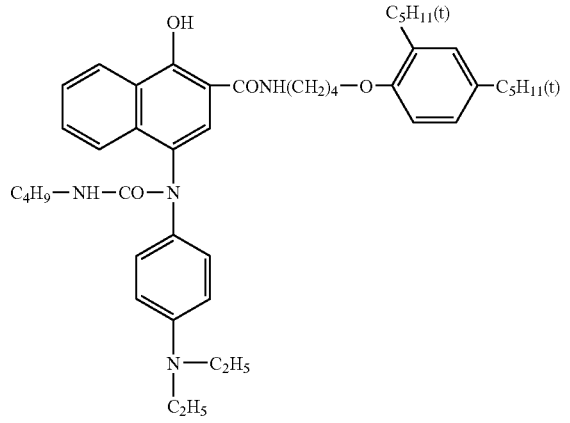

-continued
(CL-3)
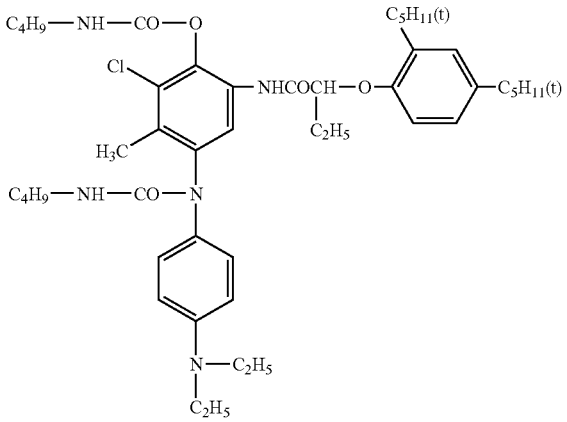
(CL-4)
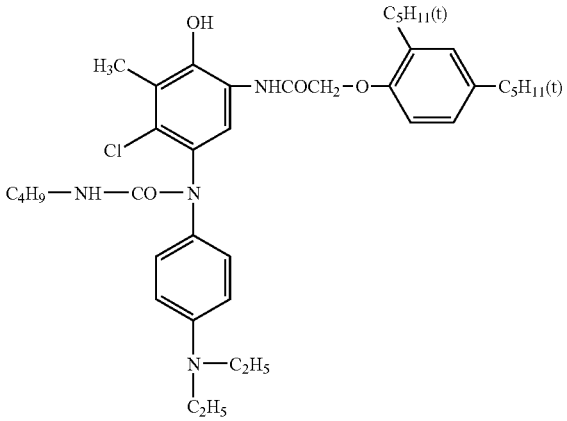
(CL-5)
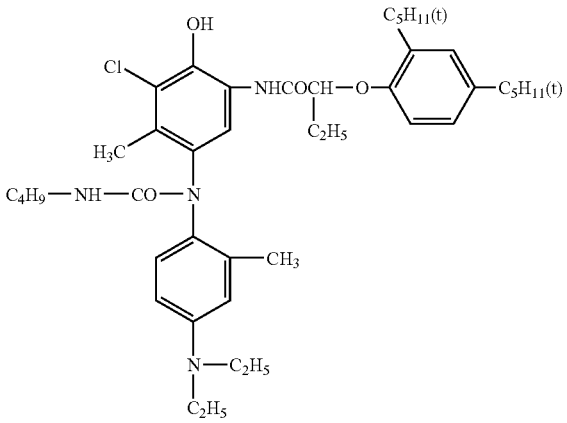
-continued
(CL-6)
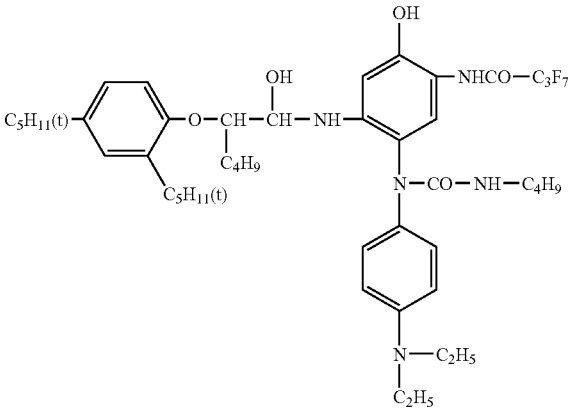
(CL-7)
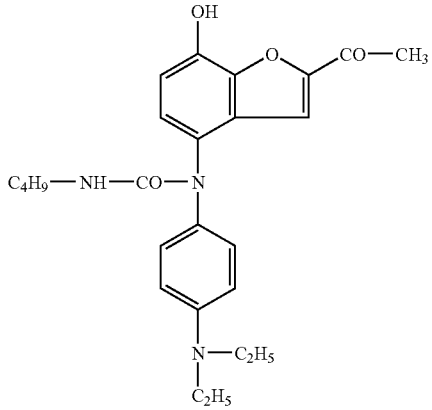
(CL-8)
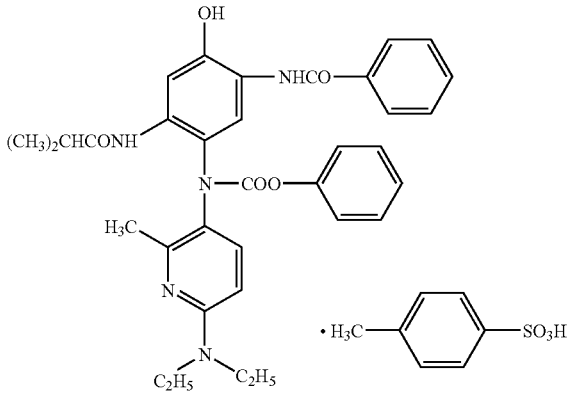

-continued (CL-9)

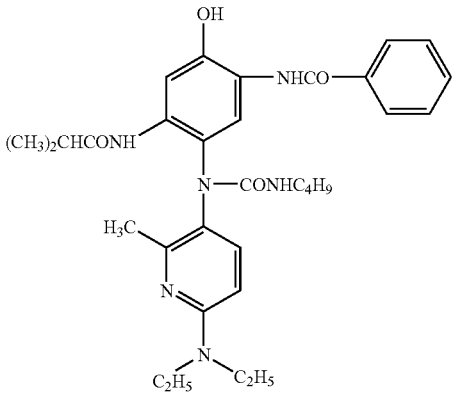

(CL-10)

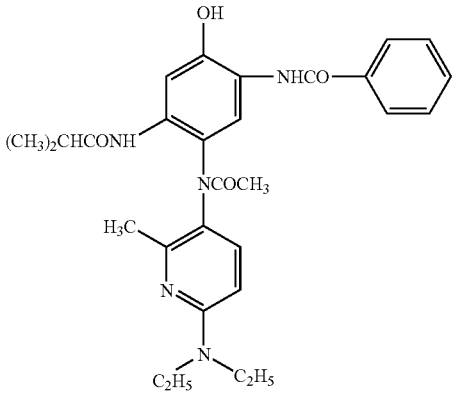

(CL-11)

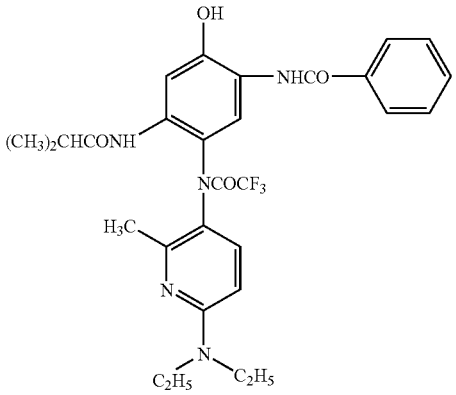

(CL-12)

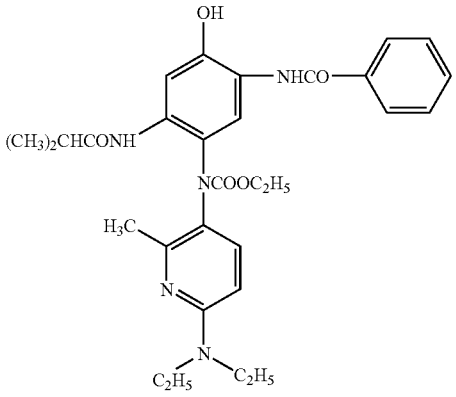

The addition amount of cyan forming leuco dyes is usually 0.00001 to 0.05 mol/mol of Ag, preferably 0.0005 to 0.02 mol/mol, and more preferably 0.001 to 0.01 mol.

The compounds represented by the foregoing formula (YL) and cyan forming leuco dyes may be added employing the same method as for the reducing agents represented by the foregoing formual (RED). They may be incorporated in liquid coating compositions employing an optional method to result in a solution form, an emulsified dispersion form, or a minute solid particle dispersion form, and then incorporated in a photosensitive material.

It is preferable to incorporate the compounds represented by Formula (YL) and cyan forming leuco dyes into an image forming layer containing organic silver salts. On the other hand, the former may be incorporated in the image forming layer, while the latter may be incorporated in a non-image forming layer adjacent to the aforesaid image forming layer. Alternatively, both may be incorporated in the non-image forming layer. Further, when the image forming layer is comprised of a plurality of layers, incorporation may be performed for each of the layers.

To minimize image abrasion caused by handling prior to development as well as after thermal development, matting agents are preferably incorporated in the surface layer (on the photosensitive layer side, and also on the other side when the light-insensitive layer is provided on the opposite side across the support). The added amount is preferably from 0.1 to 30.0 percent by weight with respect to the binders.

Matting agents may be comprised of organic or inorganic materials. Employed as inorganic materials for the matting agents may be, for example, silica described in Swiss Patent No. 330,158, glass powder described in French Patent No. 1,296,995, and carbonates of alkali earth metals or cadmium and zinc described in British Patent No. 1,173,181. Employed as organic materials for the matting agents are starch described in U.S. Pat. No. 2,322,037, starch derivatives described in Belgian Patent No. 625,451 and British Patent No. 981,198, polyvinyl alcohol described in Japanese Patent Publication No. 44-3643, polystyrene or polymethacrylate described in Swiss Patent No. 330,158, acrylonitrile described in U.S. Pat. No. 3,079,257, and polycarbonate described in U.S. Pat. No. 3,022,169.

The average particle diameter of the matting agents is preferably from 0.5 to 10.0 μm, and is more preferably from 1.0 to 8.0 μm. Further, the variation coefficient of the particle size distribution of the same is preferably less than or equal to 50 percent, is more preferably less than or equal to 40 percent, and is most preferably from less than or equal to 30 percent. Herein, the variation coefficient of the particle size distribution refers to the value expressed by the formula described below:

[(Standard deviation of particle diameter)/(particle diameter average)]×100

Methods of adding the matting agent may include one in which the matting agent is previously dispersed in a coating composition and the resultant dispersion is applied onto a support, and the other in which after applying a coating composition onto a support, a matting agent is sprayed onto the resultant coating prior to completion of drying. Further, when a plurality of matting agents is employed, both methods may be used in combination.

It is preferable to employ the fluorinated surfactants represented by the following formulas (SA-1) to (SA-3) in the photothermographic materials:

$$(Rf\text{-}L)_p\text{-}Y\text{-}(A)_q \qquad \text{formula (SA-1)}$$

$$LiO_3S—(CF_2)_n—SO_3Li \qquad \text{formula (SA-2)}$$

$$MO_3S—(CF_2)_n—SO_3M \qquad \text{formula (SA-3)}$$

wherein M represents a hydrogen atom, a sodium atom, a potassium atom, and an ammonium group; n represents a positive integer, while in the case in which M represents H, n represents an integer of 1 to 6 and 8, and in the case in which M represents an ammonium group, n represents an integer of 1 to 8.

In the foregoing formula (SA-1), Rf represents a substituent containing a fluorine atom. Fluorine atom-containing substituents include, for example, an alkyl group having 1 to 25 carbon atoms (such as a methyl group, an ethyl group, a butyl group, an octyl group, a dodecyl group, or an octadecyl group), and an alkenyl group (such as a propenyl group, a butenyl group, a nonenyl group or a dodecenyl group).

L represents a divalent linking group having no fluorine atom. Listed as divalent linking groups having no fluorine atom are, for example, an alkylene group (e.g., a methylene group, an ethylene group, and a butylene group), an alkyleneoxy group (such as a methyleneoxy group, an ethyleneoxy group, or a butyleneoxy group), an oxyalkylene group (e.g., an oxymethylene group, an oxyethylene group, and an oxybutylene group), an oxyalkyleneoxy group (e.g., an oxymethyleneoxy group, an oxyethyleneoxy group, and an oxyethyleneoxyethyleneoxy group), a phenylene group., and an oxyphenylene group, a phenyloxy group, and an oxyphenyloxy group, or a group formed by combining these groups.

A represents an anion group or a salt group thereof. Examples include a carboxylic acid group or salt groups thereof (sodium salts, potassium salts and lithium salts), a sulfonic acid group or salt groups thereof (sodium salts, potassium salts and lithium salts), and a phosphoric acid group and salt groups thereof (sodium salts, potassium salts and lithium salts).

Y represents a trivalent or tetravalent linking group having no fluorine atom. Examples include trivalent or tetravalent linking groups having no fluorine atom, which are groups of atoms comprised of a nitrogen atom as the center. P represents an integer from 1 to 3, while q represents an integer of 2 or 3.

The fluorinated surfactants represented by the foregoing formula (SA-1) are prepared as follows. Alkyl compounds having 1 to 25 carbon atoms into which fluorine atoms are introduced (e.g., compounds having a trifluoromethyl group, a pentafluoroethyl group, a perfluorobutyl group, a perfluorooctyl group, or a perfluorooctadecyl group) and alkenyl compounds (e.g., a perfluorohexenyl group or a perfluorononenyl group) undergo addition reaction or condensation reaction with each of the tri- to hexa-valent alknaol compounds into which fluorine atom(s) are not introduced, aromatic compounds having 3 or 4 hydroxyl groups or hetero compounds. Anion group (A) is further introduced into the resulting compounds (including alknaol compounds which have been partially subjected to introduction of Rf) employing, for example, sulfuric acid esterification.

Examples of the aforesaid tri- to hexa-valent alkanol compounds include glycerin, pentaerythritol, 2-methyl-2-hydroxymethyl-1,3-propanediol, 2,4-dihydroxy-3-hydroxymethylpentane, 1,2,6-hexanrtriol. 1,1,1-tris(hydroxymethyl)propane, 2,2-bis(butanol), aliphatic triol, tetramethylolmethane, D-sorbitol, xylitol, and D-mannitol. The aforesaid aromatic compounds, having 3–4 hydroxyl groups and hetero compounds, include, for example, 1,3,5-trihydroxybenzene and 2,4,6-trihydroxypyridine.

In formula (SA-2), "n" is an integer of 1 to 4.

In the foregoing formula (SA-3), M represents a hydrogen atom, a potassium atom, or an ammonium group and n represents a positive integer. In the case in which M represents H, n represents an integer from 1 to 6 or 8; in the case in which M represents Na, n represents 4; in the case in which M represents K, n represents an integer from 1 to 6; and in the case in which M represents an ammonium group, n represents an integer from 1 to 8.

It is possible to add the fluorinated surfactants represented by the formulas (SA-1) to (SA-3) to liquid coating compositions, employing any conventional addition methods known in the art. Thus, they are dissolved in solvents such as alcohols including methanol or ethanol, ketones such as methyl ethyl ketone or acetone, and polar solvents such as dimethylformamide, and then added. Further, they may be dispersed into water or organic solvents in the form of minute particles at a maximum size of 1 μm, employing a sand mill, a jet mill, or an ultrasonic homogenizer and then added. Many techniques are disclosed for minute particle dispersion, and it is possible to perform dispersion based on any of these. It is preferable that the aforesaid fluorinated surfactants are added to the protective layer which is the outermost layer.

The added amount of the aforesaid fluorinated surfactants is preferably $1\times10^{-8}$ to $1\times10^{-1}$ mol per $m^2$. When the added amount is less than the lower limit, it is not possible to achieve desired charging characteristics, while it exceeds the upper limit, storage stability degrades due to an increase in humidity dependence.

Surfactants represented by the foregoing formulas (SA-1), (SA-2), and (SA-3) are disclosed in JP-A No. 2003-57786, and Japanese Patent Application Nos. 2002-178386 and 2003-237982.

Materials for the support employed in the silver salt photothermographic material are various kinds of polymers, glass, wool fabric, cotton fabric, paper, and metal (for example, aluminum). From the viewpoint of handling as information recording materials, flexible materials, which can be employed as a sheet or can be wound in a roll, are suitable. Accordingly, preferred as supports in the silver salt photothermographic dry imaging material of the present invention are plastic films (for example, cellulose acetate film, polyester film, polyethylene terephthalate film, polyethylene naphthalate film, polyamide film, polyimide film, cellulose triacetate film or polycarbonate film). Of these, in the present invention, biaxially stretched polyethylene terephthalate film is particularly preferred. The thickness of the supports is commonly from about 50 to about 300 μm, and is preferably from 70 to 180 μm.

To minimize static-charge buildup, electrically conductive compounds such as metal oxides and/or electrically conductive polymers may be incorporated in composition layers. The compounds may be incorporated in any layer, but are preferably incorporated in a subbing layer, a backing layer, and an interlayer between the photosensitive layer and the subbing layer. In the present invention, preferably employed are electrically conductive compounds described in columns 14 through 20 of U.S. Pat. No. 5,244,773.

The silver salt photothermographic material relating to this invention comprises a support having thereon at least one photosensitive layer. The photosensitive layer may only be formed on the support. However, it is preferable that at least one light-insensitive layer is formed on the photosensitive layer. For example, it is preferable that for the purpose of protecting a photosensitive layer, a protective layer is formed on the photosensitive layer, and in order to minimize adhesion between photosensitive materials as well as adhesion in a wound roll, a backing layer is provided on the opposite side of the support. As binders employed in the protective layer as well as the backing layer, polymers such as cellulose acetate, cellulose acetate butyrate, which has a higher glass transition point from the thermal development layer and exhibit abrasion resistance as well as distortion resistance are selected from the aforesaid binders. Incidentally, for the purpose of increasing latitude, one of the preferred embodiments of the present invention is that at least two photosensitive layers are provided on the one side of the support or at least one photosensitive layer is provided on both sides of the support.

In the silver salt photothermographic dry imaging material of the present invention, in order to control the light amount as well as the wavelength distribution of light which transmits the photosensitive layer, it is preferable that a filter layer is formed on the photosensitive layer side or on the opposite side, or dyes or pigments are incorporated in the photosensitive layer.

For example, when the silver salt photothermographic dry imaging material of the present invention is used as an image recording material utilizing infrared radiation, it is preferable to employ squalilium dyes having a thiopyrylium nucleus (hereinafter referred to as thiopyriliumsqualilium dyes) and squalilium dyes having a pyrylium nucleus (hereinafter referred to as pyryliumsqualilium dyes), as described in Japanese Patent Application No. 11-255557, and thiopyryliumcroconium dyes or pyryliumcroconium dyes which are analogous to the squalilium dyes.

Incidentally, the compounds having a squalilium nucleus, as described herein, refers to ones having 1-cyclobutene-2-hydroxy-4-one in their molecular structure. Herein, the hydroxyl group may be dissociated. Hereinafter, all of these dyes are referred to as squalilium dyes. There are also preferably employed as a dye compounds described in JP-A No. 8-201959.

It is preferable to prepare the silver salt photothermographic dry imaging material of the present invention as follows. Materials of each constitution layer as above are dissolved or dispersed in solvents to prepare coating compositions. Resultant coating compositions are subjected to simultaneous multilayer coating and subsequently, the resultant coating is subjected to a thermal treatment. "Simultaneous multilayer coating", as described herein, refers to the following. The coating composition of each constitution layer (for example, a photosensitive layer and a protective layer) is prepared. When the resultant coating compositions are applied onto a support, the coating compositions are not applied onto a support in such a manner that they are individually applied and subsequently dried, and the operation is repeated, but are simultaneously applied onto a support and subsequently dried. Namely, before the residual amount of the total solvents of the lower layer reaches 70 percent by weight, the upper layer is applied.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system called an extrusion coating method. The extrusion coating method is suitable for accurate coating as well as organic solvent coating because volatilization on a slide surface, which occurs in a slide coating system, does not occur. Coating methods have been described for coating layers on the photosensitive layer side. However, the backing layer and the subbing layer are applied onto a support in the same manner as above.

In the present invention, silver coverage is preferably from 0.1 to 2.5 g/m$^2$, and is more preferably from 0.5 to 1.5 g/m$^2$. Further, in the present invention, it is preferable that in the silver halide grain emulsion, the content ratio of silver halide grains, having a grain diameter of 0.030 to 0.055 μm in term of the silver weight, is from 3 to 15 percent in the range of a silver coverage of 0.5 to 1.5 g/m$^2$. The ratio of the silver coverage which is resulted from silver halide is preferably from 2 to 18 percent with respect to the total silver, and is more preferably from 3 to 15 percent. Further, in the present invention, the number of coated silver halide grains, having a grain diameter (being a sphere equivalent grain diameter) of at least 0.01 μm, is preferably from $1\times10^{14}$ to $1\times10^{18}$ grains/m$^2$, and is more preferably from $1\times10^{15}$ to $1\times10^{17}$. Further, the coated weight of aliphatic carboxylic acid silver salts of the present invention is from $10^{-17}$ to $10^{-15}$ g per silver halide grain having a diameter (being a sphere equivalent grain diameter) of at least 0.01 μm, and is more preferably from $10^{-16}$ to $10^{-14}$ g. When coating is carried out under conditions within the aforesaid range, from the viewpoint of maximum optical silver image density per definite silver coverage, namely covering power as well as silver image tone, desired results are obtained.

When the silver salt photothermographic dry imaging material of the present invention is exposed, it is preferable to employ an optimal light source for the spectral sensitivity provided to the aforesaid photosensitive material. For example, when the aforesaid photosensitive material is sensitive to infrared radiation, it is possible to use any radiation source which emits radiation in the infrared region. However, infrared semiconductor lasers (at 780 nm and 820 nm) are preferably employed due to their high power, as well as ability to make photosensitive materials transparent.

In the present invention, it is preferable that exposure is carried out utilizing laser scanning. Employed as the exposure methods are various ones. For example, listed as a preferable method is the method utilizing a laser scanning exposure apparatus in which the angle between the scanning surface of a photosensitive material and the scanning laser beam does not substantially become vertical. "Does not substantially become vertical", as described herein, means that during laser scanning, the nearest vertical angle is preferably from 55 to 88 degrees, is more preferably from 60 to 86 degrees, and is most preferably from 70 to 82 degrees.

When the laser beam scans photosensitive materials, the beam spot diameter on the exposed surface of the photosensitive material is preferably at most 200 μm, and is more preferably at most 100 mm, and is more preferably at most 100 μm. It is preferable to decrease the spot diameter due to the fact that it is possible to decrease the deviated angle from the verticality of laser beam incident angle. Incidentally, the lower limit of the laser beam spot diameter is 10 μm. By performing the laser beam scanning exposure, it is possible to minimize degradation of image quality according to reflection light such as generation of unevenness analogous to interference fringes.

Further, as the second method, exposure in the present invention is also preferably carried out employing a laser scanning exposure apparatus which generates a scanning laser beam in a longitudinal multiple mode, which minimizes degradation of image quality such as generation of unevenness analogous to interference fringes, compared to the scanning laser beam in a longitudinal single mode. The longitudinal multiple mode is achieved utilizing methods in which return light due to integrated wave is employed, or high frequency superposition is applied. The longitudinal multiple mode, as described herein, means that the wavelength of radiation employed for exposure is not single. The wavelength distribution of the radiation is commonly at least 5 nm, and is preferably at least 10 nm. The upper limit of the wavelength of the radiation is not particularly limited, but is commonly about 60 nm.

In the recording methods of the aforesaid first and second embodiments, it is possible to suitably select any of the following lasers employed for scanning exposure, which are generally well known, while matching the use. The foregoing lasers include solid lasers such as a ruby laser, a YAG laser, and a glass laser; gas lasers such as a HeNe laser, an Ar ion laser, a Kr ion laser, a $CO_2$ laser a CO laser, a HeCd laser, an $N_2$ laser, and an excimer laser; semiconductor lasers such as an InGaP laser, an AlGaAs laser, a GaASP laser, an InGaAs laser, an InAsP laser, a $CdSnP_2$ laser, and a GaSb laser; chemical lasers; and dye lasers. Of these, from the viewpoint of maintenance as well as the size of light sources, it is preferable to employ any of the semiconductor lasers having a wavelength of 600 to 1,200 nm. The beam spot diameter of lasers employed in laser imagers, as well as laser image setters, is commonly in the range of 5 to 75 μm in terms of a short axis diameter and in the range of 5 to 100 μm in terms of a long axis diameter. Further, it is possible to set a laser beam scanning rate at the optimal value for each photosensitive material depending on the inherent speed of the silver salt photothermographic dry imaging material at laser transmitting wavelength and the laser power.

In the present-invention, development conditions vary depending on employed devices and apparatuses, or means. Typically, an imagewise exposed silver salt photothermographic dry imaging material is heated at optimal high temperature. It is possible to develop a latent image formed by exposure by heating the material at relatively high temperature (for example, from about 100 to about 200° C.) for a sufficient period (commonly from about 1 second to about 2 minutes). When the heating temperature is less than or equal to 100° C., it is difficult to obtain sufficient image density within a relatively short period. On the other hand, at more than or equal to 200° C., binders melt so as to be transferred to rollers, and adverse effects result not only for images but also for transportability as well as processing devices. Upon heating the material, silver images are formed through an oxidation-reduction reaction between aliphatic carboxylic acid silver salts (which function as an oxidizing agent) and reducing agents. This reaction proceeds without any supply of processing solutions such as water from the exterior.

Heating may be carried out employing typical heating means such as hot plates, irons, hot rollers and heat generators employing carbon and white titanium. When the protective layer-provided silver salt photothermographic dry imaging material of the present invention is heated, from the viewpoint of uniform heating, heating efficiency, and workability, it is preferable that heating is carried out while the surface of the side provided with the protective layer comes into contact with a heating means, and thermal development is carried out during the transport of the material while the surface comes into contact with the heating rollers.

EXAMPLES

The present invention will be further described based on examples but is by no means limited to these.

Example 1

Preparation of Photothermographic Material

A photographic support comprised of a 175 μm thick biaxially oriented polyethylene terephthalate film with blue tinted at an optical density of 0.170 (determined by Densitometer PDA-65, manufactured by Konica Corp.), which had been subjected to corona discharge treatment of 8 W·minute/$m^2$ on both sides, was subjected to subbing. Namely, subbing liquid coating composition a-1 was applied onto one side of the above photographic support at 22° C. and 100 m/minute to result in a dried layer thickness of 0.2 μm and dried at 140° C., whereby a subbing layer on the image forming layer side (designated as Subbing Layer A-1) was formed. Further, subbing liquid coating composition b-1 described below was applied, as a backing layer subbing layer, onto the opposite side at 22° C. and 100 m/minute to result in a dried layer thickness of 0.12 μm and dried at 140° C. An electrically conductive subbing layer (designated as subbing lower layer B-1), which exhibited an antistatic function, was applied onto the backing layer side. The surface of subbing lower layer A-1 and subbing lower layer B-1 was subjected to corona discharge treatment of 8 W·minute/$m^2$. Subsequently, subbing liquid coating composition a-2 was applied onto subbing lower layer A-1 was applied at 33° C. and 100 m/minute to result in a dried layer thickness of 0.03 μm and dried at 140° C. The resulting layer was designated as subbing upper layer A-2. Subbing liquid coating composition b-2 described below was applied onto subbing lower layer B-1 at 33° C. and 100 m/minute to results in a dried layer thickness of 0.2 μm and dried at 140° C. The resulting layer was designated as subbing upper layer B-2. Thereafter, the resulting support was subjected to heat treatment at 123° C. for two minutes and wound up under the conditions of 25° C. and 50 percent relative humidity, whereby a subbed sample was prepared.

Coating Composition a-1: Subbing Lower Layer A-1 on Image Forming Layer Side

| | |
|---|---|
| Acryl Based Polymer Latex C-3 (30% solids) | 70.0 g |
| Aqueous dispersion of ethoxylated alcohol and ethylene homopolymer (10% solids) | 5.0 g |
| Surfactant (A) | 0.1 g |
| Distilled water to make | 1000 ml |

Coating Composition a-2: Image Forming Layer Side Subbing Upper Layer A-2

| | |
|---|---|
| Modified Water-based Polyester B-2 (18 wt %) | 30.0 g |
| Surfactant (A) | 0.1 g |
| Spherical silica matting agent (Sea Hoster KE-P50, manufactured by Nippon Shokubai Co., Ltd.) | 0.04 g |
| Distilled water to make | 1000 ml |

Coating Composition b-1: Backing Layer Side Subbing Lower Layer B-1

| | |
|---|---|
| Acryl Based Polymer Latex C-1 (30% solids) | 30.0 g |
| Acryl Based Polymer Latex C-2 (30% solids) | 7.6 g |
| $SnO_2$ sol*[1] | 180 g |
| Surfactant (A) | 0.5 g |
| Aqueous 5 wt % PVA-613 (PVA, manufactured by Kuraray Co., Ltd.) | 0.4 g |
| Distilled water to make | 1000 ml |

*[1]The solid concentration of $SnO_2$ sol synthesized employing the method described in Example 1 of Japanese Patent Publication JP-B No. 35-6616 (the term, JP-B refers to Japanese Patent Publication) was heated and concentrated to reach a solid concentration of 10 percent by weight, and subsequently, the pH was adjusted to 10 by the addition of ammonia water.

Coatings Composition b-2: Backing Layer Side Subbing Upper Layer B-2

| | |
|---|---|
| Modified Water-based Polyester B-1 (18 percent by weight) | 145.0 g |
| Spherical silica matting agent (Sea Hoster KE-P50, manufactured by Nippon Shokubai Co., Ltd.) | 0.2 g |
| Surface Active Agent (A) | 0.1 g |
| Distilled water to make | 1000 ml |

Modified water-based polyester solutions B-1 and B-2, and acryl based polymer latexes C-1, C-2 and C-3 used in the foregoing coating composition were prepared in the following manner.

Preparation of Water-Based Polyester A-1

A mixture consisting of 35.4 parts by weight of dimethyl terephthalate, 33.63 parts by weight of dimethyl isophthalate, 17.92 parts by weight of sodium salt of dimethyl 5-sulfoisophthalate, 62 parts by weight of ethylene glycol, 0.065 part by weight of calcium acetate monohydrate, and 0.022 part by weight of manganese acetate tetrahydrate underwent transesterification at 170 to 220° C. under a flow of nitrogen while distilling out methanol. Thereafter, 0.04 part by weight of trimethyl phosphate, 0.04 part by weight of antimony trioxide, and 6.8 parts by weight of 4-cyclohexanedicarboxylic acid were added. The resulting mixture underwent esterification at a reaction temperature of 220 to 235° C. while a nearly theoretical amount of water being distilled away.

Thereafter, the reaction system was subjected to pressure reduction and heating over a period of one hour and was subjected to polycondensation at a final temperature of 280° C. and a maximum pressure of 133 Pa for one hour, whereby water-soluble polyester A-1 was synthesized. The intrinsic viscosity of the resulting water-soluble polyester A-1 was 0.33, the average particle size was 40 nm, and Mw was 80,000 to 100,000.

Subsequently, 850 ml of pure water was placed in a 2-liter three-necked flask fitted with stirring blades, a refluxing cooling pipe, and a thermometer, and while rotating the stirring blades, 150 g of water-soluble polyester A-1 was gradually added. The resulting mixture was stirred at room temperature for 30 minutes without any modification. Thereafter, the interior temperature was raised to 98° C. over a period of 1.5 hours and at that resulting temperature, dissolution was performed. Thereafter, the temperature was lowered to room temperature over a period of one hour and the resulting product was allowed to stand overnight, whereby water-based polyester A-1 solution was prepared.

Preparation of Modified Water-Based Polyester Solution B-1 and B-2

Into a 3-liter four-necked flask fitted with stirring blades, a reflux cooling pipe, a thermometer, and a dripping funnel was put 1,900 ml of the aforesaid 15 percent by weight water-based polyester A-1 solution, and the interior temperature was raised to 80° C., while rotating the stirring blades. Into this was added 6.52 ml of a 24 percent aqueous ammonium peroxide solution, and a monomer mixed liquid composition (consisting of 28.5 g of glycidyl methacrylate, 21.4 g of ethyl acrylate, and 21.4 g of methyl methacrylate) was dripped over a period of 30 minutes, and reaction was allowed for an additional 3 hours. Thereafter, the resulting product was cooled to at most 30° C., and filtrated, whereby modified water-based polyesters solution B-1 (vinyl based component modification ratio of 20 percent by weight) of 18 wt % solid was obtained.

Subsequently, modified water-based polyester B-2 at a solid concentration of 18 percent by weight (a vinyl based component modification ratio of 20 percent by weight) was prepared in the same manner as above except that the vinyl modification ratio was changed to 36 percent by weight and the modified component was changed to styrene:glycidyl methacrylate:acetacetoxyethyl methacrylate:n-butyl acrylate=39.5:40:20:0.5.

Preparation of Acryl Based Polymer Latexes C-1 to C-3

Acryl based polymer latexes C-1 to C-3 having the monomer compositions shown in Table 1 were synthesized employing emulsion polymerization. All the solid concentrations were adjusted to 30 percent by weight.

TABLE 1

| Latex No. | Monomer Composition (weight ratio) | Tg (° C.) |
|---|---|---|
| C-1 | styrene:glycidyl methacrylate:n-butyl acrylate = 20:40:40 | 20 |
| C-2 | styrene:n-butyl acrylate:t-butyl acrylate:hydroxyethyl methacrylate = 27:10:35:28 | 55 |
| C-3 | styrene:glycidyl methacrylate: acetacetoxyethyl methacrylate = 40:40:20 | 50 |

An antihalation layer having the composition described below was applied onto subbing layer A-2 on the subbed support.

Antihalation Layer Coating Composition

| | |
|---|---|
| Binder: PVB-1*[2] | 0.8 g/m$^2$ |
| Dye: C1 | $1.2 \times 10^{-5}$ mol/m$^2$ |

*[2]Binder was prepared by dissolving polyvinyl butyral (PVB-1) in methyl ethyl ketone (MEK). PVB-1 was prepared polyvinyl acetate of a polymerization degree of 500 was saponified up to 98% and 86% of the remaining hydroxyl group was butyralized.

Backing Layer and Protective Layer

Coating compositions of a backing layer and its protective layer which were prepared to achieve a coated amount (per m$^2$) described below was successively applied onto the subbing upper layer B-2 and subsequently dried, whereby a a backing layer and a protective layer were formed.

Backing Layer Coating Composition

| | |
|---|---|
| PVB-1 (binding agent) | 1.8 g |
| C1 (dye) | $1.2 \times 10^{-5}$ mol |

Protective Layer Coating Composition)

| | |
|---|---|
| Cellulose acetate butyrate | 1.1 g |
| Matting agent (polymethyl methacrylate of an average particle size of 5 μm) | 0.12 g |
| Antistatic agent F-EO | 250 mg |
| Antistatic agent F-DS1 | 30 mg |

Surfactant (A)

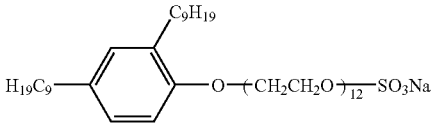

C1 (Dye)

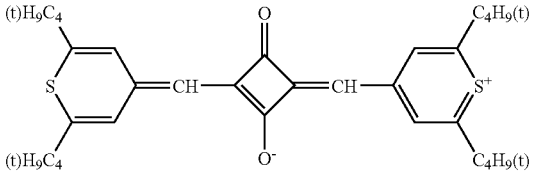

F-EO

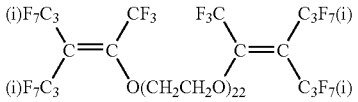

F-DS1

Preparation of Silver Halide Emulsion 1

| | |
|---|---|
| Solution A1 | |
| Phenylcarbamoyl-modified gelatin | 88.3 g |
| Compound*[3] (10% aqueous methanol solution) | 10 ml |
| Potassium bromide | 0.32 g |
| Water to make | 5429 ml |
| Solution B1 | |
| 0.67 mol/L aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| $K_3IrCl_6$ (equivalent to $4 \times 10^{-5}$ mol/Ag) | 50.0 ml |
| Water to make | 1982 ml |
| Solution E1 | |
| 0.4 mol/L aqueous potassium bromide solution in an amount to control silver potential | |

-continued

| | |
|---|---|
| Solution F1 | |
| Potassium hydroxide | 0.71 g |
| Water to make | 20 ml |
| Solution G1 | |
| 56% aqueous acetic acid solution | 18.0 ml |
| Solution H1 | |
| Sodium carbonate anhydride | 1.72 g |
| Water to make | 151 ml |

*[3]Compound A: $HO(CH_2CH_2O)_n(CH(CH_3)CH_2O)_{17}(CH_2CH_2O)_mH$ (m + N = 5 through 7)

Upon employing a mixing stirrer shown in JP-B Nos. 58-58288 and 58-58289, ¼ portion of solution B1 and whole solution C1 were added to solution A1 over 4 minutes 45 seconds, employing a double-jet precipitation method while adjusting the temperature to 30° C. and the pAg to 8.09, whereby nuclei were formed. After one minute, whole solution F1 was added. During the addition, the pAg was appropriately adjusted employing Solution E1. After 6 minutes, ¾ portions of solution B1 and whole solution D1 were added over 14 minutes 15 seconds, employing a double-jet precipitation method while adjusting the temperature to 30° C. and the pAg to 8.09. After stirring for 5 minutes, the mixture was cooled to 40° C., and whole solution G1 was added, whereby a silver halide emulsion was flocculated. Subsequently, while leaving 2000 ml of the flocculated portion, the supernatant was removed, and 10 L of water was added. After stirring, the silver halide emulsion was again flocculated. While leaving 1,500 ml of the flocculated portion, the supernatant was removed. Further, 10 L of water was added. After stirring, the silver halide emulsion was flocculated. While leaving 1,500 ml of the flocculated portion, the supernatant was removed. Subsequently, solution H1 was added and the resultant mixture was heated to 60° C., and then stirred for an additional 120 minutes. Finally, the pH was adjusted to 5.8 and water was added so that the weight was adjusted to 1,161 g per mol of silver, whereby an emulsion was prepared.

The prepared emulsion was comprised of monodisperse cubic silver iodobromide grains having an average grain size of 0.040 μm, a grain size variation coefficient of 12 percent and a (100) crystal face ratio of 92 percent.

Preparation of Aliphatic Carboxylic Acid Silver Salt A

In 4,720 ml of pure water were dissolved 117.7 g of behenic acid, 60.9 g of arachidic acid, 39.2 g of stearic acid, and 2.1 g of palmitic acid at 80° C. Subsequently, 486.2 ml of a 1.5 M aqueous sodium hydroxide solution was added, and further, 6.2 ml of concentrated nitric acid was added. Thereafter, the resultant mixture was cooled to 55° C., whereby an aliphatic acid sodium salt solution was prepared. After 347 ml of t-butyl alcohol was added and stirred for 20 min, the above-described photosensitive silver halide emulsion 1 as well as 450 ml of pure water was added and stirred for 5 minutes.

Subsequently, 702.6 ml of one mol silver nitrate solution was added over two minutes and stirred for 10 minutes, whereby an aliphatic carboxylic acid silver salt dispersion was prepared. Thereafter, the resultant aliphatic carboxylic acid silver salt dispersion was transferred to a water washing machine, and deionized water was added. After stirring, the resultant dispersion was allowed to stand, whereby a flocculated aliphatic carboxylic acid silver salt was allowed to float and was separated, and the lower portion, containing water-soluble salts, were removed. Thereafter, washing was repeated employing deionized water until electric conductivity of the resultant effluent reached 50 μS/cm. After centrifugal dehydration, the resultant cake-shaped aliphatic carboxylic acid silver salt was dried employing an gas flow type dryer Flush Jet Dryer (manufactured by Seishin Kigyo Co., Ltd.), while setting the drying conditions such as nitrogen gas as well as heating flow temperature at the inlet of the dryer, until its water content ratio reached 0.1 percent, whereby powdery aliphatic carboxylic acid silver salt A was prepared. The water content ratio of aliphatic carboxylic acid silver salt compositions was determined employing an infrared moisture meter.

A silver salt conversion ratio of the aliphatic carboxylic acid was confirmed to be about 95%, measured by the above-described method.

Preparation of Preliminary Dispersion A

In 1457 g of methyl ethyl ketone (hereinafter referred to as MEK) was dissolved 14.57 g of poly(vinyl butyral) resin P-9. While stirring, employing dissolver DISPERMAT Type CA-40M, manufactured by VMA-Getzmann Co., 500 g of aforesaid Powder Aliphatic Carboxylic Acid Silver Salt A was gradually added and sufficiently mixed, and Preliminary Dispersion A was thus prepared.

Preparation of Photosensitive Emulsion A

Preliminary dispersion A, prepared as above, was charged into a media type homogenizer DISPERMAT Type SL-C12EX (manufactured by VMA-Getzmann Co.), filled with 0.5 mm diameter zirconia beads (Toreselam, produced by Toray Co.) so as to occupy 80 percent of the interior volume so that the retention time in the mill reached 1.5 minutes and was dispersed at a peripheral rate of the mill of 8 m/second, whereby photosensitive emulsion A was prepared.

Preparation of Stabilizer Solution

Stabilizer solution was prepared by dissolving 1.0 g of stabilizer 1 and 0.31 g of potassium acetate in 4.97 g of methanol.

Preparation of Infrared Sensitizing Dye A Solution

Infrared sensitizing dye A solution was prepared by dissolving 19.2 mg of infrared sensitizing dye 1, 10 mg of infrared sensitizing dye 2, 1.48 g of 2-chloro-benzoic acid, 2.78 g of stabilizer 2, and 365 mg of 5-methyl-2-mercapto-benzimidazole in 31.3 ml of MEK in a dark room.

Preparation of Additive Solution "a"

Additive solution "a" was prepared by dissolving 27.98 g of 1,1-bis(2-hydroxy-3,5-dimethylphenyl)-3,5,5-trimethylhexane (Developing Agent A) and 1.54 g of 4-methylphthalic acid, and 0.20 g of aforesaid infrared dye 1 in 110 g of MEK.

Preparation of Additive Solution "b"

Additive Solution "b" was prepared by dissolving 3.56 g of Antifoggant 2 and 3.43 g of phthalazine in 40.9 g of MEK.

Preparation of Light-Sensitive Layer Coating Composition A

While stirring, 50 g of aforesaid light-sensitive emulsion A and 15.11 g of MEK were mixed and the resultant mixture was maintained at 21° C. Subsequently, 390 μl of antifoggant 1 (being a 10 percent methanol solution) was added and stirred for one hour. Further, 494 μl of calcium bromide (being a 10 percent methanol solution) was added and stirred for 20 minutes. Subsequently, 167 ml of aforesaid stabilizer solution was added and stirred for 10 minutes. Thereafter, 1.32 g of the foregoing infrared sensitizing dye A was added and the resulting mixture was stirred for one hour. Subsequently, the resulting mixture was cooled to 13° C. and stirred for an additional 30 minutes. While maintaining at 13° C., 13.31 g of poly(vinyl acetal) resin P-1 as a binder was added and stirred for 30 minutes. Thereafter, 1.084 g of tetrachlorophthalic acid (being a 9.4 weight percent MEK solution) was added and stirred for 15 minutes. Further, while stirring, 12.43 g of additive solution "a", 1.6 ml of Desmodur N300/aliphatic isocyanate, manufactured by Mobay Chemical Co. (being a 10 percent MEK solution), and 4.27 g of additive solution "b" were successively added, whereby light-sensitive layer coating composition A was prepared.

Preparation of Surface Protective Layer Coating Composition

The coating composition having the formulation described below was prepared in the same manner as the foregoing light-sensitive layer coating composition and was subsequently applied onto a photosensitive layer to result in the coated amount (per $m^2$) below, and subsequently dried, whereby a photosensitive layer protective layer was formed.

| | |
|---|---|
| Cellulose acetate propionate | 2.0 g |
| 4-Methyl phthalate | 0.7 g |
| Tetrachlorophthalic acid | 0.2 g |
| Tetrachlorophthalic anhydride | 0.5 g |
| Silica matting agent (at an average diameter of 5 μm) | 0.5 g |
| 1,3-bis(vinylsulfonyl)-2-propanol | 50 mg |
| Benzotriazole | 30 mg |
| Antistatic Agent: F-EO | 20 mg |
| Antistatic Agent: F-DS1 | 3 mg |

Preparation of Light-insensitive Layer Coating Composition

Into 955 g of methyl ethyl ketone (MEK) was added 88.7 g of butyral resin with stirring and dissolved to prepare a coating composition of a light-insensitive layer provided between the light-sensitive layer and the support.

Preparation of Photothermographic Material

Light-sensitive layer coating composition A and surface protective layer coating composition, prepared as above, were simultaneously coated onto the subbing layer on the support prepared as above, employing a prior art extrusion type coater, and sample 101 was prepared. Coating was performed so that the thickness of the light-insensitive layer was 3.7 μm, the coated silver amount of the photosensitive layer was 1.5 g/$m^2$ and the thickness of the surface protective layer reached 2.5 μm after drying. Thereafter, drying was performed employing a drying air flow at a temperature of 75° C. and a dew point of 10° C. for 10 minutes, and photothermographic material sample 101 was thus obtained.

Preparation of Photothermographic Material Sample 102 to 119

Photothermographic material samples 102 to 119 were prepared similarly to the foregoing sample 101, provided that silver halide emulsion 1 was replaced by silver halide emulsions prepared according to the manner described below, as shown in Table 3, and dye microcapsules were incorporated to the light-insensitive layer in the combination shown in Table 3. In photothermographic materials in which dye microcapsules were incorporated, a dye was removed from the solution a to be added to the light-sensitive layer coating composition.

Light-insensitive layer coating composition containing a microcapsule was prepared in the following manner. Into 955 g of methyl ethyl ketone (MEK), 88.7 g of a butyral resin was added and dissolved with stirring, and to the thus obtained solution, each of powdery microcapsules was added so as to have a dye content of 6 g/m$^2$ and sufficiently stirred to obtain coating composition of a light-insensitive layer.

Preparation of Silver Halide Emulsion 2

Light-sensitive silver halide emulsion 2 was prepared in the same manner as the foregoing silver halide emulsion 1, except that 5 ml of an aqueous 0.4% lead bromide solution was added to solution D1. The prepared emulsion was comprised of monodisperse cubic silver iodobromide grains having an average grain size of 0.042 μm, a coefficient of variation of grain size of 13% and a (100) face ratio of 94%.

Preparation of Silver Halide Emulsion 3

Light-sensitive silver halide emulsion 3 was prepared in the same manner as the foregoing silver halide emulsion 1, except that after nucleus formation, all solution F1 was added, and subsequently 40 ml of an aqueous 5% 4-hydroxy-6-methyl-1,3,3a,7-tetraazaindene solution was added. The thus prepared emulsion was comprised of monodisperse cubic silver iodobromide grains having an average grain size of 0.041 μm, a coefficient of variation of grain size of 14% and a (100) face ratio of 93%.

Preparation of Silver Halide Emulsion 4

Light-sensitive silver halide emulsion 4 was prepared in the same manner as the foregoing silver halide emulsion 1, except that after nucleus formation, all solution F1 was added, and subsequently 4 ml of a 0.1% ethanol solution of ETTU (indicated below) was added. The thus prepared emulsion was comprised of monodisperse cubic silver iodobromide grains having an average grain size of 0.042 μm, a coefficient of variation of grain size of 10% and a (100) face ratio of 94%.

Preparation of Silver Halide Emulsion 5

Light-sensitive silver halide emulsion 5 was prepared in the same manner as the foregoing silver halide emulsion 1, except that after nucleus formation, all solution F1 was added, and subsequently 4 ml of a 0.1% ethanol solution of 1,2-benzothiazoline-3-one was added. The thus prepared emulsion was comprised of monodisperse cubic silver iodobromide grains having an average grain size of 0.041 μm, a coefficient of variation of grain size of 11% and a (100) face ratio of 93%.

Preparation of Silver Halide Emulsion 6

Light-sensitive silver halide emulsion 6 was prepared in the same manner as the foregoing silver halide emulsion 1, except that the temperature before adding the solution (G1) was changed to 60° C., and after nucleus formation, all solution F1 was added and subsequently 4 ml of a 0.1% ethanol solution of a compound (ETTU) described below was added. The thus prepared emulsion was comprised of monodisperse cubic silver iodobromide grains having an average grain size of 0.080 μm, a coefficient of variation of grain size of 12% and a (100) face ratio of 93%.

Preparation of Silver Halide Emulsion 7

Light-sensitive silver halide emulsion 6 was prepared in the same manner as the foregoing silver halide emulsion 6, except that after nucleus formation, the compound (ETTU) was not added. The thus prepared emulsion was comprised of monodisperse cubic silver iodobromide grains having an average grain size of 0.082 μm, a coefficient of variation of grain size of 14% and a (100) face ratio of 91%.

Stabilizer 1

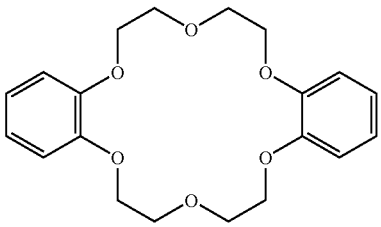

Antifoggant 1

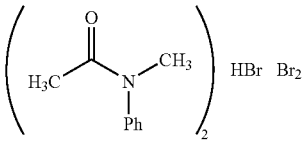

ETTU

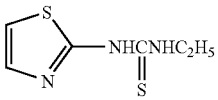

Stabilizer 2

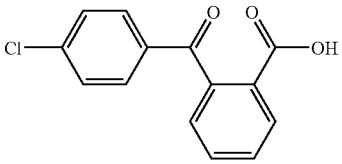

Antifoggant 2

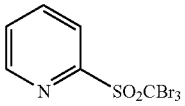

Infrared sensitizing dye 1

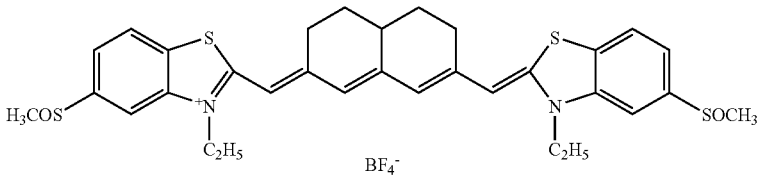

-continued

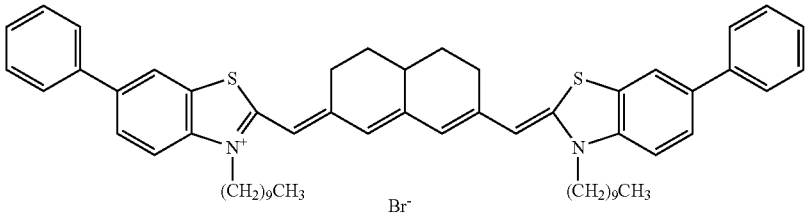

Infrared senstizing dye 2

Preparation of Dye Microcapsule 1

To 23.88 g of ethyl acetate was added 0.11 g of exemplified dye compound 1—1 with stirring and it was confirmed that no precipitate was observed even when stirring was stopped. Then, 1.01 g of a butyral resin (Buttvar B-79) was added thereto and completely dissolved.

Separately, 1.25 g of gelatin (Miyagi Gelatin: 09YR-30) was dissolved in 47.5 g of pure water and after adding 1.25 g of an aqueous 10% surfactant solution (Sanyo Kasei: Sanmorin OT-70), ethyl acetate solution containing the dye and butyral resin was gradually added thereto and continuously dispersed for 10 min. using an ultrasonic dispersing machine to obtain a slightly turbid dispersion. Further thereto, 50 g of an aqueous 2.5% gum arabic solution was added and stirred for 2 min. The thus obtained dispersion was distilled under reduced pressure using a rotary evaporator until all odor of ethyl acetate disappeared to obtain a clear aqueous dispersion. The average particle size of the aqueous dispersion was 200 nm. Then, 5% acetic acid was added to the aqueous dispersion and the pH was adjusted to 3.5 to cause coacervation to achieve microcapsulation. A compound (glutar aldehyde) which is reactive to gelatin was added thereto to result in a concentration of 10% solids, based on the total quantity and reacted at 50° C. for 4 hrs. Thereafter, the mixture was washed three times with water by decantation, and 10 g of colloidal silica (PL-2, produced by Fuso Kagaku Kogyo Co., Ltd.) having a salt concentration of less than 1 ppm, was stirred and dried by a spray dryer to obtain powdery dye microcapsule 1.

Preparation of Dye Microcapsule 2 to 10

Powdery dye microcapsules 2 to 10 having an average particle size as shown in Table 2 were each prepared similarly to the foregoing dye microcapsule 1, except that the kind of dye, the kind of water-soluble resin, the kind of reactive compound, the presence/absence of colloidal silica and the dispersing condition were varied as shown in Table 2.

Preparation of Dye Microcapsule 11

To 23.88 g of ethyl acetate was added 0.11 g of exemplified dye compound 1—1 with stirring and it was confirmed that no precipitate was observed even when stirring was stopped. Then, 1.01 g of a butyral resin (Buttvar B-79) was added thereto and allowed to completely dissolve.

Separately, 1.25 g of gelatin (Miyagi Gelatin: 09YR-30) was dissolved in 47.5 g of pure water and after adding 1.25 g of an aqueous 10% surfactant solution (Sanyo Kasei: Sanmorin OT-70), an ethyl acetate solution of the dye and butyral resin was gradually added thereto and continuously dispersed for 10 min. using an ultrasonic dispersing machine to obtain a slightly turbid dispersion. Further thereto, 50 g of an aqueous 2.5% gum arabic solution was added and stirred for 2 min. The thus obtained dispersion was distilled under reduced pressure using a rotary evaporator until all odor of ethyl acetate disappeared to obtain a clear aqueous dispersion. The average particle size of the aqueous dispersion was 500 nm. Then, 10 g of colloidal silica (PL-2, produced by Fuso Kagaku Kogyo Co., Ltd.) having a salt concentration of less than 1 ppm, was stirred and dried by a spray dryer to obtain powdery dye microcapsule 11.

Evaluation of Dispersibility of Dye Microcapsule

The thus prepared powdery dye capsules were each dispersed in MEK at a 1% concentration and their dispersibility was visually evaluated based on the following criteria. Absorption of the individual dyes in a solid state was shifted to the longer wavelength side than in a solution state so that comparing with spectral absorption of a dye of raw material, one which had the dye absorption shifted to the longer wavelength side, was judged as being dispersed and one having no shift was judged as being dissolved.

5: having been easily dispersed only by stirring with a magnetic stirrer,

4: having been dispersed by applying ultrasonic for 1 min. using an ultrasonic dispersing machine, 3: having been dispersed by applying ultrasonic for 3 min. using an ultrasonic dispersing machine, 2: having been dispersed by applying ultrasonic for at least 30 min. using an ultrasonic dispersing machine, 1: having been dissolved by stirring with a magnetic stirrer.

The main constitutions of the prepared microcapsules and evaluation results of average particle size and dispersibility are shown in Table 2.

TABLE 2

| | Dye Microcapsule Constitution | | | | | | |
|---|---|---|---|---|---|---|---|
| Dye Microcapsule No. | Dye | Water-soluble Resin | Colloidal Silica | Reactive Compound | Time of Capsulation Average | Particle Size (μm) | Dispersibility |
| 1 | 1-1 | Gel/GA*1 | Yes | A*3 | Before drying | 200 | 5 |
| 2 | 1-1 | — | — | — | — | — | 1 |

TABLE 2-continued

| Dye Microcapsule No. | Dye Microcapsule Constitution: Dye | Water-soluble Resin | Colloidal Silica | Reactive Compound | Time of Capsulation Average | Particle Size (μm) | Dispersibility |
|---|---|---|---|---|---|---|---|
| 3 | 1-1 | — | Yes | — | — | — | 1 |
| 4 | 1-1 | Gel/GA*1 | Yes | — | Before drying | 200 | 3 |
| 5 | 1-1 | Gel/GA*1 | Yes | — | Before drying | 200 | 3 |
| 6 | 1-1 | Gel/GA*1 | Yes | A*3 | Before drying | 200 | 5 |
| 7 | 1 | Gel/GA*1 | Yes | A*3 | Before drying | 200 | 5 |
| 8 | 1-1 | Gel*2 | Yes | A*3 | Before drying | 230 | 5 |
| 9 | 1-1 | Gel/GA*1 | Yes | — | Before drying | 350 | 3 |
| 10 | 1-1 | Gel/GA*1 | Yes | B*4 | Before drying | 200 | 5 |
| 11 | 1-1 | Gel/GA*1 | Yes | — | Before drying | 5000 | 3 |

*1Gelatin/Gum arabic
*2Gelatin
*3Glutar aldehyde
*4Vinylsulfone 1
Vinylsulfone 1
$(CH_2{=}CHSO_2CH_2CONHCH_2)_2$ As apparent from Table 2, it was proved that dye microcapsules according to this invention exhibited superior dispersibility. It was also observed that microcapsule No. 2 and 3 were dissolved by stirring with a magnetic stirrer. Thus, it was contemplated that no micro-encapsulation was performed in the dispersion 2 and 3.

Evaluation of Photothermographic Material

Exposure and Processing

Scanning exposure was applied onto the emulsion side surface of each sample prepared as above, employing an exposure apparatus in which a semiconductor laser, which was subjected to a longitudinal multi-mode at a wavelength of 800 to 820 nm, employing high frequency superposition, was employed as a laser beam source. In such a case, images were formed while adjusting the angle between the exposed surface of the sample and the exposure laser beam to 75 degrees. By employing such a method, compared to the case in which the angle was adjusted to 90 degrees, images were obtained with minimized unevenness and which exhibited surprisingly excellent sharpness.

Thereafter, while employing an automatic processor having a heating drum, the protective layer of each sample was brought into contact with the surface of the drum and thermal development was carried out at 110° C. for 15 sec. In such a case, exposure as well as development was carried out in an atmosphere which was maintained at 23° C. and 50% relative humidity.

Sensitivity, Fog and Maximum Density

The visual transmission density of the resulting silver images formed as above was measured employing a transmission type densitometer (PDA-65, produced by Konica Minolta Corp.) and characteristic curves were prepared in which the abscise shows the exposure amount and the ordinate shows the density. Utilizing the resulting characteristic curve, sensitivity (also denoted simply as "S") was defined as the reciprocal of an exposure amount to give a density higher 1.0 than the unexposed area, and fog density (also denoted simply as Dmin) as well as maximum density (also denoted simply as "Dmax) was determined. The sensitivity and the maximum density were represented by a relative value, based on each of the sensitivity and the maximum density of Sample 101 being 100.

Image Lasting Quality

Each of thermally developed samples, which had been prepared in the same manner as for the foregoing sensitivity determination, was allowed to stand for three days at 45° C. and 55% RH while a commercially available fluorescent lamp was arranged so as to give an illuminance of 500 lux on the surface of each sample. The minimum density (D2) of each of the fluorescent light-exposed samples and the minimum density. (D1) of each of the fluorescent light-unexposed samples were determined, and the variation rate (in percent) of minimum density was calculated based on the formula described below.

$$\text{Variation ratio of minimum density } (\Delta Dmin) = D2/D1 \times 100\ (\%)$$

Each of thermally developed samples, which had been prepared in the same manner as the determination of the variation ratio of minimum density, was allowed to stand for three days at 25° C. and 45° C. Thereafter, the variation of the maximum density was determined, and the variation rate of image density was determined based on the formula described below, which was utilized as the scale of the image lasting quality.

$$\text{Variation rate of maximum density } (\Delta Dmax) = \text{maximum density of the sample aged at } 45°\text{C.}/\text{maximum density of the sample aged at } 25°\text{C.} \times 100\ (\%)$$

Image Color Tone

Employing a thermal development apparatus, a 4-step wedge sample including an unexposed portion, and optical densities of 0.5, 1.0, and 1.5 was prepared. Each of the density portions of the wedge, prepared as above, was determined employing CM-3600d (manufactured by Minolta Co., Ltd.), and either u* and v* or a* and b* were calculated. When determined, measurement conditions were such that F7 light source was used as a light source, and a transmission measurement mode was employed at a visual field angle of 10 degrees. Subsequently, measured u* and v* or measured a* and b* were plotted on a graph in which u* or a* was used as the abscissa, while v* or b* was used as the ordinate, and a linear regression line was obtained. The coefficient of determined value $R^2$, intercepts and gradients were then obtained.

The obtained results are shown in Table 3.

TABLE 3

| Sample No. | AgX No.*[1] | Microcapsule No. | Dmin | S | Dmax | Image Lasting Quality ΔDmin | ΔDmax | Remark |
|---|---|---|---|---|---|---|---|---|
| 101 | 1 | — | 0.204 | 100 (30) | 100 | 135 | 81 | Comp. |
| 102 | 4 | — | 0.205 | 146 (38) | 125 | 125 | 87 | Comp. |
| 103 | 1 | 1 | 0.201 | 127 (30) | 110 | 130 | 85 | Comp. |
| 104 | 2 | 1 | 0.187 | 138 (14) | 122 | 107 | 95 | Inv. |
| 105 | 3 | 1 | 0.188 | 139 (15) | 123 | 107 | 95 | Inv. |
| 106 | 4 | 1 | 0.189 | 192 (14) | 136 | 105 | 96 | Inv. |
| 107 | 5 | 1 | 0.191 | 191 (16) | 137 | 106 | 97 | Inv. |
| 108 | 4 | 2 | 0.201 | 149 (30) | 123 | 121 | 89 | Comp. |
| 109 | 4 | 3 | 0.201 | 148 (29) | 122 | 120 | 89 | Comp. |
| 110 | 4 | 4 | 0.189 | 190 (13) | 135 | 106 | 95 | Inv. |
| 111 | 4 | 5 | 0.189 | 189 (13) | 134 | 106 | 94 | Inv. |
| 112 | 4 | 6 | 0.189 | 191 (12) | 134 | 107 | 94 | Inv. |
| 113 | 4 | 7 | 0.189 | 190 (11) | 132 | 106 | 93 | Inv. |
| 114 | 4 | 8 | 0.189 | 190 (10) | 133 | 106 | 95 | Inv. |
| 115 | 4 | 9 | 0.189 | 188 (11) | 134 | 107 | 93 | Inv. |
| 116 | 4 | 10 | 0.189 | 189 (10) | 134 | 108 | 94 | Inv. |
| 117 | 4 | 11 | 0.201 | 149 (28) | 122 | 121 | 89 | Comp. |
| 118 | 6 | 1 | 0.191 | 66 (11) | 82 | 107 | 95 | Inv. |
| 119 | 7 | 1 | 0.203 | 100 (26) | 100 | 132 | 87 | Comp. |

*[1]Silver halide emulsion

As is apparent from Table 3, it was proved that silver salt photothermographic material samples which contained a dye microcapsule in the light-insensitive layer, exhibited reduced fogging (minimum density), enhanced sensitivity and maximum density and superior image lasting quality, compared to comparative samples.

Further, in the image color tone evaluation of the samples according to this invention, the coefficient of determination value $R^2$ was from 0.998 to 1.000; b* value of the intersection of the aforesaid linear regression line with the ordinate was from −5 to +5; gradient (b*/a*) was from 0.7 to 2.5, confirming that superior image color tone was achieved.

Example 2

Photothermographic material samples 201 to 207 were prepared similarly to photothermographic material sample 101 to 107 of Example 1, provided that silver halide emulsions used in the light-sensitive layer coating compositions were chemically sensitized in the following manner.

While stirring, 50 g of the foregoing light-sensitive emulsion A of Example 1 and 15.11 g of MEK were mixed and the resultant mixture was maintained at 21° C. Subsequently, 390 μl of antifoggant 1 (10 percent methanol solution) was added and stirred for one hour. Then, 240 ml of sulfur sensitizer S-4 (10% methanol solution) was added thereto and stirred at 21° C. for 1 hr. to perform chemical sensitization. Further, 494 μl of calcium bromide (10 percent methanol solution) was added and stirred for 20 minutes. Subsequently, 167 ml of aforesaid stabilizer solution was added and stirred for 10 minutes. Thereafter, 1.32 g of aforesaid infrared sensitizing dye A was added and the resulting mixture was stirred for one hour. Subsequently, the resulting mixture was cooled to 13° C. and stirred for an additional 30 minutes. While maintaining at 13° C., 13.31 g of poly(vinyl acetal) resin P-1 as a binder was added and stirred for 30 minutes. Thereafter, 1.084 g of tetrachlorophthalic acid (9.4 weight percent MEK solution) was added and stirred for 15 minutes. Further, while stirring, 12.43 g of additive solution "a", 1.6 ml of Desmodur N300/aliphatic isocyanate, manufactured by Mobay Chemical Co. (10 percent MEK solution), and 4.27 g of additive solution "b" were successively added, whereby coating compositions of the respective light-sensitive layers were prepared.

Sulfur sensitizer S-5

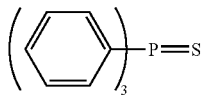

Similarly to Example 1, the thus prepared photothermographic material samples were exposed, processed and evaluated with respect to sensitivity, fog density (minimum density), maximum density and image lasting quality. The obtained results are shown in Table 4. Sensitivity and maximum density were represented by relative values, based on each of the sensitivity and maximum density of sample 201 being 100.

TABLE 4

| Sample No. | AgX No.*1 | Microcapsule No. | Dmin | S | Dmax | Image Lasting Quality ΔDmin | ΔDmax | Remark |
|---|---|---|---|---|---|---|---|---|
| 201 | 1 | — | 0.205 | 100 (35) | 100 | 150 | 74 | Comp. |
| 202 | 4 | — | 0.208 | 145 (40) | 122 | 155 | 71 | Comp. |
| 203 | 1 | 1 | 0.201 | 121 (33) | 110 | 148 | 72 | Comp. |
| 204 | 2 | 1 | 0.190 | 137 (14) | 119 | 107 | 92 | Inv. |
| 205 | 3 | 1 | 0.190 | 136 (15) | 120 | 107 | 93 | Inv. |
| 206 | 4 | 1 | 0.191 | 200 (14) | 141 | 105 | 95 | Inv. |
| 207 | 5 | 1 | 0.192 | 198 (16) | 137 | 106 | 93 | Inv. |

*1Silver halide emulsion

As apparent from Table 4, it was proved that even when silver halide emulsions were chemically sensitized, photothermographic material samples containing a dye capsule in the light-insensitive layer, exhibited reduced fogging (minimum density, equal or enhanced sensitivity and maximum density and superior image lasting quality.

It was also proved that even when chemical sensitization of silver halide emulsions was conducted by adding 240 ml of sulfur sensitizer S-5 (0.5% methanol solution) after completion of the final stage of emulsion making and ripening the emulsion for 120 min. at 55° C., and separately prepared aliphatic carboxylic acid silver salt was added thereto, the obtained photothermographic material samples exhibited similar results.

Further, in the image color tone evaluation of the samples according to this invention, the coefficient of determination value $R^2$ was 0.998 to 1.000; b* value of the intersection of the aforesaid linear regression line with the ordinate was from −5 to +5; gradient (b*/a*) was from 0.7 to 2.5, confirming that superior image color tone was obtained.

Example 3

Preparation of Support

Using terephthalic acid and ethylene glycol, PET of an intrinsic viscosity (IV) of 0.66 (determined in phenol/tetrachloroethane of 6/4 in weight ratio, at 25° C.) was prepared. After pelletizing the resulting PET, the resulting pellets were dried at 130° C. for 4 hours. The dried pellets were melted at 300° C., then extruded employing a T type die, subsequently rapidly cooled, and thermally fixed, whereby a 175 μm thick film, which had not been yet oriented, was prepared.

The resulting film was vertically stretched at a factor of 3.3 employing rollers at different peripheral rates and then laterally stretched at a factor of 4.5 employing a tenter. During stretching, temperatures were 110° C. and 130° C., respectively. Thereafter, thermal fixation was performed at 240° C. for 20 seconds and then 4 percent vertical relaxation was performed. After slitting off the chucked tenter portion, both ends were subjected to knurling. The resulting film was wound at 4 kg/cm$^2$, whereby a roll of the 175 μm thick film was prepared.

The surface of the support was subjected to corona discharge treatment as follows. Employing Solid State Corona Processor Model 6 KVA, manufactured by Piller Inc., both surfaces of a support were treated at a rate of 20 m/minute at room temperature. During this operation, it was noted that the support was subjected to a treatment of 0.375 kV·A·minute/m$^2$ based on the read value of voltage, treatment frequency was 9.6 kHz, and gap clearance between the electrode and the dielectric roller was 1.6 mm.

The support was further subbed in the following manner.

| Photosensitive Layer Side Subbing Layer Coating Composition | |
|---|---|
| Pesresin A-520, manufactured by Takamatsu Oil & Fat Co., Ltd. (at 30% by weight solution) | 59 g |
| 10% by weight polyethylene glycol monononyl phenyl ether (at an average ethylene oxide number of 8.5) | 5.4 g |
| MP-1000 (minute polymer particles at an average particle diameter of 0.4 μm), manufactured by Soken Chemical & Engineering Co., Ltd. | 0.91 g |
| Distilled water | 935 ml |
| **Back Layer Side First Layer Coating Composition** | |
| Styrene-butadiene copolymer latex (at 40% by weight solids, and a styrene/butadiene weight ratio of 68/32) | 158 g |
| 8% by weight aqueous solution of 2,4-dichloro-6-hydroxy-s-triazine sodium salt | 20 g |
| 1% by weight aqueous sodium laurylbenznesulfonate solution | 10 ml |
| Distilled water | 854 ml |
| **Back Layer Side Second Layer Coating Composition** | |
| $SnO_2$/Sb (17% by weight dispersion at a weight ratio of 9/1, an average particle diameter of 0.038 μm) | 84 g |
| Gelatin (10% aqueous solution) | 89.2 g |
| Metorose TC-5 (2% by weight aqueous solution), manufactured by Shin-Etsu Chemical Co., Ltd. | 8.6 g |
| MP-1000, manufactured by Soken Chemical & Engineering Co., Ltd. | 0.01 g |
| 1% by weight aqueous dodecyl-benzenesulfonate solution | 10 ml |
| NaOH (1% by weight) | 6 ml |
| Proxel (manufactured by ICI Co.) | 1 ml |
| Distilled water | 805 ml |

After applying the aforesaid corona treatment to both sides of the aforesaid 175 μm thick biaxially oriented polyethylene terephthalate support, the aforesaid subbing liquid coating composition formulation was applied onto one side (a photosensitive layer surface) employing a wire bar to result in a wet coated amount of 6.6 ml/m$^2$ (per side), and the resulting coating was dried at 180° C. for 5 minutes. Subsequently, the aforesaid subbing liquid coating composition formulation was applied onto the reverse side (the back surface) employing a wire bar to result in a wet coated amount of 5.7 ml/m$^2$, and the resulting coating was dried at 180° C. for 5 minutes. Further, the foregoing subbing liquid coating composition formulation was applied onto the reverse surface (the back surface) to result in a wet coated amount of 7.7 ml/$m^2$, and the resulting coating was dried at 180° C. for 6 minutes, whereby a subbed support was prepared.

There was prepared a solid particle dispersion of a base precursor, as follows. Added to distilled water were 1.5 kg of Base Precursor Compond-1, 225 g of a surfactant (registered trade name: Demol N, manufactured by Kao Corp.), 937.5 g diphenylsulfone, and 15 g of parahydroxybenzoic acid butyl ester (registered trade name: Mekkins, manufactured by Ueno Fine Chemicals Industry, Ltd.). While mixing, the total weight was made to 5.0 kg by the addition of distilled water. The resulting mixed liquid composition was subjected to bead dispersion employing a horizontal sand mill (UVM-2, manufactured by IMEX Co., Ltd.). The dispersion method was such that the mixed liquid composition was transferred to UVM-2 filled with 5 mm zirconia beads, employing a diaphragm pump, and dispersion was performed under an interior pressure of at least 50 hPa until the desired average particle diameter was obtained.

The spectral absorption of the resulting dispersion was monitored and dispersion was performed until the ratio (D450/D650) of absorbance at 450 nm of the dispersion to absorbance at 650 nm of the same reached at least 2.2. The resulting dispersion was diluted by the addition of distilled water to reach 20% by weight of the concentration of the Base Precursor. In order to remove dust, the resulting dispersion was filtered employing a filter (polypropylene filter of an average pore diameter of 3 μm) and then employed in practice.

A solid dye particle dispersion was prepared in the following manner. Mixed with distilled water were 6.0 kg of cyanine dye compound-1, 3.0 kg of sodium p-dodecylbenznesulfonate, 0.6 kg of surface active agent Demol SNB, manufactured by Kao Corp., and 0.15 kg of a defoamer (registered trade name Surfinol 104E, manufactured by Nissin Chemical Industry Co., Ltd.), and the total weight was made to 60 kg.

The resulting mixed liquid composition was dispersed using zirconia beads in a horizontal sand mill (UVM-2, manufactured by IMEX Co., Ltd.). The spectral absorption of the resulting dispersion was monitored and dispersion was performed until the ratio (D650/D750) of absorbance at 650 nm of the dispersion to absorbance at 750 nm of the same reached at least 5.0. The resulting dispersion was diluted by the addition of distilled water to reach 6 percent by weight of the concentration of the cyanine dye. In order to remove dust, the resulting dispersion was filtered employing a filter (an average pore diameter of 1 μm) and then employed in practice.

There was prepared a coating composition of an antihalation layer in the following manner. Mixed were 30 g of gelatin, 24.5 g of polyacrylamide, 2.2 g of mol/liter caustic, 2.4 g of minute monodisperse polymethyl methacrylate particle (of an average particle size of 8 μm and a standard deviation of the particle diameter of 0.4), 0.08 g of benzoisothiazolinone, 35.9 g of the aforesaid minute solid dye particle dispersion, 74.2 g of the aforesaid minute solid Base Precursor particle dispersion (a), 0.6 g of poly(sodium styrenesulfonate), 0.21 g of blue dye Compound-1, 0.15 g of yellow dye compound-1, and 8.3 g of acrylic acid/ethyl acrylate copolymer latex (at a copolymerization ratio of 5/95), and the total volume was brought to 8,183 ml by the addition of water, whereby an antihalation layer liquid coating composition was prepared.

A coating composition of a back surface protective layer was prepared in the following manner. Mixed in a vessel maintained at 40° C. were 40 g of gelatin, 1.5 g of liquid paraffin emulsion as liquid paraffin, 35 mg of benzoisothiazolinone, 6.8 g of 1 mol/liter caustic soda, 0.5 g of sodium t-octylphenoxyethoxyethanesulfonate, 0.27 g of sodium polystyrenesulfonate, 37 mg of a fluorinated surfactant (F-1: N-perfluorooctylsulfonyl-N-propylalanine potassium salt), 150 mg of fluorinated surfactant (F-2: polyethylene glycol mono(N-perfluorocctylsulfonyl-N-propyl-2-aminoethyl) ether of an average degree of polymerization of ethylene oxide of 15, 64 mg of a fluorinated surfactant agent (F-3), 32 mg of a fluorinated surfactant (F-4), 6.0 g of acrylic acid/ethyl acrylate copolymer, and 2.0 g of N,N-ethylenebis (vinylsulfoneacetamide), and the volume of the resulting mixture was made to 10 liters by the addition of water, whereby a back surface protective layer coating composition was prepared.

Preparation of Silver Halide Emulsion

Silver halide emulsion 3-1 was prepared in the following manner. To 1,421 ml of distilled water in a stainless steel reaction vessel was added a solution prepared by adding 3.1 ml of 1% by weight potassium bromide solution, 3.5 ml of a concentration of 0.5 mol/L of sulfuric acid, and 31.7 g of phthalated gelatin. While stirring, the resulting mixture was maintained at 30° C. Subsequently, all solution A prepared by dissolving 22.22 g of silver nitrate in distilled water to make the total volume to 95.4 ml, and all solution B prepared by dissolving 15.3 g of potassium bromide and 0.8 g of potassium iodide in 97.4 ml of distilled water, were added to the resulting mixture over a period of 45 seconds. Thereafter, 10 ml of 3.5% by weight aqueous hydrogen peroxide solution was added and further 4 ml of 0.1 percent aforesaid compound (ETTU) ethanol solution was added. Solution C was prepared by dissolving 51.86 g of silver nitrate in distilled water to make to the total volume of 317.5 ml, and solution D was also prepared by dissolving 44.2 g of potassium bromide and 2.2 g of potassium iodide in distilled water to make a total volume 400 ml. Solution C and solution D were added employing a controlled double-jet method in such a manner that all aforesaid solution C was added at a constant flow rate over a period of 20 minutes and solution D was added to maintain the pAg at 8.1. Potassium hexachloroirridate (III) was added 10 minutes after the addition of solutions C and D to result in a concentration of $1\times10^{-4}$ mol per mol of silver. Further, an aqueous potassium iron (II) hexacyanate was added 5 seconds after the completion of the addition of solution C to result in a concentration of $3\times10^{-4}$ mol per mol of silver. The pH was adjusted to 3.8 by the addition of sulfuric acid at a concentration of 0.5 mol/L, and stirring was terminated. Thereafter, coagulation/desalting/washing was performed. The pH was adjusted to 5.9 by the addition of sodium hydroxide at a concentration of 1 mol/L, whereby a silver halide dispersion exhibting a pAg of 8.0 was prepared.

To the aforesaid silver halide dispersion was added 5 ml of a 0.34 weight percent 1,2-benzoisothiazoline-3-one methanol solution, while stirring at 38° C. After 40 minutes, a methanol solution of spectral sensitizing dyes A and B at a mol ratio of 1:1 was added in a total amount of $7.6\times10^{-5}$ mol per mol of silver, and after 5 minutes, a tellurium sensitizer C methanol solution was added in an amount of $2.9\times10^{-4}$ mol per mol of silver. The resulting mixture underwent ripening for 91 minutes. Subsequently, 1.3 ml of a 0.8 weight percent N,N'-dihyroxy-N"-diethylmelamine methanol solution was added, and after 4 minutes, a 5-methyl-2-mercaptobenzimidazole methanol solution was added to result in an amount of $4.8\times10^{-3}$ mol per mol of silver, and then a 1-phenyl-2-heputyl-5-mercapto-1,3,4-triazole methanol solution was added to result in an amount of $5.4\times10^{-3}$ mol per mol of silver, whereby silver halide emulsion 1 was prepared.

The prepared silver halide emulsion was comprised of silver iodobromide grains, uniformly containing 3.5 mol percent of iodine, of an average equivalent spherical diameter of 0.042 μm and a variation coefficient of the equivalent spherical diameter of 20 percent. The grain size and the like were determined based on the average of 1,000 grains, employing an electron microscope. The (100) face ratio of these grains was determined to be 80%, employing the Kubelka-Munk method.

Silver halide emulsion 3-2 was prepared similarly to the foregoing silver halide emulsion 3-1, except that the temperature of the liquid composition during grain formation was changed from 30° C. to 47° C.; the preparation of solution B was changed in such a manner that 15.9 g of potassium bromide was dissolved in distilled water to result in the total volume of 97.4; the preparation of solution D was changed in such a manner that 45.8 g of potassium bromide was dissolved in distilled water to result in the total volume of 400 ml; the addition time of solution C was varied to 30 minutes; and potassium hexacyanoiron (II) was omitted. The resulting emulsion was subjected to coagulation/desalting/washing/dispersion in the same manner as silver halide emulsion 5-1. Subsequently, silver halide emulsion 5-2 was obtained while being subjected to spectral sensitization and chemical ripening in the same manner as emulsion 1 and subjected to addition of 5-methyl-2-mercaptobenzimidazole and 1-phenyl-2-heptyl-5-mercapto-1,3,4-triazole, except that the total addition amount of methanol solution of spectral sensitizing dyes A and B at a mol ratio of 1:1 was changed to $7.5\times10^{-4}$ mol per mol of silver; the added amount of tellurium sensitizer C was changed to $1.1\times10^{-4}$ mol per mol of silver; and the added amount of 1-phenyl-2-heptyl-5-mercapto-1,3,4-triazole was changed to $3.3\times10^{-3}$ mol per mol of silver. Silver halide emulsion 3-2 was comprised of pure cubic silver bromide grains of an average equivalent spherical diameter of 0.080 μm and an equivalent spherical variation coefficient of 20%.

Silver halide emulsion 3-3 was prepared similarly to the foregoing silver halide emulsion 3-1, except that the temperature of the liquid composition during grain formation was changed from 30° C. to 27° C. The resulting emulsion was subjected to coagulation/desalting/washing/dispersion in the same manner as silver halide emulsion 1. Silver halide emulsion 5-3 was prepared in the same manner as emulsion 1, except that the total added amount in the form of a solid dispersion (an aqueous gelatin solution) of spectral sensitizing dyes A and B at a mol ratio of 1:1 was changed to $6\times10^{-3}$ mol per mol of silver; the added amount of tellurium sensitizer C was changed to $5.2\times10^{-4}$ mol per mol of silver; bromoauric acid was added in an amount of $5\times10^{-4}$ mol per mol of silver; and potassium thiocyanate was added in an amount of $2\times10^{-3}$ mol per mol of silver three minutes after the addition of the tellurium sensitizer C. Silver halide emulsion 3-3 was comprised of uniformly 3.5 mol percent iodine containing silver iodobromide grains of an average equivalent spherical diameter of 0.034 μm and a variation coefficient of an equivalent spherical diameter of 20 percent.

Silver halide emulsion 3-4 was prepared similarly to the foregoing silver halide emulsion 3-1, except that compound (ETTU) was omitted during grain formation. The silver halide emulsion prepared as above was comprised of uniformly 3.5 mol percent iodine containing silver iodobromide grains of an average equivalent spherical diameter of 0.044 μm, and a variation coefficient of equivalent spherical diameter of 19 percent. The (100) face ratio of these grains was determined to be 82 percent.

Silver halide emulsion 3-5 was prepared similarly to the foregoing silver halide emulsion 3-2, except that during grain formation, the compound (ETTU) was not added. Silver halide emulsion 3-5 was comprised of silver bromide cubic grains of an average equivalent spherical diameter of 0.081 μm and a variation coefficient of equivalent spherical diameter of 17 percent.

Silver halide emulsion 3-6 was prepared similarly to the foregoing silver halide emulsion 3-3, except that during grain formation, compound (ETTU) was not added. Incidentally, silver halide emulsion 5-6 was comprised of uniformly 3.5 mol percent iodine containing silver iodobromide grains of an average equivalent spherical diameter of 0.032 μm and a variation coefficient of the equivalent spherical diameter of 18 percent.

A mixed emulsion A for the light-sensitive layer was prepared in the following manner. A mixture consisting of 70 percent by weight of silver halide emulsion 5-1, 15 percent by weight of silver halide emulsion 5-2, and 15% by weight of silver halide emulsion 5-3 was melted, and 1 weight percent aqueous benzothiazolium iodide solution was added in an amount of $7\times10^{-3}$ mol per mol of silver. Further, water was added so that the content of silver halide per kg of the mixed emulsion for a coating composition reached 38.2 g in terms of silver.

A mixed emulsion B for the light-sensitive layer was prepared in the following manner. A mixture consisting of 70 percent by weight of silver halide Emulsion 5-4, 15 percent by weight of silver halide emulsion 5-5, and 15 percent by weight of silver halide emulsion 5-6 was melted, and 1 weight percent aqueous benzothiazolium iodide solution was added in an amount of $7\times10^{-3}$ mol per mol of silver. Further, water was added so that the content of silver halide per kg of the mixed emulsion for a liquid coating composition reached 38.2 g in terms of silver.

Preparation of Silver Behenate Dispersion

Mixed with 120 kg of isopropyl alcohol was 100 kg of behenic acid (trade name Edenor C22-85R), manufacture by Henkel Co., dissolved at 50° C. and filtered employing a 10 μm filter. Thereafter, the temperature was lowered to 30° C., and recrystallization was performed. The cooling rate during recrystallization was controlled to be 3° C./hour. The resulting crystals were subjected to centrifugal filtration, were washed with 100 kg of isopropyl alcohol, and subsequently dried. The resulting crystals then underwent esterification. Subsequently, GC-FID was performed, resulting in a silver behenate proportion of 99% and a lignoceric acid proportion of 0.5 percent, and an arachidic acid proportion of 0.5 percent as other products.

Subsequently, 88 kg of the foregoing recrystallized behenic acid, 422 L of distilled water, 49.2 L of a 5 mol/L aqueous NaOH solution, and 120 L of t-butyl alcohol were mixed and the resulting mixture underwent reaction while stirring at 75° C. for one hour, whereby a sodium behenate solution was obtained. Separately, 206.2 L of an aqueous solution of 40.4 kg of silver nitrate was prepared and maintained at 10° C. A reaction vessel in which 635 L of distilled water and 30 L of t-butyl alcohol were placed, was maintained at 30° C., and while vigorously stirring, all the sodium behenate solution and all the aqueous silver nitrate solution were added at a specified rate over a period of 93 minutes 15 seconds and 90 minutes, respectively. During this operation, addition was arranged so that an aqueous silver nitrate solution was only added for 11 minutes after the addition of the aforesaid aqueous silver nitrate solution. Thereafter, the addition of sodium behenate solution B was initiated, and addition was arranged so that sodium behenate solution B was added for only 14 minutes 15 seconds after the completion of the addition of the aforesaid aqueous silver nitrate solution. Concurrently, the temperature of the interior of the reaction vessel was maintained at 30° C., and the exterior temperature was controlled so that the temperature of the composition remained constant. Further, duplex pipes were employed as a pipe for the addition system of the sodium behenate solution, which was warmed by circulating warmed water in the exterior side of the duplex pipes, and the temperature of the liquid composition at the outlet of the tip of the addition nozzle was controlled to be at 75° C. Further, duplex pipes were employed as a pipe for the addition system of an aqueous silver nitrate solution which was cooled by circulating cooled water in the exterior of the duplex pipes. The addition position of the aqueous silver nitrate solution and the addition location of the sodium behenate solution were symmetrically arranged with respect to the stirring shaft as a center and the height was controlled to not come into contact with the reaction liquid composition.

After completion of the addition of the sodium behenate solution, the resulting mixture was allowed to stand for 20 minutes while stirring without temperature control. Thereafter, the resulting mixture was heated to 35° C. over a period of 30 minutes and subsequently underwent ripening for 210 minutes. Immediately after the ripening, solids were collected by centrifugal filtration, and the resulting solids were washed with water until the electrical conductivity of the wash water reached 30 μS/cm. Thus, a fatty acid silver salt was obtained. The resulting solids were not dried and stored in the form of a wet cake. The shape of the resulting silver behenate particles was imaged employing an electron microscope and evaluated, noting that the crystals of an average aspect ratio of 2.1, an average equivalent spherical diameter of 0.51 μm, and a variation coefficient of equivalent spherical diameter of 11%.

Added to the wet cake in an amount corresponding to 260 kg of dried solids were 19.3 kg of polyvinyl alcohol (trade name PVA-217) and water so that the total weight reached 1,000 kg. Thereafter, the resulting mixture was modified to slurry employing dissolver blades and was subjected to a preliminary dispersion treatment employing a pipe line mixer (Type PM-10, manufactured by Mizuho Kogyo Co., Ltd.).

Subsequently, the thus obtained preliminary dispersion was treated three times employing a homogenizer (trade name Microfluidizer M-610, manufactured by International Corporation, employing a Type Z interaction chamber) while controlling the pressure to be $1.13\times10^5$ kPa or 1,150 kg/cm$^2$), whereby a silver behenate dispersion was obtained. A cooling operation was performed as follows. Coiled tube type heat exchangers were installed before and after the interaction chamber, and dispersion temperature was set at 18° C. by controlling the temperature of the coolant.

Preparation of Reducing Agent Dispersion

A reducing agent-1 dispersion was prepared as follows. Thus, to 10 kg of a 1:1 complex of reducing agent-1 [(6,6'-di-t-butyl-4,4'-dimethyl-2,2'-butylidenediphenol) and triphenylphosphine oxide, 0.12 kg of triphenylphosphine oxide, and 16 kg of a 10 weight percent aqueous modified polyvinyl alcohol (Poval MP203, manufactured by Kuraray Co., Ltd.) solution was added 10 kg of water. The resulting mixture was vigorously stirred to form slurry. The resulting slurry was conveyed employing a diaphragm pump and dispersed employing a horizontal type sand mill (UVM-2, manufactured by IMEX Co., Ltd.) filled with zirconia beads of an average diameter of 0.5 mm for 4 hours 30 minutes. Thereafter, 0.2 g of benzoisothiazolinone and water were added so that the concentration of the reducing agent complex reached 22 percent by weight, whereby reducing agent-1 dispersion was obtained. The median diameter and the maximum particle diameter of reducing agent complex particles contained in the reducing agent dispersion prepared as above were 0.45 μm and at most 1.4 μm, respectively. The prepared reducing agent dispersion was filtered employing a polypropylene filter of a pore diameter of 3.0 μm to remove foreign matter such as dust and then stored.

A reducing agent-2 dispersion was prepared as follows. Thus, 10 kg of water was added to 10 kg of Reducing Agent-2 (6,6'-di-t-butyl-4,4'-dimethyl-2,2'-butylidenediphenol) and 16 kg of a 10 weight percent aqueous modified polyvinyl alcohol (Poval MP203, manufactured by Kuraray Co., Ltd.) solution. The resulting mixture was vigorously stirred to form slurry. The resulting slurry was conveyed employing a diaphragm pump and dispersed employing a horizontal type sand mill (UVM-2, manufactured by IMEX Co., Ltd.) filled with zirconia beads of an average diameter of 0.5 mm for 3 hours 30 minutes. Thereafter, 0.2 g of a benzoisothiazolinone sodium salt and water were added so that the concentration of the reducing agent reached 25 percent by weight, whereby reducing agent-2 dispersion was obtained. The median diameter and the maximum particle diameter of reducing agent complex particles contained in the reducing agent dispersion prepared as above were 0.40 μm and at most 1.5 μm, respectively. The prepared reducing agent dispersion was filtered employing a polypropylene filter of a pore diameter of 3.0 μm to remove foreign matter, such as dust and then stored.

Preparation of Hydrogen Bond Forming Compound-1 Dispersion

To 10-kg of hydrogen bond forming compound-1 [tri(4-t-butylphenyl)phosphine oxide] and 16 kg a 10 weight percent aqueous modified polyvinyl alcohol (Poval MP203, manufactured by Kuraray Co., Ltd.) was added 10 kg of water The resulting mixture was vigorously stirred to form slurry. The resulting slurry was conveyed employing a diaphragm pump and dispersed for 3 hours 30 minutes employing a horizontal type sand mill (UVM-2, manufactured by IMEX Co., Ltd.) filled with zirconia beads of an average diameter of 0.5 mm. Thereafter, 0.2 of benzoisothiazolinone sodium salt and water were added so that the concentration of the hydrogen bond forming compound reached 25 percent by weight, whereby hydrogen bond forming compound-1 dispersion was obtained. The median diameter and the maximum particle diameter of hydrogen bond forming compound particles contained in the hydrogen bond forming compound dispersion prepared as above were 0.35 μm and at most 1.4 μm, respectively. The prepared hydrogen bond forming compound dispersion was filtered employing a polypropylene filter of a pore diameter of 3.0 μm to remove foreign matter, such as dust, and then stored.

Preparation of Development Accelerator Dispersion

A dispersion of development accelerator-1 was prepared in the following manner. To 10 kg of development accelarator-1 and 20 kg of a 10% by weight aqueous modified polyvinyl alcohol (Poval MP203, manufactured by Kuraray Co., Ltd.) was added 10 kg of water. The resulting mixture was vigorously stirred to form slurry. The resulting slurry was conveyed employing a diaphragm pump and dispersed employing a horizontal type sand mill (UVM-2, manufactured by IMEX Co., Ltd.) filled with zirconia beads of an average diameter of 0.5 mm for 3 hours 30 minutes. Thereafter, 0.2 of benzoisothiazolinone sodium salt and water were added so that the concentration of the development accelerator reached 20 percent by weight, whereby development accelerator-1 dispersion was obtained. The median diameter and the maximum particle diameter of development accelerator particles contained in the development accelerator dispersion prepared as above were 0.48 μm and at most 1.4 μm, respectively. The prepared development accelerator dispersion was filtered employing a polypropylene filter of a pore diameter of 3.0 μm to remove foreign matter such as dust and stored. Solid dispersion of each of development accelerator-2, development accelerator-3, and color tone controlling agent-1 was performed in the same manner as development accelerator-1 and each of the 20 weight percent dispersion was obtained.

A 20 wt % dispersion of development accelerator-2, a 20 wt % dispersion of development accelerator-3, and a 20 wt % dispersion of image tone controlling agent-1 were each prepared similarly to the foregoing dispersion of development accelerator-1, except that the development accelerator-1 was replaced by development accelerator-2, development accelerator-3 and image tone controlling agent-1, respectively.

Preparation of Polyhalogen Compound

A dispersion of organic polyhalogen compound-1 was prepared in the manner as follows. To 10 kg of organic polyhalogen compound-1 (tribromomethanesulfonylbenzene), 10 kg of a 20 weight percent aqueous modified polyvinyl alcohol (Poval MP203, manufactured by Kuraray Co., Ltd.) solution, and 0.4 kg of an aqueous sodium triisopropylnaphthalenesufonate solution was added 14 kg of water. The resulting mixture was vigorously stirred to form slurry. The resulting slurry was conveyed employing a diaphragm pump and dispersed for 5 hours employing a horizontal type sand mill (UVM-2, manufactured by IMEX Co., Ltd.) filled with zirconia beads of an average diameter of 0.5 mm. Thereafter, 0.2 of benzoisothiazolinone sodium salt and water were added so that the concentration of the organic polyhalogen compound reached 26 percent by weight, whereby organic polyhalogen compound-1 Dispersion was obtained. The median diameter and the maximum particle diameter of organic polyhalogen compound particles contained in the organic polyhalogen compound dispersion prepared as above were 0.41 μm and at most 2.0 μm, respectively. The prepared organic polyhalogen compound dispersion was filtered employing a polypropylene filter of a pore diameter of 10.0 μm to remove foreign matter, such as dust, and then stored.

A dispersion of organic polyhalogen compound-2 was also prepared in the following manner. To 0.4 kg of an aqueous sodium triisopropylnaphthalenesufonate solution are added 10 kg of organic polyhalogen compound-2 (N-butyl-3-tribromomethanesulfonylbenzamide) and 10 kg of a 10 weight percent aqueous modified polyvinyl alcohol (Poval MP203, manufactured by Kuraray Co., Ltd.) solution. The resulting mixture was vigorously stirred to form slurry. The resulting slurry was dispersed for 5 hours, employing a horizontal type sand mill (UVM-2, manufactured by IMEX Co., Ltd.) filled with zirconia beads of an average diameter of 0.5 mm. Thereafter, 0.2 of benzoisothiazolinone sodium salt and water were added so that the concentration of the organic polyhalogen compound reached 30 percent by weight. The resulting dispersion was heated at 40° C. for 5 hours, whereby organic polyhalogen compound-2 dispersion was obtained. The median diameter and the maximum particle diameter of organic polyhalogen compound particles contained in the organic polyhalogen compound dispersion prepared as above were 0.40 μm and at most 1.3 μm, respectively. The prepared organic polyhalogen compound dispersion was filtered employing a polypropylene filter of a pore diameter of 3.0 μm to remove foreign matter, such as dust, and then stored.

Preparation of Phthalazine Compound-1 Solution

In 174.57 kg of water was dissolved 8 kg of modified polyvinyl alcohol MP203, manufactured by Kuraray Co., Ltd. Subsequently, 3.15 kg of a 20% by weight aqueous sodium triisopropylnaphthalenesulfonate solution and 14.28 kg of a 70% by weight aqueous phthalazine compound-1 (6-isopropylphthalazine) solution were added, whereby a 5% by weight phthalazine compound-1 solution was prepared.

Preparation of Mercapto Compound

Aqueous mercapto compound-1 solution was prepared. Thus, in 993 g of water was dissolved 7 g of mercapto compound-1 [1-(3-sulfophenyl)-5-mercaptotetrazole sodium salt] to obtain an aqueous 0.7% by weight mercapto compound-1 solution.

Similarly, aqueous mercapto compound-2 solution was prepared. Thus, in 980 g of water was dissolved 20 g of mercapto compound-2 (a 1-(3-methylureido)-5-mercaptotetrazole sodium salt) to obtain an aqueous 2.0% by weight mercapto compound-2 solution.

Preparation of Pigment-1 Dispersion

To 250 g of water were added 64 g of C.I. Pigment Blue 60 and 6.4 g of Demol N, manufactured by Kao Corp. The resulting mixture was vigorously mixed to form slurry. Subsequently, 800 g of zirconia beads of an average diameter of 0.5 mm was prepared, placed in a vessel together with the slurry, and dispersed for 25 hours, employing a homogenizer (¼G Sand Grinder Mill, manufactured by IMEX Co., Ltd.), whereby pigment-1 was obtained. The average diameter of pigment particles contained in the pigment dispersion, prepared as above, was 0.21 μm.

Preparation of SBR Latex Liquid Composition

SBR latex having a Tg of 22° C. was prepared as follows. Ammonium persulfate was used as a polymerization initiator, while anionic surfactants were used as an emulsifier. After 70.0 weight parts of styrene, 27.0 weight parts of butadiene, and 3.0 weight parts of acrylic acid were subjected to emulsion polymerization, the resulting product was subjected to aging at 80° C. for 8 hours. Thereafter, the temperature was lowered to 40° C., and the pH was adjusted to 7.0 by the addition of ammonia water. Further, Sandet BL (manufactured by Sanyo Chemical Industries, Ltd.) was added to reach 0.22 percent. Subsequently, the pH was adjusted to 8.3 by the addition of a 5 percent aqueous sodium hydroxide solution, and further, the pH was adjusted to 8.4 by the addition ammonia water. The molar ratio of $Na^+$ ions to $NH_4^+$ ions employed for the adjustment of the pH was 1:2.3. Further, 0.15 ml of a 7% aqueous benzoisothiazolinone sodium salt solution was added with respect to 1 kg of the resulting liquid composition, and a SBR latex composition was thus prepared.

SBR latex was a latex of-St(70.0)—Bu(27.0)-AA(3.0)-, exhibiting a Tg of 22° C., an average particle diameter of 0.1 μm, a concentration of 43 percent by weight, an equilibrium moisture content of 0.6 percent by weight at 25° C. and 60% relative humidity, an ionic conductance of 4.2 mS/cm (which was determined at 43% by weight and 25° C. employing a conductometer CM-30S, manufactured by To a Denpa Kogyo Co., Ltd.), and a pH of 8.4.

Preparation of Coating Composition

Into a vessel were successively added 1,000 g of the fatty acid silver dispersion prepared as above, 276 ml of water, 33.2 g of pigment-1 Dispersion, 21 g of organic polyhalogen compound-1 dispersion, 58 g of organic polyhalogen compound-2 dispersion, 173 g of phthalazine compound-1 solution, 1,082 g of SBR latex (having a Tg of 22° C.) composition, 299 g of dispersion of reducing agent complex-1, 6 g of development accelerator dispersion, 9 ml of aqueous mercapto compound-1 solution, and 27 ml of aqueous mercapto compound solution. Further, immediately before coating, 117 g of mixed silver halide emulsion (A) was added and vigorously stirred to obtain a coating composition of light-sensitive layer 1.

Coating composition of light-sensitive layer 2 was prepared similarly to the foregoing. Into a vessel were successively added 1,000 g of the fatty acid silver dispersion prepared as above, 276 ml of water, 32.8 g of pigment-1 dispersion, 21 g of organic polyhalogen compound-1 Dispersion, 58 g of organic polyhalogen compound-2 dispersion, 173 g of phthalazine compound-1 solution, 1,082 g of SBR latex (having a Tg of 20° C.) composition, 155 g of dispersion of reducing agent-2, 55 g of a dispersion of hydrogen bond forming compound-1, 6 g of development accelerator-1 dispersion, 2 g of development accelerator-2, 3 g of development accelerator-3, 2 g of a dispersion of image toning agent-1, and 6 ml of aqueous mercapto compound-2 solution. Further, immediately before coating, 117 g of mixed silver halide emulsion (B) was added and vigorously stirred to obtain a coating composition of light-sensitive layer 2.

An interlayer coating composition was prepared as follows. Water was added to a mixture consisting of 1,000 g of polyvinyl alcohol PVA-205 (manufactured by Kuraray Co., Ltd.), 272 g of 5% by weight pigment dispersion, 4,200 ml of a 19% by weight methyl methacrylate/styrene/butyl acrylate/hydroxyethyl methacrylate/acrylic acid copolymer (at a copolymerization ratio of 64/9/20/5/2) latex, 27 ml of a 5% by weight aqueous Aerosol OT (manufactured by American Cyanamid Co.) solution, and 135 ml of a 20% by weight aqueous phthalic acid diammonium salt solution and water was added to make the total weight of 10,000 g. Subsequently the pH was adjusted to 7.5 by the addition of NaOH, and an interlayer coating composition was thus prepared. Subsequently, the resulting liquid coating composition was conveyed to a coating die. The viscosity of the coating composition was 58 mPa·s, which was determined at 40° C., employing Type B Viscometer (No. 1 Rotor at 60 rpm).

Coating Composition of the first protective layer was prepared as follows. In water was dissolved 64 g of inert gelatin, and to the resulting gelatin solution were added 80 g of a 27.5 weight percent methyl methacrylate/styrene/butyl acrylate/hydroxyethyl methacrylate/acrylic acid copolymer (at a copolymerization weight ratio of 64/9/20/5/2) latex, 23 ml of a 10% by weight phthalic acid methanol solution, 23 ml of 10% by weight aqueous 4-methylphthalic acid solution, 28 ml of sulfuric acid at a concentration of 5 mol/L, 5 ml of a 5% by weight aqueous Aerosol OT (manufactured by American Cyanamid Co.) solution, 0.5 g of phenoxyethanol, and 0.1 g of benzoisothiazolinone. Subsequently, the total weight was adjusted to 750 g by the addition of water, whereby a liquid coating composition was prepared. Subsequently, 26 ml of a 4% by weight chromium alum solution was mixed just prior to coating, employing a static mixer, and the resulting mixture was conveyed to a coating die to result in a coated amount of 18.6 ml/$m^2$. The viscosity of the thus prepared coating composition was 20 mPa·s, which was determined at 40° C., employing Type B Viscometer (No. 1 Rotor at 60 rpm).

Coating composition of the second protective layer was prepared similarly. Thus, in water was dissolved 80 g of inert gelatin, and added to the resulting gelatin solution were 102 g of a 27.5 weight percent methyl methacrylate/styrene/butyl acrylate/hydroxyethyl methacrylate/acrylic acid copolymer (at a copolymerization weight ratio of 64/9/20/5/2) latex, 3.2 ml of a 5 weight percent fluorinated surfactant (F-1:N-perfluorooctylsulfonyl-N-propylalanine potassium salt solution, 32 ml of a 2 weight percent aqueous fluorinated surfactant (F-2: polyethylene glycol mono(N-perfluorooctylsulfonyl-N-propyl-2-aminoethyl)ether (an average degree of polymerization of ethylene oxide: 15)) solution, 23 ml of a 5% by weight Aerosol OT (manufactured by American Cyanamid Co.) solution, 4 g of minute polymethyl methacrylate particles (having an average diameter of 0.7 μm), 21 g of minute polymethyl methacrylate particles (having an average diameter of 4.5 μm), 1.6 g of 4-methylphthalic acid, 4.8 g of phthalic acid, 44 ml of sulfuric acid at a concentration of 0.5 mol/L, 10 mg of benzoisothiazolinone. Subsequently, the total weight was adjusted to 650 g by the addition of water, whereby a liquid coating composition was prepared. Subsequently, 445 ml of an aqueous solution containing 4% by weight chromium alum and 0.67% by weight phthalic acid was mixed just prior to coating, whereby a surface protective layer coating composition was prepared, which was conveyed to a coating die to result in a coated amount of 8.3 ml/m$^2$. The viscosity of the coating composition was 19 mPa·s, which was determined at 40° C., employing Type B Viscometer (No. 1 Rotor at 60 rpm).

Preparation of Photothermographic Material

An antihalation layer liquid coating composition and a surface protective layer liquid coating composition were simultaneously coated onto the back surface side of the support so as to have a coated amount of solids of solid particulate dye of 0.04 g/m$^2$ and a coated amount of gelatin of 1.7 g/m$^2$, respectively, and subsequently dried, whereby a back layer was prepared.

The emulsion layer, interlayer, first protective layer, and second protective layer were simultaneously coated onto the support of the opposite side to the back surface in the stated order from the subbed surface in a slide bead coating system to obtain photothermographic material 301. During the above coating, the temperature of the emulsion layer and the interlayer was adjusted to 31° C., the temperature of the first protective layer was adjusted to 36° C., and the temperature of the second protective layer was adjusted to 37° C. The coated amount (in g/cm$^2$) of each compound in the emulsion layer was as follows:

silver behenate: 5.55, pigment (C.I. Pigment Blue 60): 0.036, organic polyhalogen compound-1: 0.12, organic polyhalogen compound-2: 0.37, phthalazine compound-1: 0.19, SBR latex: 9.67, reducing agent complex-1: 1.41, development accelerator-1: 0.024, mercapto comppound-1: 0.002, mercapto compound-2: 0.012, and silver halide (in terms of Ag): 0.091.

Coating and drying conditions were as follows. Coating was performed at a coating speed of 160 m/minute; the gap between the edge of the coating die and the support was set to between 0.10 and 0.30 mm; and the pressure in the pressure reduced chamber was set to 196 to 882 Pa lower than atmospheric pressure. The supports were subjected to charge elimination employing an ion flow prior to coating. In the subsequent chilling zone, after chilling the coating composition employing an air flow at a dry bulb temperatures of 10 to 20° C., drying was performed employing an air flow at a dry bulb temperature of 23 to 45° C. and a wet bulb temperature of 15 to 21° C. employing a non-contact helically floating dryer under non-contact conveyance. After drying, humidification was performed at 25° C. and relative humidity of 40 to 60 percent. Thereafter, the layer surface was heated to 70 to 90° C. After heating, the layer surface was cooled to 25° C.

Photothermographic material 302 was prepared similarly to the foregoing photothermographic material 301, except that the coating composition of the light-sensitive layer 1 was replaced by that of the light-sensitive layer 2.

Photothermographic materials 303 and 304 were prepared similarly to the foregoing photothermographic materials 301 and 302, respectively, except that a solid particle dispersion of a base precursor and a solid particle dispersion of a dye were removed from the antihalation layer coating composition and a light-insensitive layer containing a dye microcapsule 1 used in Example 1 and having a dry thickness of 3.7 μm was provided between the light-sensitive layer and the support.

Spectral sensitizing dye A

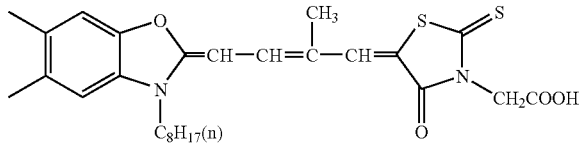

Spectral sensitizing dye B

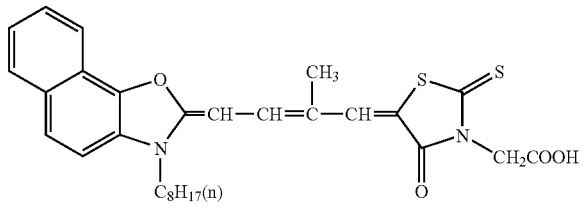

Tellurium sensitizer C

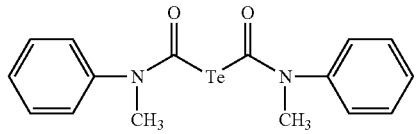

Base precursor compound-1

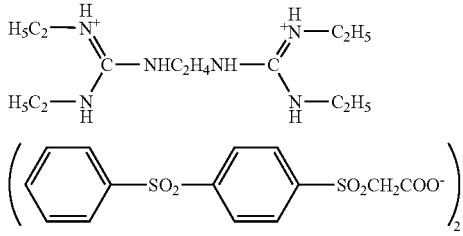

Phthalazinone compound-1

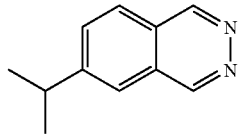

Development accelerator-1

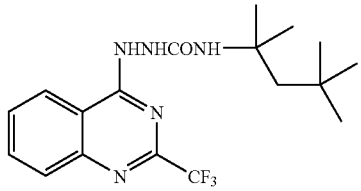

Development accelerator-2

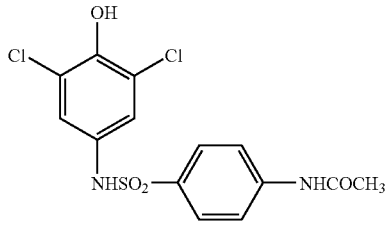

-continued

Development accelerator-3

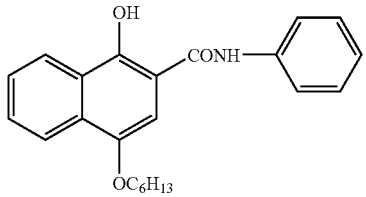

Image tone controlling agent-1

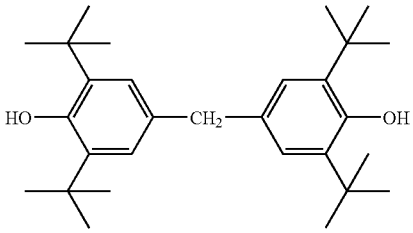

Cyanine dye compound-1

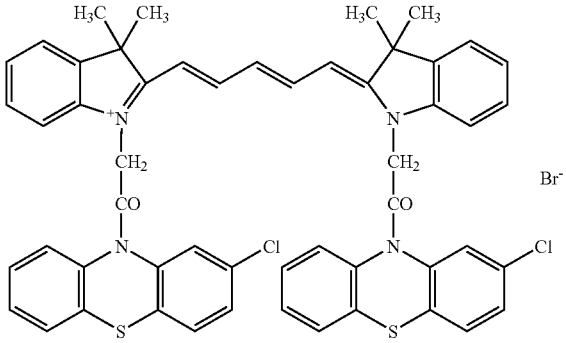

Blue dye compound-1

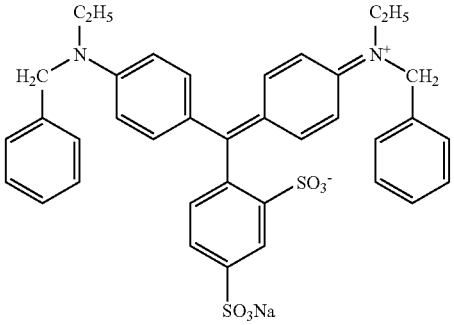

(F-1)

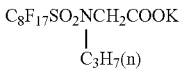

-continued (F-2)

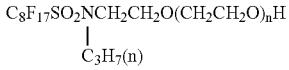

(F-3)

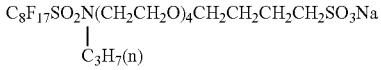

(F-4)

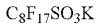

n = 15 (average)

Evaluation of Photothermographic Material

Using a medical dry laser imager (fitted with a 660 nm semiconductor laser at a maximum output of 60 mW (IIIB)), the prepared photothermographic materials were each exposed and thermally developed for the total time of 14 sec., in which four panel heaters were respectively set at 112° C., 119° C., 121° C. and 121° C.

Similarly to Example 1, the photothermographic materials were evaluated with respect to sensitivity (also denoted as "S", fog density (also denoted as "Dmin"), maximum density (also denoted as "Dmax") and silver image lasting quality. In addition, evaluation was made with respect to staining and odor caused in the heat-developing drum according to the procedure described below.

After the thermal development was continuously conducted, odor in a thermal development environment was confirmed and the heat-developing drum surface was visually observed, and evaluation was made with respect to stain resistance and odor resistance of the heat-developing drum, based on the following criteria:

A: no odor was perceived and any adhesion of foreign material was not noticed on the heat-developing drum, even after completion of continuous thermal development, B: foul smell was perceived and adhesion of foreign material was noticed on the heat-developing drum after completion of continuous thermal development.

Results are shown in Table 5, in which the sensitivity and maximum density were each represented by a relative value, based on each of the sensitivity and maximum density of photothermographic material 301 being 100.

TABLE 5

| Sample | AgX | Microcapsule | | | | Image Lasting Quality | | Stain Resistance/ Oder | |
|---|---|---|---|---|---|---|---|---|---|
| No. | No.*1 | No. | Dmin | S | Dmax | ΔDmin | ΔDmax | Resistance | Remark |
| 301 | A | — | 0.204 | 100 (34) | 100 | 150 | 74 | B | Comp. |
| 302 | B | — | 0.203 | 135 (38) | 112 | 155 | 71 | B | Comp. |

TABLE 5-continued

| Sample No. | AgX No.*1 | Microcapsule No. | Dmin | S | Dmax | Image Lasting Quality ΔDmin | Image Lasting Quality ΔDmax | Stain Resistance/ Oder Resistance | Remark |
|---|---|---|---|---|---|---|---|---|---|
| 303 | A | 1 | 0.189 | 175 (18) | 138 | 107 | 94 | A | Inv. |
| 304 | B | 1 | 0.200 | 137 (37) | 119 | 139 | 79 | B | Comp. |

*1Silver halide emulsion

As apparent from Table 5, it was proved that silver salt photothermographic material samples which contained a dye microcapsule in the light-insensitive layer, exhibited reduced fogging (minimum density), enhanced sensitivity and maximum density, and superior image lasting quality, compared to comparative samples.

Further, in the image color tone evaluation of the sample according to this invention, the coefficient of determination value $R^2$ was from 0.998 to 1.000; b* value of the intersection of the aforesaid linear regression line with the ordinate was from −5 to +5; gradient (b*/a*) was from 0.7 to 2.5, confirming that superior image color tone was achieved.

Example 4

Photothermographic material sample 401 was prepared similarly to photothermographic material 101 in Example 1, provided reducing agent A used in the additive solution "a" was replaced by an equimolar amount of an equimolar mixture of exemplified compounds RED-10 and RED-17.

Infrared sensitizing dye 3 (IR Dye 3)

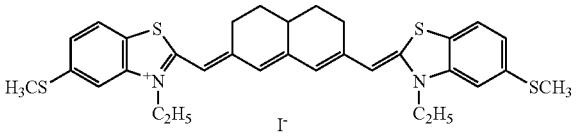

(YL-1)

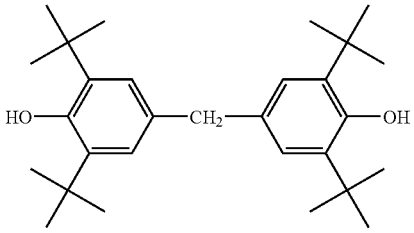

-continued (CL-8)

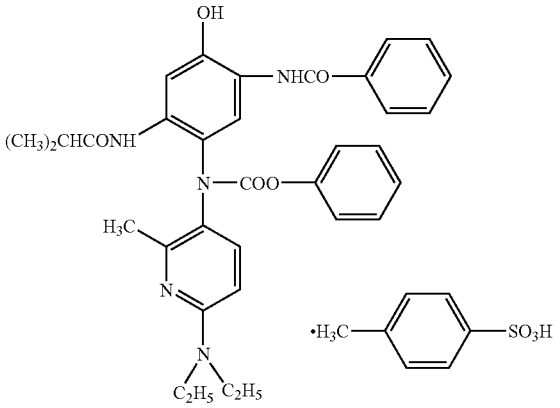

Similarly to the foregoing photothermographic material 401, photothermographic material samples 402 to 412 were prepared in the combinations, as shown in Table 6, provided that molar amounts of silver halide emulsions and halogen radical releasing compounds (OFI or XP) were unchanged, and further the sensitizing dyes were added so that the total molar number was equal to that of chromophores.

The thus prepared photothermographic material samples 401 to 412 were each exposed and thermally processed similarly to Example 1 and evaluated with respect to sensitivity (S), fog (Dmin), maximum density (Dmax) and image lasting quality (ΔDmin, ΔDmax). The sensitivity and maximum density were each represented by a relative value, based on each of the sensitivity and maximum density of sample 401 being 100.

Results are shown in Table 6.

TABLE 6

| Sample No. | AgX No. | Sensitizing Dye*1 | Halogen Radical Releasing Agent*2 | Dmin | S | Dmax | Image Lasting Quality ΔDmin (%) | Image Lasting Quality ΔDmax (%) | Remark |
|---|---|---|---|---|---|---|---|---|---|
| 401 | 1 | IR Dye (1 + 2) | OFI-65 | 0.215 | 100 (29) | 100 | 136 | 79 | Comp. |
| 402 | 1 | DD30 | OFI-65 | 0.208 | 108 (27) | 105 | 134 | 81 | Comp. |
| 403 | 2 | IR Dye (1 + 2) | OFI-65 | 0.212 | 105 (15) | 106 | 131 | 80 | Comp. |
| 404 | 2 | DD30 | OFI-65 | 0.196 | 115 (13) | 125 | 112 | 90 | Inv. |
| 405 | 3 | DD30 | OFI-65 | 0.195 | 116 (13) | 125 | 111 | 91 | Inv. |
| 406 | 3 | DD30 | XP5 | 0.192 | 116 (12) | 126 | 110 | 91 | Inv. |
| 407 | 4 | IR Dye 3 | XP5 | 0.205 | 135 (11) | 126 | 131 | 81 | Comp. |
| 408 | 4 | DD29 | XP5 | 0.194 | 140 (11) | 129 | 111 | 93 | Inv. |
| 409 | 4 | DD30 | XP5 | 0.185 | 151 (4) | 135 | 106 | 97 | Inv. |
| 410 | 4 | DD30 | XP1 | 0.186 | 145 (5) | 130 | 108 | 94 | Inv. |
| 411 | 4 | DD30 | XP10 | 0.186 | 143 (6) | 131 | 109 | 93 | Inv. |
| 412 | 5 | DD30 | XP5 | 0.187 | 150 (5) | 133 | 106 | 96 | Inv. |

*1The total amount of sensitizing dye(s) is equimolar to sample 101
*2The total molar amount is the same in each sample In Table 6, the numeral in parentheses in the sensitivity column indicates the value of the sensitivity obtained when, prior to exposure to white light, thermally treated at a temperature equivalent to the foregoing thermal developing temperature, then exposed to white light (487K, 30 sec.) and thermally developed, relative to that of the sensitivity obtained when exposed to the white light and thermally developed, based on the latter value being 100.

The main reason for reduction of sensitivity obtained when, prior to exposure to white light, thermally treated at a temperature equivalent to the foregoing thermal developing temperature, then exposed to white light and thermally developed was confirmed that the relative relationship between surface sensitivity and internal sensitivity was varied due to disappearance or reduction of spectral sensitization effects.

As apparent from Table 6, it was proved that silver salt photothermographic material samples exhibited reduced fogging (minimum density), enhanced sensitivity and maximum density and superior image lasting quality, compared to comparative samples.

Further, in the image color tone evaluation of the samples according to this invention, the coefficient of determination value $R^2$ was from 0.998 to 1.000; b* value of the intersection of the aforesaid linear regression line with the ordinate was from −5 to +5; gradient (b*/a*) was from 0.7 to 2.5, confirming that superior image color tone was achieved.

Example 5

Photothermographic material sample 501 was prepared similarly to photothermographic material sample 301 in Example 3, provided that reducing agent-1 and reducing agent- 2 were replaced by exemplified compounds RED-10 and RED-17, respectively, and mixed silver halide emulsion (A) was replaced by mixed silver halide emulsion (B).

Photothermographic material sample 502 was prepared similarly to the foregoing sample 501, provided that mixed silver halide emulsion (B) was replaced by mixed silver halide emulsion (A). Similarly, photothermographic material samples 503 to 507 were prepared in the combinations shown in Table 7.

The prepared photothermographic materials 501 to 507 were each expose and thermally processed similarly to Example 3 and evaluated with respect to sensitivity (S), fog (Dmin), maximum density (Dmax) and image lasting quality (ΔDmin, ΔDmax). The sensitivity and maximum density were each represented by a relative value, based on each of the sensitivity and maximum density of sample 501 being 100.

Results are shown in Table 7.

TABLE 7

| Sample No. | AgX No. | Sensitizing Dye*1 | Dmin | S | Dmax | Image Lasting Quality ΔDmin (%) | Image Lasting Quality ΔDmax (%) | Remark |
|---|---|---|---|---|---|---|---|---|
| 501 | B | A + B | 0.202 | 100 (31) | 100 | 135 | 88 | Comp. |
| 502 | A | A + B | 0.200 | 115 (11) | 105 | 109 | 94 | Comp. |
| 503 | B | DD-17 + DD-19 | 0.201 | 105 (29) | 103 | 108 | 93 | Comp. |
| 504 | A | DD-17 + DD-19 | 0.197 | 122 (9) | 110 | 105 | 96 | Inv. |
| 505 | A | DD-5 | 0.196 | 126 (8) | 115 | 104 | 97 | Inv. |
| 506 | A | DD-7 | 0.195 | 131 (5) | 118 | 103 | 98 | Inv. |
| 507 | A | DD-21 | 0.197 | 123 (7) | 112 | 106 | 97 | Inv. |

*1The total amount of sensitizing dye(s) was equimolar to sample 501

As is apparent from Table 7, it was proved that silver salt photothermographic material samples according to this invention exhibited reduced fogging (minimum density), enhanced sensitivity and maximum density and superior image lasting quality, compared to comparative samples. Further, in the image color tone evaluation of the samples according was this invention, the coefficient of determination value $R^2$ was from 0.998 to 1.000; b* value of the intersection of the aforesaid linear regression line with the ordinate was from −5 to +5; gradient (b*/a*) was from 0.7 to 2.5, confirming that superior image color tone was achieved.

What is claimed is:

1. A photothermographic material comprising on a support a light-insensitive silver salt of an aliphatic carboxylic acid, light-sensitive silver halide grains and a reducing agent for silver ions, wherein the photothermographic material further comprises a dye microcapsule dispersion and the photothermographic material meets the following requirement:

$$S_2/S_1 \leqq 0.2$$

wherein $S_1$ represents a sensitivity obtained when exposed and thermally developed, and $S_2$ represents a sensitivity obtained when subjected to a heat treatment at 123° C. for 15 sec., then, exposed and thermally developed.

2. The photothermographic material of claim 1, wherein the dye microcapsule dispersion is prepared by a process comprising the steps of (a) dissolving a dye and a binder in a volatile solvent, (b) dispersing the dye and the binder in an aqueous solution containing a water-soluble resin and water, (c) removing the volatile solvent by evaporation to form microcapsules containing the dye, (d) removing the water by evaporation to obtain the microcapsules, and (e) dispersing the obtained microcapsules in an organic solvent to form the dye microcapsule dispersion.

3. The photothermographic material of claim 2, wherein step (c) further comprises adding a colloidal silica.

4. The photothermographic material of claim 2, wherein step (c) further comprises adding a compound capable of reacting with the water-soluble resin.

5. The photothermographic material of claim 2, wherein the water-soluble resin is gelatin or gum arabic.

6. The photothermographic material of claim 1, wherein the silver halide grains each internally occlude a dopant capable of functioning as an electron trap after being thermally developed.

7. The photothermographic material of claim 6, wherein the dopant is occluded in an amount of from $1\times10^{-8}$ to $1\times10^{-1}$ mol per mol of silver halide.

8. The photothermographic material of claim 6, wherein the dopant is selected from the group consisting of metal ions except for silver ion and their salts or complexes, chalcogens, chalcogen- or nitrogen-containing compounds, and rare earth ions and their complexes.

9. The photothermographic material of claim 8, wherein the dopant is selected from the group consisting of lead ion, bismuth ion, gold ion, and their salts.

10. The photothermographic material of claim 8, wherein the dopant is a complex of a transition metal ion selected from the group consisting of W, Fe, Co, Ni, Cu, Ru, Rh, Pd, Os, Ir and Pt.

11. The photothermographic material of claim 6, wherein the dopant is selected from the group consisting of chalcogens and chalcogen- or nitrogen-containing compounds.

12. The photothermographic material of claim 1, wherein the silver halide grains are silver bromide or silver iodobromide.

* * * * *